US007440836B2

(12) United States Patent
Yasui et al.

(10) Patent No.: US 7,440,836 B2
(45) Date of Patent: Oct. 21, 2008

(54) CONTROL SYSTEM FOR INTERNAL COMBUSTION ENGINE

(75) Inventors: Yuji Yasui, Saitama-ken (JP); Masahiro Sato, Saitama-ken (JP); Mitsunobu Saito, Saitama-ken (JP); Hiroshi Tagami, Saitama-ken (JP); Kosuke Higashitani, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 45 days.

(21) Appl. No.: 11/628,499

(22) PCT Filed: Jun. 10, 2005

(86) PCT No.: PCT/JP2005/010692

§ 371 (c)(1),
(2), (4) Date: Dec. 5, 2006

(87) PCT Pub. No.: WO2005/124135

PCT Pub. Date: Dec. 29, 2005

(65) Prior Publication Data

US 2007/0208486 A1 Sep. 6, 2007

(30) Foreign Application Priority Data

Jun. 15, 2004 (JP) ..... 2004-177195

(51) Int. Cl.
*G06G 7/70* (2006.01)
*F02M 25/07* (2006.01)
*F02D 41/04* (2006.01)

(52) U.S. Cl. ..... 701/101; 701/108; 123/676

(58) Field of Classification Search ..... 701/101, 701/103, 104, 109; 123/429, 672, 676, 679, 123/703, 704
See application file for complete search history.

(56) References Cited

U.S. PATENT DOCUMENTS

| | | | | |
|---|---|---|---|---|
| 4,773,376 | A * | 9/1988 | Uchikawa et al. | 123/697 |
| 5,768,887 | A * | 6/1998 | Nakamura et al. | 60/274 |
| 5,878,733 | A * | 3/1999 | Kato et al. | 123/681 |
| 6,014,962 | A * | 1/2000 | Sato et al. | 123/674 |
| 6,405,122 | B1 * | 6/2002 | Yamaguchi | 701/106 |
| 6,463,912 | B1 * | 10/2002 | Fuwa | 123/480 |
| 6,619,277 | B2 * | 9/2003 | Katoh | 123/672 |

(Continued)

FOREIGN PATENT DOCUMENTS

JP 2001-73834 A 3/2001

(Continued)

*Primary Examiner*—Willis R. Wolfe, Jr.
*Assistant Examiner*—Johnny H. Hoang
(74) *Attorney, Agent, or Firm*—Arent Fox LLP

(57) ABSTRACT

A control system for an internal combustion engine, which is capable of properly performing air-fuel ratio control and ignition timing control according to an actual amount of intake air, even when reliability of the results of detection of the operating condition of a variable intake mechanism is low. The control system for controlling air-fuel ratio and ignition timing includes an ECU. The ECU calculates a target air-fuel ratio, calculates an air-fuel ratio correction coefficient, calculates a statistically processed value of an air-fuel ratio index value, calculates a corrected valve lift and a corrected cam phase, and determines a fuel injection amount according to the corrected valve lift, the corrected cam phase, and the air-fuel ratio correction coefficient.

7 Claims, 33 Drawing Sheets

U.S. PATENT DOCUMENTS 6,701,244 B2 * 3/2004 Oota et al. ..... 701/104
6,814,067 B2 * 11/2004 Yasui et al. ..... 123/679
6,917,874 B2 * 7/2005 Uchida et al. ..... 701/108
6,941,936 B2 * 9/2005 Yasui et al. ..... 123/674
6,980,902 B2 * 12/2005 Nakazawa ..... 701/102
7,027,906 B2 * 4/2006 Araki ..... 701/104
7,043,350 B2 * 5/2006 Abe et al. ..... 701/103
7,124,717 B2 * 10/2006 Gaessler et al. ..... 123/64
7,200,449 B2 * 4/2007 Yasui et al. ..... 700/28
7,295,912 B2 * 11/2007 Yasui et al. ..... 701/103

FOREIGN PATENT DOCUMENTS

JP 2001-152929 A 6/2001
JP 2001-164963 A 6/2001
JP 2002-256930 A 9/2002
JP 2004-100575 A 4/2004

* cited by examiner

| Gcyl \ AP | AP1 | ····· | APj |
|---|---|---|---|
| Gcyl1 | KCMD11 | ····· | KCMD1j |
| ⋮ | ⋮ | ⋱ | ⋮ |
| Gcyli | KCMDi1 | ····· | KCMDij |

FOR Cain_comp=Cainrt

FOR Cain_comp=Cainad

CONTROL SYSTEM FOR INTERNAL COMBUSTION ENGINE

CROSS-REFERENCE TO RELATED APPLICATION

This application is a National Stage entry of International Application No. PCT/JP2005/010692, filed Jun. 10, 2005, the entire specification claims and drawings of which are incorporated herewith by reference.

FIELD OF THE INVENTION

The present invention relates to a control system for an internal combustion engine, which controls the amount of intake air drawn into cylinders of the engine via a variable intake mechanism and controls an air-fuel ratio and ignition timing.

BACKGROUND ART

Conventionally, a control system for an internal combustion engine, which controls the amount of intake air drawn into cylinders of the engine via a variable intake mechanism, has been proposed in Patent Literature 1. This control system is comprised of an air flow sensor that detects the flow rate of air flowing through an intake passage of the engine, a crank angle sensor that detects a state of rotation of a crankshaft, an accelerator pedal opening sensor that detects an opening of an accelerator pedal (hereinafter referred to as "the accelerator pedal opening"), and a controller to which are input detection signals from these sensors. The controller calculates an engine speed based on the detection signal from the crank angle sensor, and the amount of intake air (intake air amount) based on the detection signal from the air flow sensor. Further, the engine is provided with a throttle valve mechanism and a variable valve lift mechanism as variable intake mechanisms. The throttle valve mechanism changes the flow rate of air flowing through the intake passage as desired, and the variable valve lift mechanism changes the lift of each intake valve (hereinafter referred to as "the valve lift") as desired.

As will be described hereinafter, in the control system, the intake air amount is controlled by the controller. First, it is determined based on the engine speed, the accelerator pedal opening, and the intake air amount, in what load region the engine is operating. Then, when it is determined that the engine is in a low-engine speed and low-load region including an idling region, the valve lift is controlled to a predetermined low lift by the variable valve lift mechanism, and the opening of the throttle valve is controlled to a value corresponding to the engine speed and the accelerator pedal opening by the throttle valve mechanism. On the other hand, when it is determined that the engine is between a medium-engine speed and medium-load region and a high-engine speed and high-load region, the throttle valve is controlled to a fully-open state, and the valve lift is controlled to a value corresponding to the engine speed and the accelerator pedal opening.

[Patent Literature 1] Japanese Laid-Open Patent Publication (Kokai) No. 2003-254100

In the control system proposed in Patent Literature 1, it is sometimes impossible to properly calculate the intake air amount, due to a low resolution of the air flow sensor. For example, some type of internal combustion engine has an intake passage whose diameter is set to a large value (i.e. which is set to a large diameter) so as to reduce flow resistance within the intake passage to enhance the charging efficiency of intake air into cylinders. When the above control system is applied to the engine configured as above, the flow velocity of intake air assumes a very low value when the engine is in a low-engine speed and low-load region, and hence the control system cannot properly calculate the intake air amount due to the low resolution of the air flow sensor, which degrades the accuracy of the intake air amount control. As a result, when the air-fuel ratio of a mixture in a combustion chamber is controlled based on the intake air amount thus calculated, there is a fear that the resulting degraded control accuracy lowers fuel economy and increases exhaust emissions.

On the other hand, in the ignition timing control of the engine, a method is conventionally employed which uses an engine speed and an intake air amount as load parameters indicative of load on the engine, and ignition timing maps having map values of ignition timing set in advance in association with the load parameters. In the above-described engine with the intake air passage having a large diameter as well, it is envisaged that ignition timing is controlled by the above method. However, as described above, in the control system proposed in Patent Literature 1, the intake air amount cannot be properly calculated in the low-load region of the engine due to the low resolution of the air flow sensor. This degrades the accuracy of the ignition timing control.

A control system for an internal combustion engine, which is capable of solving the above problems of the conventional control system, has been proposed in Japanese Patent Application No. 2004-133677 by the present assignee. This control system is comprised of an air flow sensor that detects the flow rate of air flowing through an intake passage of the engine, a pivot angle sensor that detects the valve lift, a cam angle sensor that detects the phase of a camshaft for actuating an intake valve to open and close the same with respect to a crankshaft (hereinafter referred to as "the cam phase"), and a crank angle sensor. Further, the engine includes the intake passage having a large diameter, a variable valve lift mechanism, and a variable cam phase mechanism as variable intake mechanisms. In the engine, the valve lift and the cam phase are changed by the variable valve lift mechanism and the variable cam phase mechanism as desired, respectively, whereby the intake air amount is changed as desired.

In the above control system, in the low-load region of the engine, as the intake air amount, a first estimated intake air amount is calculated according to the valve lift and the cam phase, and in the high-load region of the engine, a second estimated intake air amount is calculated according to the flow rate of air. In a load region between the low-load region and the high-load region of the engine, a weighted average value of the first and second estimated intake air amounts is calculated. Furthermore, air-fuel ratio control and ignition timing control are carried out using the thus calculated intake air amount. As a result, by employing the first estimated intake air amount higher in reliability in the low-load region where the reliability of the second estimated intake air amount is lower than that of the first estimated intake air amount due to the large diameter of the intake system of the engine, and employing the second estimated intake air amount higher in reliability in the high-load region in which occurs a state opposite to the above state in the low-load region, it is possible to further enhance the accuracy of the air-fuel ratio control and the ignition timing control compared with the control system proposed in Patent Literature 1.

According to the control system, however, when detection signals from the pivot angle sensor, the cam angle sensor, and the crank angle sensor drift due to changes in temperature, for example, or when the dynamic characteristics of the two variable mechanisms (i.e. the relationship between the valve lift and the cam phase with respect to control inputs) are changed by wear, contamination, play caused by aging, etc., occurring in component parts of the variable valve lift mechanism and the variable cam phase mechanism, the reliability of the results of detection by the sensors lowers. This can hinder the first estimated intake air amount from properly representing an actual intake air amount and cause the same to deviate from the actual intake air amount. When such a state occurs, if the engine is in the low-load region where the first estimated intake air amount is used as the intake air amount, it is impossible to properly calculate a fuel amount and ignition timing, which can degrade the accuracy of the air-fuel ratio control and the ignition timing control. More specifically, there is a possibility that the air-fuel ratio and the ignition timing assume improper values, which results in unstable combustion and degraded combustion efficiency.

The present invention has been made to provide a solution to the above-described problems, and an object thereof is to provide a control system for an internal combustion engine, which is capable of properly performing air-fuel ratio control and ignition timing control according to an actual intake air amount even when reliability of results of detection of an operating condition of a variable intake mechanism is low.

DISCLOSURE OF THE INVENTION

To attain the above object, in a first aspect of the present invention, there is provided a control system for an internal combustion engine, which controls an amount of intake air drawn into a cylinder of the engine by a variable intake mechanism and controls an amount of fuel to be supplied to a combustion chamber, to thereby control an air-fuel ratio of a mixture in the combustion chamber, comprising operating condition parameter-detecting means for detecting an operating condition parameter indicative of an operating condition of the variable intake mechanism, air-fuel ratio parameter-detecting means for detecting an air-fuel ratio parameter indicative of an air-fuel ratio of exhaust gases flowing through an exhaust passage of the engine, target air-fuel ratio-calculating means for calculating a target air-fuel ratio to which the air-fuel ratio of the mixture is to be controlled, air-fuel ratio control parameter-calculating means for calculating an air-fuel ratio control parameter for controlling an air-fuel ratio of the mixture such that the air-fuel ratio becomes equal to the target air-fuel ratio, according to the air-fuel ratio parameter, correction means for correcting the operating condition parameter according to one of the air-fuel ratio control parameter and the air-fuel ratio parameter, and fuel amount-determining means for determining the amount of fuel according to the corrected operating condition parameter and the air-fuel ratio control parameter.

With the configuration of this control system, an air-fuel ratio control parameter for controlling the air-fuel ratio of a mixture such that it becomes equal to a target air-fuel ratio is calculated according to an air-fuel ratio parameter indicative of the air-fuel ratio of exhaust gases flowing through an exhaust passage of the engine; an operating condition parameter indicative of an operating condition of a variable intake mechanism is corrected according to one of the air-fuel ratio control parameter and the air-fuel ratio parameter; and the amount of fuel to be supplied to a combustion chamber is determined according to the corrected operating condition parameter and the air-fuel ratio control parameter. In this case, the amount of intake air drawn into a cylinder of the engine is changed as desired by the variable intake mechanism, and hence the operating condition parameter indicative of the operating condition of the variable intake mechanism corresponds to a value indicative of the amount of the intake air drawn into the cylinder. Therefore, during execution of air-fuel ratio control, when a detection value of the operating condition parameter deviates from an actual value, an actual air-fuel ratio of the mixture deviates toward a leaner side or a richer side with respect to the target air-fuel ratio due to the deviation of the detection value. On the other hand, the air-fuel ratio control parameter is calculated as a value for controlling the air-fuel ratio of the mixture such that it becomes equal to the target air-fuel ratio, according to the air-fuel ratio parameter, in other words, a value indicative which of the leaner side and the richer side the air-fuel ratio is controlled to, so that the air-fuel ratio control parameter reflects the above-described deviation of the air-fuel ratio. Further, the air-fuel ratio parameter is a value indicative of the air-fuel ratio of exhaust gases flowing through the exhaust passage of the engine, and hence when the air-fuel ratio of the mixture is controlled such that it becomes equal to the target air-fuel ratio, the air-fuel ratio parameter as well is detected as a value reflecting the above-described deviation of the air-fuel ratio. Therefore, by correcting the operating condition parameter according to the air-fuel ratio control parameter or the air-fuel ratio parameter, thus calculated or detected, it is possible to properly correct the deviation between the detection value of the operating condition parameter and the actual value. As a result, even when the detection value of the operating condition parameter deviates from the actual value due to a drift of the detection value detected by the operating condition parameter-detecting means, and wear, contamination, play caused by aging, etc., occurring in component parts of the variable intake mechanism, it is possible to properly determine the fuel amount while compensating for the influence of the above deviation. This makes it possible to properly carry out the air-fuel ratio control, thereby making it possible to ensure a stable combustion state and excellent reduction of exhaust emissions.

Preferably, the correction means calculates a control state value indicative of a state of control of the air-fuel ratio of the mixture based on one of the air-fuel ratio control parameter and the air-fuel ratio parameter, calculates a statistically processed value by performing a predetermined sequential statistical process on the control state value, and corrects the operating condition parameter according to the statistically processed value.

With the configuration of this preferred embodiment, a control state value indicative of a state of control of the air-fuel ratio of the mixture in the air-fuel ratio control is calculated based on one of the air-fuel ratio control parameter and the air-fuel ratio parameter; a statistically processed value is calculated by performing a predetermined sequential statistical process on the control state value; and the operating condition parameter is corrected according to the statistically processed value. In the air-fuel ratio control, in general, when the operating condition or the combustion state of the engine changes, the state of control of the air-fuel ratio fluctuates with the above change in a manner oscillating between a direction toward the leaner side and a direction toward the richer side, so that the air-fuel ratio control parameter and the air-fuel ratio parameter are also changed in an oscillating manner to change the control state value in an oscillating manner as well. As a result, when the operating condition parameter is corrected using the thus changed control state value, a value obtained by correcting the operating condition parameter is also changed in an oscillating manner to reduce the accuracy of the air-fuel ratio control. This can cause occurrence of surging and fluctuation in the rotational speed of the engine, resulting in the degraded drivability. In contrast, in the present control system, the operating condition parameter is corrected according to the statistically processed value obtained by performing the predetermined sequential statistical process on the control state value, and hence even when the control state value is changed in an oscillating manner with the change in the operating condition or the combustion state of the engine, it is possible to properly correct the operating condition parameter while avoiding the influence of the oscillatory change in the control state value. As a result, it is possible to control the air-fuel ratio with excellent accuracy, thereby making it possible to ensure excellent drivability.

Preferably, when the statistically processed value is outside a predetermined range, the correction means corrects the operating condition parameter according to the statistically processed value such that the statistically processed value comes to be within the predetermined range, and holds an amount of correction of the operating condition parameter at a fixed value when the statistically processed value is within the predetermined range.

According to the first-mentioned preferred embodiment, the fuel amount is determined according to the corrected operating condition parameter and the air-fuel ratio control parameter, and hence there is a possibility that a process for correcting the operating condition parameter and an air-fuel ration control process interfere with each other. When the two processes interfere with each other, the interference can cause degradation of the accuracy of the air-fuel ration control, and an increase in exhaust emissions. In contrast, with the configuration of the control system according to the present embodiment, when the statistically processed value is outside a predetermined range, the operating condition parameter is corrected according to the statistically processed value such that the statistically processed value comes to be within the predetermined range, whereas when the statistically processed value is within the predetermined range, the amount of correction of the operating condition parameter is held at a fixed value. Therefore, by setting the predetermined range to a range of the statistically processed value which can prevent the accuracy of the air-fuel ratio control from being degraded even when the amount of correction of the operating condition parameter is held at the fixed value by reducing the deviation between the corrected operating condition parameter and the actual value through the process for correcting the operating condition parameter, it is possible to perform the air-fuel ratio control with accuracy while avoiding the interference of the two processes, described above. This makes it possible to enhance the accuracy of the air-fuel ratio control, and reduce exhaust emissions.

Preferably, the control system further comprises air flow rate-detecting means for detecting a flow rate of air flowing through an intake passage of the engine, and load parameter-detecting means for detecting a load parameter indicative of load on the engine, and the fuel amount-determining means determines the amount of fuel according to the corrected operating condition parameter and the air-fuel ratio control parameter when the load parameter is within a first predetermined range, and determines the amount of fuel according to the flow rate of air and the air-fuel ratio control parameter when the load parameter is within a second predetermined range different from the first predetermined range.

With the configuration of this preferred embodiment, the fuel amount is determined according to the corrected operating condition parameter and the air-fuel ratio control parameter when a load parameter is within a first predetermined range, whereas when the load parameter is within a second predetermined range different from the first predetermined range, the fuel amount is determined according to the detected flow rate of air and the air-fuel ratio control parameter. In this case, the corrected operating condition parameter and the detection value of the flow rate of air are both indicative of the amount of intake air. Therefore, by setting the first predetermined range to a range where the corrected operating condition parameter becomes higher in reliability than the detection value of the flow rate of air, and setting the second predetermined range to a range where the detection value of the flow rate of air becomes higher in reliability than the corrected operating condition parameter, it is possible, in both of the load regions, to determine the fuel amount according to a value indicative of the amount of intake air higher in reliability, thereby making it possible to further enhance the accuracy of the air-fuel ratio control.

To attain the above object, in a second aspect of the present invention, there is provided a control system for an internal combustion engine, which controls an amount of intake air drawn into a cylinder of the engine by a variable intake mechanism, and controls ignition timing and an air-fuel ratio of a mixture in a combustion chamber, comprising operating condition parameter-detecting means for detecting an operating condition parameter indicative of an operating condition of the variable intake mechanism, air-fuel ratio parameter-detecting means for detecting an air-fuel ratio parameter indicative of an air-fuel ratio of exhaust gases flowing through an exhaust passage of the engine, target air-fuel ratio-setting means for setting a target air-fuel ratio to which the air-fuel ratio of the mixture is to be controlled, air-fuel ratio control means for controlling the air-fuel ratio of the mixture such that the air-fuel ratio becomes equal to the target air-fuel ratio, according to the air-fuel ratio parameter, correction means for correcting the operating condition parameter according to one of a state of control of the air-fuel ratio of the mixture by the air-fuel ratio control means, and the air-fuel ratio parameter, and ignition timing-determining means for determining the ignition timing according to the corrected operating condition parameter.

With the configuration of this control system, the air-fuel ratio of a mixture is controlled by air-fuel ratio control means such that it becomes equal to a target air-fuel ratio, according to an air-fuel ratio parameter indicative of an air-fuel ratio of exhaust gases flowing through an exhaust passage of the engine; an operating condition parameter indicative of an operating condition of a variable intake mechanism is corrected according to one of a state of control of the air-fuel ratio of the mixture by the air-fuel ratio control means, and the air-fuel ratio parameter; and ignition timing is determined according to the corrected operating condition parameter. As described above, the amount of intake air drawn into a cylinder of the engine is changed as desired by the variable intake mechanism, and hence the operating condition parameter indicative of the operating condition of the variable intake mechanism corresponds to a value indicative of the amount of the intake air drawn into the cylinder. Therefore during execution of air-fuel ratio control, when a detection value of the operating condition parameter deviates from an actual value, an actual air-fuel ratio of the mixture deviates toward a leaner side or a richer side with respect to the target air-fuel ratio due to the deviation of the detection value. On the other hand, the air-fuel ratio of the mixture is controlled by the air-fuel ratio control means such that it becomes equal to the target air-fuel ratio, according to the air-fuel ratio parameter, and hence a state of the air-fuel ratio control reflects the above-described deviation of the air-fuel ratio. Further, the air-fuel ratio parameter is a value indicative of the air-fuel ratio of exhaust gases flowing through the exhaust passage of the engine, and hence when the air-fuel ratio of the mixture is controlled such that it becomes equal to the target air-fuel ratio, the air-fuel ratio parameter as well is detected as a value reflecting the deviation of the air-fuel ratio as described above. Therefore, by correcting the operating condition parameter according to the state of the air-fuel ratio control or the air-fuel ratio parameter, reflecting the deviation of the air-fuel ratio, it is possible to properly correct the deviation between the detection value of the operating condition parameter and the actual value. As a result, even when the detection value of the operating condition parameter deviates from the actual value due to a drift of the detection value detected by operating condition parameter-detecting means, and wear, contamination, play caused by aging, etc., occurring in component parts of the variable intake mechanism, it is possible to properly determine the ignition timing, while compensating for the influence of the above deviation. This makes it possible to properly ensure excellent accuracy of the ignition timing control, thereby making it possible to maintain excellent combustion efficiency and fuel economy.

Preferably, the air-fuel ratio control means calculates an air-fuel ratio control parameter for controlling the air-fuel ratio of the mixture such that the air-fuel ratio becomes equal to the target air-fuel ratio, according to the air-fuel ratio parameter, and the correction means calculates a control state value indicative of a state of control of the air-fuel ratio of the mixture based on one of the air-fuel ratio control parameter and the air-fuel ratio parameter, calculates a statistically processed value by performing a predetermined sequential statistical process on the control state value, and corrects the operating condition parameter according to the statistically processed value.

With the configuration of this preferred embodiment, an air-fuel ratio control parameter for controlling the air-fuel ratio of the mixture such that it becomes equal to the target air-fuel ratio is calculated according to the air-fuel ratio parameter; a control state value indicative of a state of air-fuel ratio control of the mixture is calculated based on one of the air-fuel ratio control parameter and the air-fuel ratio parameter; a statistically processed value is calculated by performing a predetermined sequential statistical process on the control state value; and the operating condition parameter is corrected according to the statistically processed value. As described hereinabove, in the air-fuel ratio control, when the operating condition or the combustion state of the engine is changed, the state of control of the air-fuel ratio fluctuates with the above change in a manner oscillating between the leaner side and the richer side, so that the air-fuel ratio parameter is also changed in an oscillating manner to change the control state value in an oscillating manner as well. As a result, when the operating condition parameter is corrected using the thus changed control state value, a value obtained by correcting the operating condition parameter is also changed in an oscillating manner to reduce the accuracy of the ignition timing control. This can cause occurrence of surging and fluctuation in the rotational speed of the engine, resulting in the degraded drivability. In contrast, in the present control system, the operating condition parameter is corrected according to the statistically processed value obtained by performing the predetermined sequential statistical process on the control state value, and hence even when the control state value is changed in an oscillating manner with the change in the operating condition or the combustion state of the engine, it is possible to correct the operating condition parameter while avoiding the influence of the oscillatory change in the control state value. As a result, it is possible to enhance the accuracy of the ignition timing control, whereby it is possible to improve drivability.

Preferably, the control system further comprises air flow rate-detecting means for detecting a flow rate of air flowing through an intake passage of the engine, and load parameter-detecting means for detecting a load parameter indicative of load on the engine, and the ignition timing-determining means determines the ignition timing according to the corrected operating condition parameter when the load parameter is within a first predetermined range, and determines the ignition timing according to the flow rate of air when the load parameter is within a second predetermined range different from the first predetermined range.

With the configuration of this preferred embodiment, the ignition timing is determined according to the corrected operating condition parameter when the load parameter is within a first predetermined range, whereas when the load parameter is within a second predetermined range different from the first predetermined range, the ignition timing is determined according to the detected flow rate of air. In this case, the corrected operating condition parameter and the detection value of the flow rate of air are both indicative of the amount of intake air. Therefore, by setting the first predetermined range to a range where the corrected operating condition parameter becomes higher in reliability than the detection value of the flow rate of air, and setting the second predetermined range to a range where the detection value of the flow rate of air becomes higher in reliability than the corrected operating condition parameter, it is possible, in both of the load regions, to determine the ignition timing according to a value indicative of the amount of intake air, higher in reliability, whereby it is possible to further enhance the accuracy of the ignition timing control.

BEST MODE FOR CARRYING OUT THE INVENTION

Figure 2:
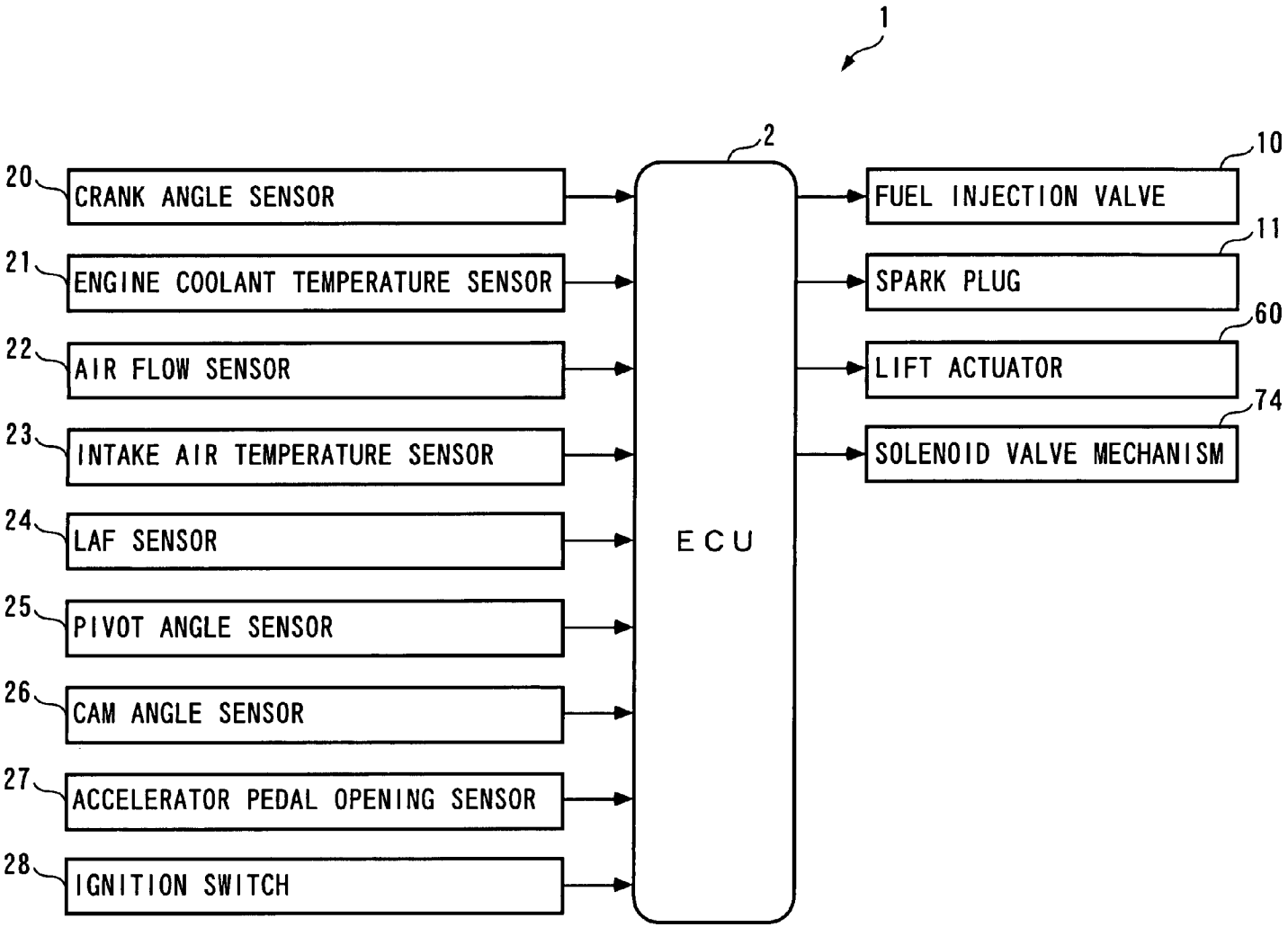
FIG. 2 is a block diagram schematically showing the arrangement of the control system.

Hereafter, a control system for an internal combustion engine, according a first embodiment of the present invention will be described with reference to the drawings. The control system 1 includes an ECU 2, as shown in FIG. 2. As described hereinafter, the ECU 2 carries out control processes, including an air-fuel ratio control process and an ignition timing control process, depending on operating conditions of the internal combustion engine (hereinafter simply referred to as "the engine") 3.

Figure 1:
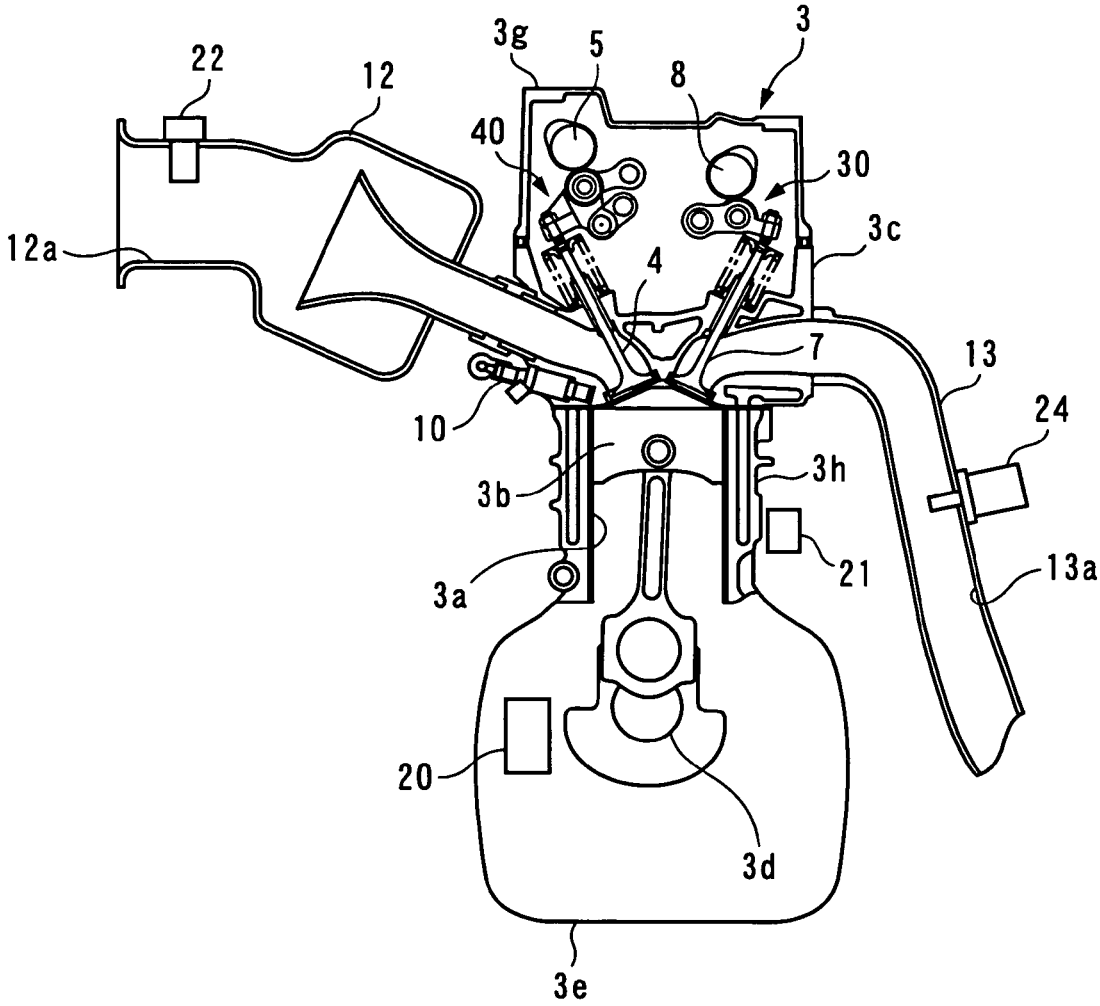
FIG. 1 is a diagram schematically showing the arrangement of an internal combustion engine to which is applied a control system according to a first embodiment of the present invention.
Figure 3:
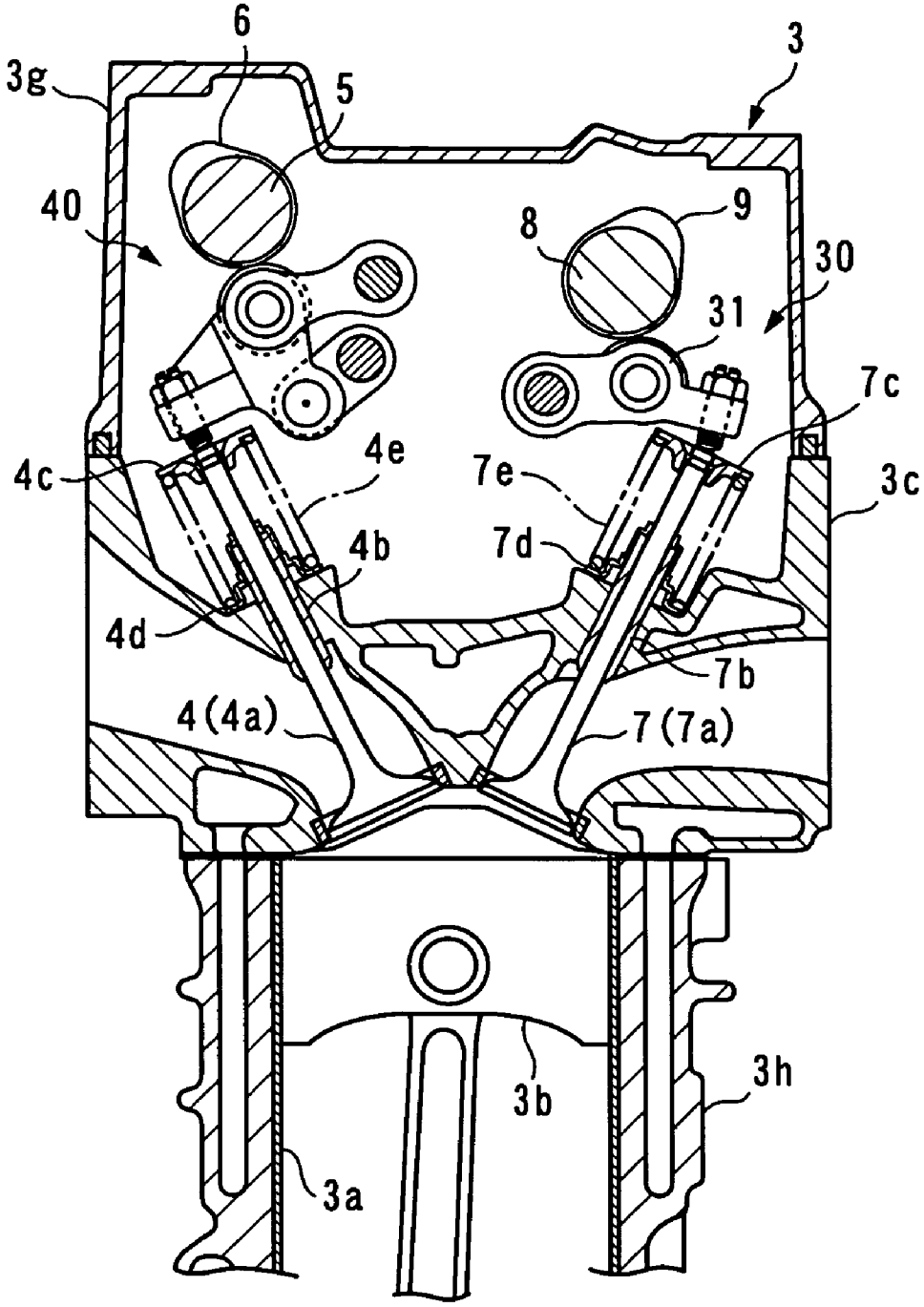
FIG. 3 is a cross-sectional view schematically showing the arrangement of a variable intake valve-actuating mechanism and an exhaust valve-actuating mechanism of the engine.

Referring to FIGS. 1 and 3, the engine 3 is an in-line four-cylinder gasoline engine having a four pairs of cylinders 3*a* and pistons 3*b* (only one pair of which is shown), and installed on a vehicle, not shown, provided with an automatic transmission. The engine 3 includes an intake valve 4 and an exhaust valve 7 provided for each cylinder 3*a*, for opening and closing an intake port and an exhaust port thereof, respectively, an intake camshaft 5 and intake cams 6 for actuating the intake valves 4, a variable intake valve-actuating mechanism 40 that actuates the intake valves 4 to open and close the same, an exhaust camshaft 8 and exhaust cams 9 for actuating the exhaust valves 7, an exhaust valve-actuating mechanism 30 that actuates the exhaust valves 7 to open and close the same, fuel injection valves 10, spark plugs 11 (see FIG. 2), and so forth.

Figure 4:
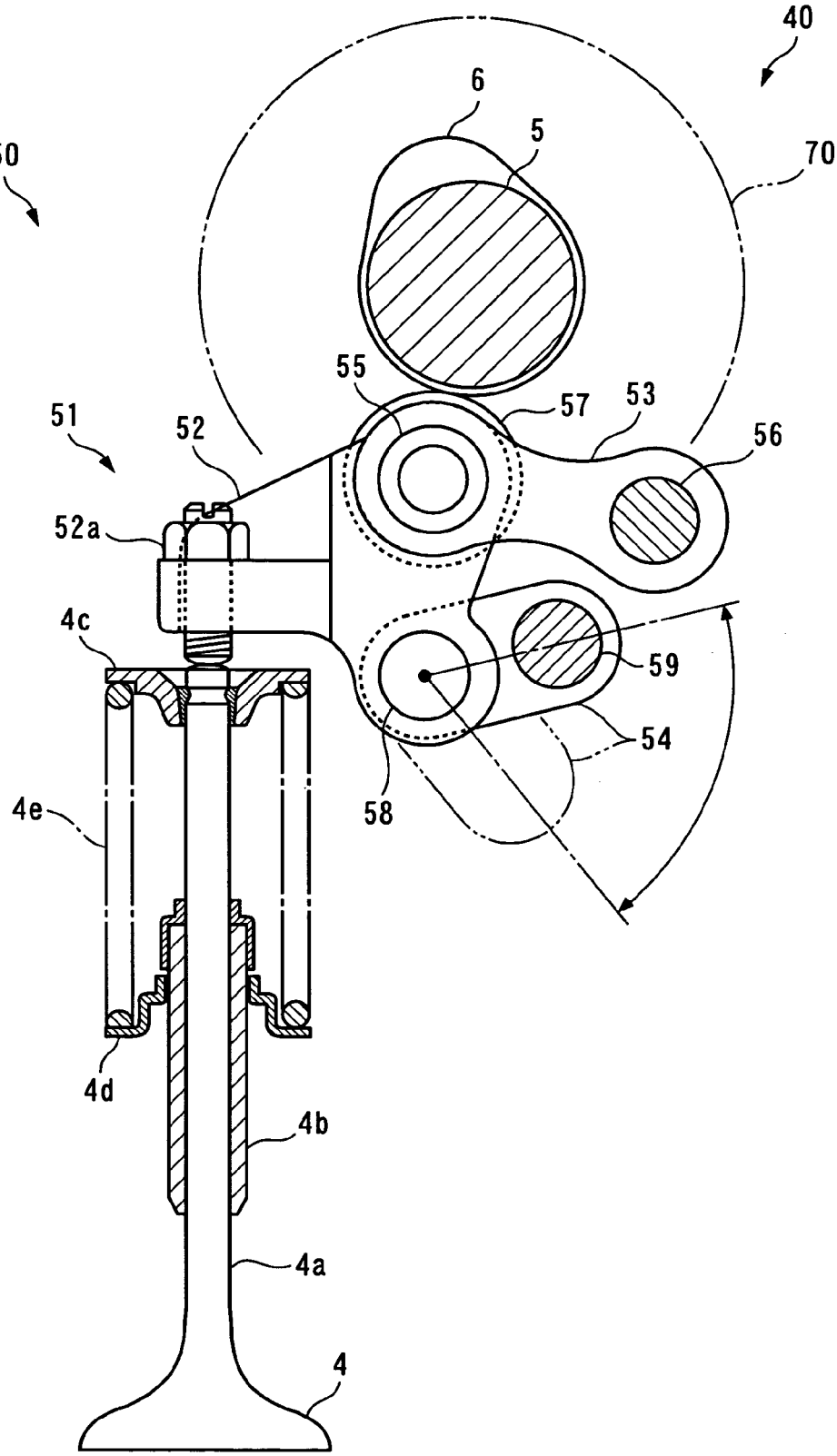
FIG. 4 is a cross-sectional view schematically showing the arrangement of a variable valve lift mechanism of the variable intake valve-actuating mechanism.

The intake valve 4 has a stem 4*a* thereof slidably fitted in a guide 4*b*. The guide 4*b* is rigidly fixed to a cylinder head 3*c*. Further, as shown in FIG. 4, the intake valve 4 includes upper and lower spring sheets 4*c* and 4*d*, and a valve spring 4*e* disposed therebetween, and is urged by the valve spring 4*e* in the valve-closing direction.

Further, the intake camshaft 5 and the exhaust camshaft 8 are rotatably mounted through the cylinder head 3*c* via holders, not shown. The intake camshaft 5 has an intake sprocket (not shown) coaxially and rotatably fitted on one end thereof. The intake sprocket is connected to a crankshaft 3*d* via a timing chain, not shown, and connected to the intake camshaft 5 via a variable cam phase mechanism 70, described hereinafter. With the above configuration, the intake camshaft 5 performs one rotation per two rotations of the crankshaft 3*d*. Further, the intake cam 6 is provided on the intake camshaft 5 for each cylinder 3*a* such that the intake cam 6 rotates in unison with the intake camshaft 5.

Furthermore, the variable intake valve-actuating mechanism 40 is provided for actuating the intake valve 4 of each cylinder 3*a* so as to open and close the same, in accordance with rotation of the intake camshaft 5, and continuously changing the lift and the valve timing of the intake valve 4, which will be described in detail hereinafter. It should be noted that in the present embodiment, "the lift of the intake valve 4" (hereinafter referred to as "the valve lift") represents the maximum lift of the intake valve 4.

On the other hand, the exhaust valve 7 has a stem 7*a* thereof slidably fitted in a guide 7*b*. The guide 7*b* is rigidly fixed to the cylinder head 3*c*. Further, the exhaust valve 7 includes upper and lower spring sheets 7*c* and 7*d*, and a valve spring 7*e* disposed therebetween, and is urged by the valve spring 7*e* in the valve-closing direction.

Further, the exhaust camshaft 8 has an exhaust sprocket (not shown) integrally formed therewith, and is connected to the crankshaft 3*d* by the exhaust sprocket and a timing chain, not shown, whereby the exhaust camshaft 8 performs one rotation per two rotations of the crankshaft 3*d*. Further, the exhaust cam 9 is provided on the exhaust camshaft 8 for each cylinder 3*a* such that the exhaust cam 9 rotates in unison with the exhaust camshaft 8.

Further, the exhaust valve-actuating mechanism 30 includes rocker arms 31. Each rocker arm 31 is pivotally moved in accordance with rotation of the associated exhaust cam 9 to thereby actuate the exhaust valve 7 for opening and closing the same against the urging force of the valve spring 7*e*.

On the other hand, the fuel injection valve 10 is provided for each cylinder 3*a*, and mounted through the cylinder head 3*c* in a tilted state such that fuel is directly injected into a combustion chamber. That is, the engine 3 is configured as a direct injection engine. Further, the fuel injection valve 10 is electrically connected to the ECU 2 and the valve-opening time period and the valve-opening timing thereof are controlled by the ECU 2, whereby the fuel injection amount is controlled.

The spark plug 11 as well is provided for each cylinder 3*a*, and mounted through the cylinder head 3*c*. The spark plug 11 is electrically connected to the ECU 2, and a state of spark discharge is controlled by the ECU 2 such that a mixture in the combustion chamber is burned in timing corresponding to ignition timing, referred to hereinafter.

On the other hand, the engine 3 is provided with a crank angle sensor 20 and an engine coolant temperature sensor 21. The crank angle sensor 20 is comprised of a magnet rotor and an MRE (magnetic resistance element) pickup, and delivers a CRK signal and a TDC signal, which are both pulse signals, to the ECU 2 in accordance with rotation of the crankshaft 3*d*. Each pulse of the CRK signal is generated whenever the crankshaft 3*d* rotates through a predetermined angle (e.g. 10°). The ECU 2 calculates the rotational speed NE of the engine 3 (hereinafter referred to as "the engine speed NE") based on the CRK signal. Further, the TDC signal indicates that each piston 3*b* in the associated cylinder 3*a* is in a predetermined crank angle position slightly before the TDC position at the start of the intake stroke, and each pulse of the TDC signal is generated whenever the crankshaft 3*d* rotates through a predetermined crank angle. In the present embodiment, the crank angle sensor 20 corresponds to operating condition parameter-detecting means and load parameter-detecting means, and the engine speed NE corresponds to a load parameter.

The engine coolant temperature sensor 12 is implemented e.g. by a thermistor, and detects an engine coolant temperature TW to deliver a signal indicative of the sensed engine coolant temperature TW to the ECU 2. The engine coolant temperature TW is the temperature of an engine coolant circulating through a cylinder block 3*h* of the engine 3.

Furthermore, the engine 3 has an intake pipe 12 from which a throttle valve mechanism is omitted, and an intake passage 12*a* which is formed to have a large diameter, whereby the engine 3 is configured such that flow resistance is smaller than in an ordinary engine. The intake pipe 12 is provided with an air flow sensor 22 and an intake air temperature sensor 23 (see FIG. 2).

The air flow sensor 22 (air flow rate-detecting means) is formed by a hot-wire air flow meter, and detects the flow rate Gin of air flowing through the intake passage 12*a* (hereinafter referred to as "the air flow rate Gin") to deliver a signal indicative of the sensed air flow rate Gin to the ECU 2. It should be noted that the air flow rate Gin is indicated in units of g/sec. Further, the intake air temperature sensor 23 detects the temperature TA of the air flowing through the intake passage 12*a* (hereinafter referred to as "the intake air temperature TA"), and delivers a signal indicative of the sensed intake air temperature TA to the ECU 2.

A LAF sensor 24 (air-fuel ratio parameter-detecting means) is inserted into an exhaust pipe 13 of the engine 3 at a location upstream of a catalytic device, not shown. The LAF sensor 24 is comprised of a zirconia layer and platinum electrodes, and linearly detects the concentration of oxygen in exhaust gases flowing through an exhaust passage of the exhaust pipe 13, in a broad air-fuel ratio range from a rich region richer than the stoichiometric ratio to a very lean region, to deliver a signal indicative of the sensed oxygen concentration to the ECU 2. The ECU 2 calculates a detected air-fuel ratio KACT indicative of an air-fuel ratio in the exhaust gases, based on a value of the signal output from the LAF sensor 24. The detected air-fuel ratio KACT (air-fuel ratio parameter) is expressed as an equivalent ratio.

Next, a description will be given of the aforementioned variable intake valve-actuating mechanism 40. As shown in FIG. 4, the variable intake valve-actuating mechanism 40 is comprised of the intake camshaft 5, the intake cams 6, a variable valve lift mechanism 50, and the variable cam phase mechanism 70.

The variable valve lift mechanism 50 (variable intake mechanism) is provided for actuating the intake valves 4 to open and close the same, in accordance with rotation of the intake camshaft 5, and continuously changing the valve lift Liftin between a predetermined maximum value Liftinmax and a predetermined minimum value Liftinmin. The variable valve lift mechanism 50 is comprised of rocker arm mechanisms 51 of a four joint link type, provided for the respective cylinders 3*a*, and a lift actuator 60 (see FIGS. 5(*a*) and 5(*b*)) simultaneously actuating these rocker arm mechanisms 51.

Each rocker arm mechanism 51 is comprised of a rocker arm 52, and upper and lower links 53 and 54. The upper link 53 has one end pivotally mounted to an upper end of the rocker arm 52 by an upper pin 55, and the other end pivotally mounted to a rocker arm shaft 56. The rocker arm shaft 56 is mounted through the cylinder head 3*c* via holders, not shown.

Further, a roller 57 is pivotally disposed on the upper pin 55 of the rocker arm 52. The roller 57 is in contact with a cam surface of the intake cam 6. As the intake cam 6 rotates, the roller 57 rolls on the intake cam 6 while being guided by the cam surface of the intake cam 6. As a result, the rocker arm 52 is vertically driven, and the upper link 53 is pivotally moved about the rocker arm shaft 56.

Furthermore, an adjusting bolt 52*a* is mounted to an end of the rocker arm 52 toward the intake valve 4. When the rocker arm 52 is vertically moved in accordance with rotation of the intake cam 6, the adjusting bolt 52*a* vertically drives the stem 4*a* to open and close the intake valve 4, against the urging force of the valve spring 4*e*.

Further, the lower link 54 has one end pivotally mounted to a lower end of the rocker arm 52 by a lower pin 58, and the other end of the lower link 54 has a connection shaft 59 pivotally mounted thereto. The lower link 54 is connected to a short arm 65, described hereinafter, of the lift actuator 60 by the connection shaft 59.

Figure 5A:
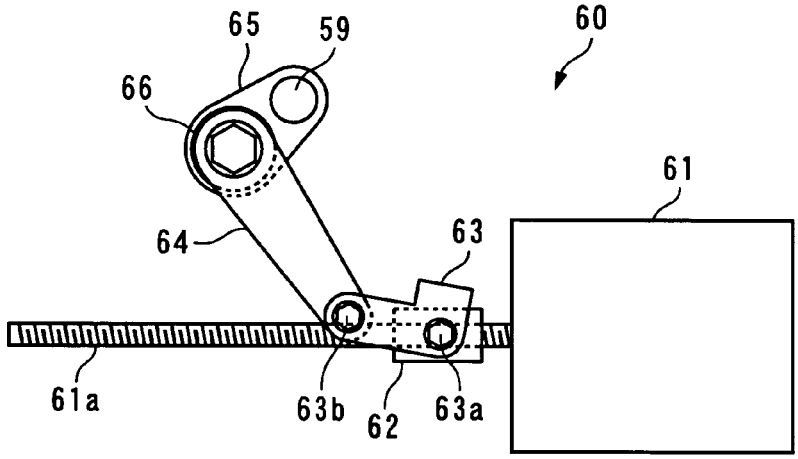
FIG. 5(*a*) is a diagram showing a lift actuator in a state in which a short arm thereof is in a maximum lift position, and FIG. 5(*b*) is a diagram showing the lift actuator in a state in which the short arm thereof is in a minimum lift position.
Figure 5B:
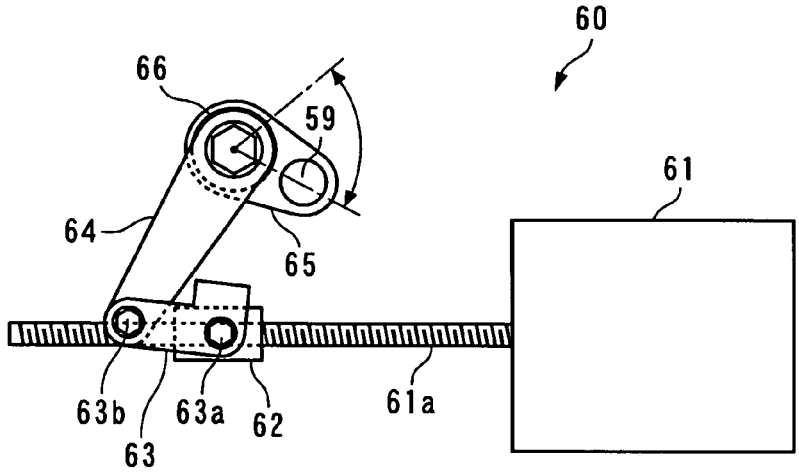

On the other hand, as shown in FIGS. 5(*a*) and 5(*b*), the lift actuator 60 is comprised of a motor 61, a nut 62, a link 63, a long arm 64, and the short arm 65. The motor 61 is connected to the ECU 2, and disposed outside a head cover 3*g* of the engine 3. The rotational shaft of the motor 61 is a screw shaft 61*a* formed with a male screw and the nut 62 is screwed onto the screw shaft 61*a*. The nut 62 is connected to the long arm 64 by the link 63. The link 63 has one end pivotally mounted to the nut 62 by a pin 63*a*, and the other end pivotally mounted to one end of the long arm 64 by a pin 63*b*.

Further, the other end of the long arm 64 is attached to one end of the short arm 65 by a pivot shaft 66. The pivot shaft 66 is circular in cross section, and extends through the head cover 3*g* of the engine 3 such that it is pivotally supported by the head cover 3*g*. The long arm 64 and the short arm 65 are pivotally moved in unison with the pivot shaft 66 in accordance with pivotal motion of the pivot shaft 66.

Furthermore, the aforementioned connection shaft 59 pivotally extends through the other end of the short arm 65, whereby the short arm 65 is connected to the lower link 54 by the connection shaft 59.

Next, a description will be given of the operation of the variable valve lift mechanism 50 configured as above. In the variable valve lift mechanism 50, when a lift control input U_Liftin, described hereinafter, is input from the ECU 2 to the lift actuator 60, the screw shaft 61*a* rotates, and the nut 62 is moved in accordance with the rotation of the screw shaft 61*a*, whereby the long arm 64 and the short arm 65 are pivotally moved about the pivot shaft 66, and in accordance with the pivotal motion of the short arm 65, the lower link 54 of the rocker arm mechanism 51 is pivotally moved about the lower pin 58. That is, the lower link 54 is driven by the lift actuator 60.

In the process, under the control of the ECU 2, the range of pivotal motion of the short arm 65 is restricted between a maximum lift position shown in FIG. 5(*a*) and a minimum lift position shown in FIG. 5(*b*), whereby the range of pivotal motion of the lower link 54 is also restricted between a maximum lift position indicated by a solid line in FIG. 4 and a minimum lift position indicated by a two-dot chain line in FIG. 4.

Figure 6B:
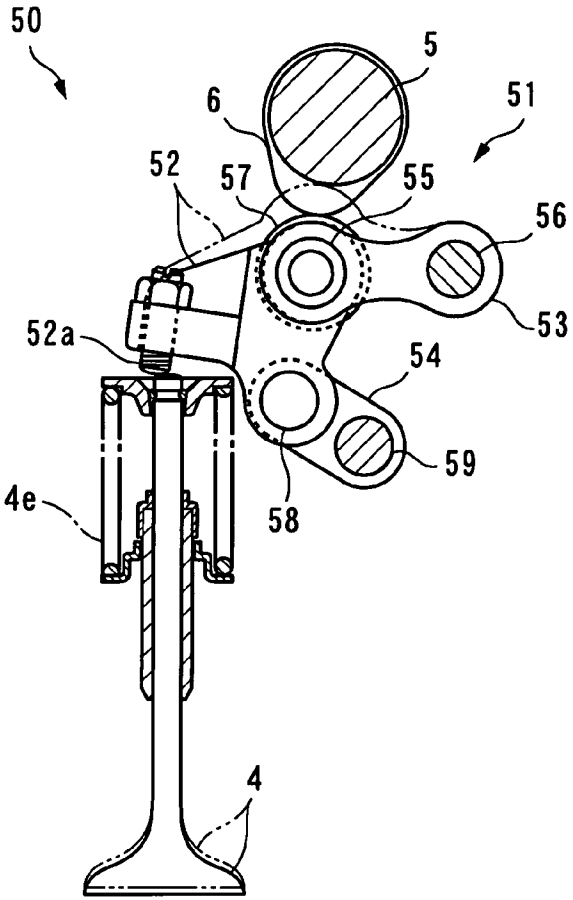
FIG. 6(*a*) is a diagram showing an intake valve placed in an open state when a lower link of the variable valve lift mechanism is in a maximum lift position, and FIG. 6(*b*) is a diagram showing the intake valve placed in an open state when the lower link of the variable valve lift mechanism is in a minimum lift position.
Figure 6A:
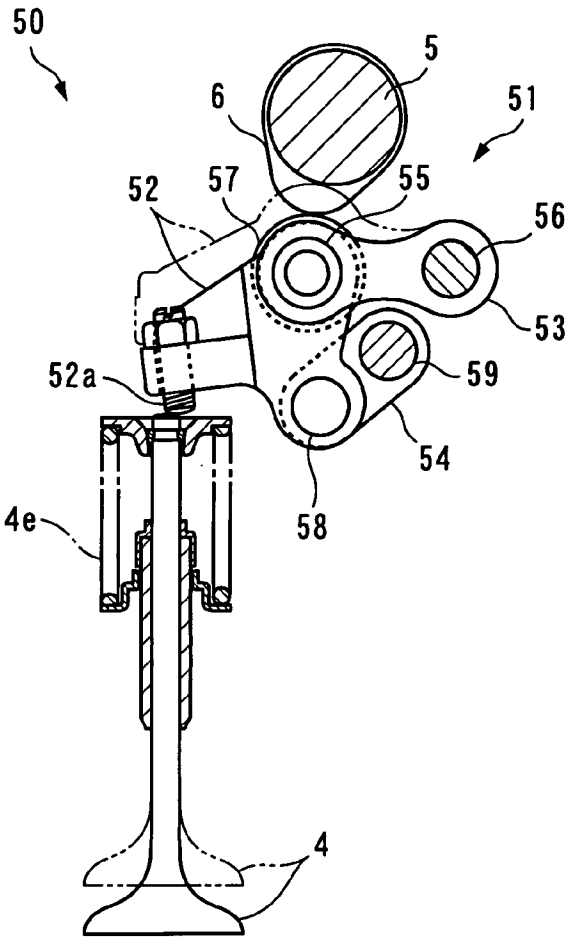

The four joint link formed by the rocker arm shaft 56, the upper and lower pins 55 and 58, and the connection shaft 59 is configured such that when the lower link 54 is in the maximum lift position, the distance between the center of the upper pin 55 and the center of the lower pin 58 becomes longer than the distance between the center of the rocker arm shaft 56 and the center of the connection shaft 59, whereby as shown in FIG. 6(*a*), when the intake cam 6 rotates, the amount of movement of the adjusting bolt 52*a* becomes larger than the amount of movement of a contact point where the intake cam 6 and the roller 57 are in contact with each other.

On the other hand, the four joint link is configured such that when the lower link 54 is in the minimum lift position, the distance between the center of the upper pin 55 and the center of the lower pin 58 becomes shorter than the distance between the center of the rocker arm shaft 56 and the center of the connection shaft 59, whereby as shown in FIG. 6(*b*), when the intake cam 6 rotates, the amount of movement of the adjusting bolt 52*a* becomes smaller than the amount of movement of the contact point where the intake cam 6 and the roller 57 are in contact with each other.

Figure 7:
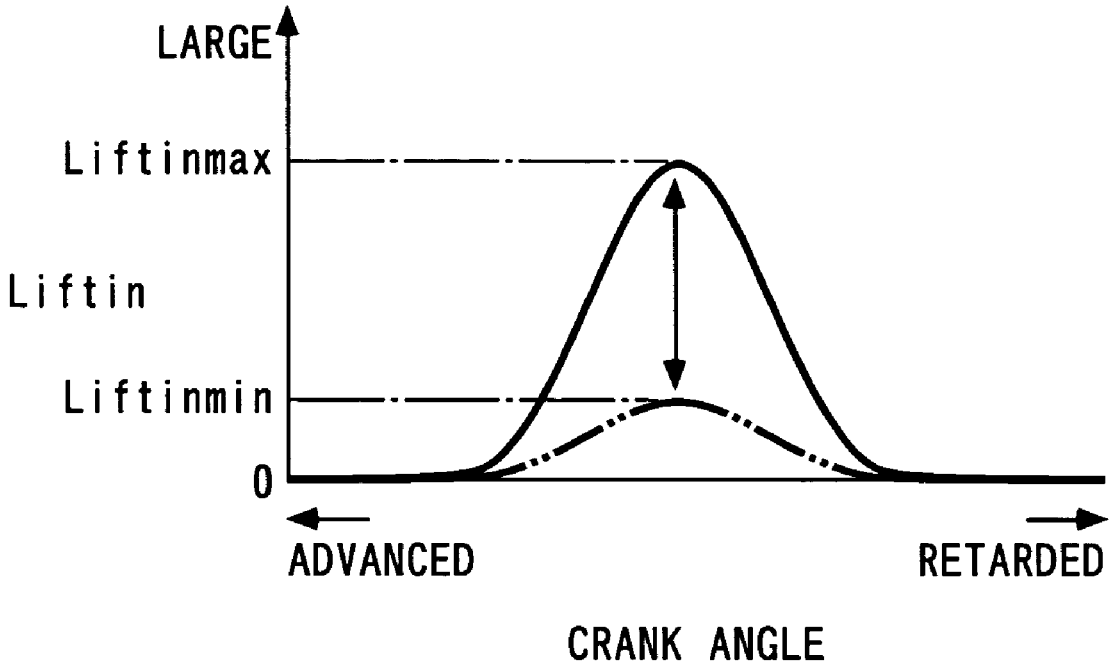
FIG. 7 is a diagram showing a valve lift curve (solid line) which the valve lift of the intake valve assumes when the lower link of the variable valve lift mechanism is in the maximum lift position, and a valve lift curve (two-dot chain line) which the valve lift of the intake valve assumes when the lower link of the variable valve lift mechanism is in the minimum lift position.

For the above reason, when the lower link 54 is in the maximum lift position, the intake valve 4 is opened with a larger valve lift Liftin than when the lower link 54 is in the minimum lift position. More specifically, during rotation of the intake cam 6, when the lower link 54 is in the maximum lift position, the intake valve 4 is opened according to a valve lift curve indicated by a solid line in FIG. 7, and the valve lift Liftin assumes its maximum value Liftinmax. On the other hand, when the lower link 54 is in the minimum lift position, the intake valve 4 is opened according to a valve lift curve indicated by a two-dot chain line in FIG. 7, and the valve lift Liftin assumes its minimum value Liftinmin.

Therefore, in the variable valve lift mechanism 50, the lower link 54 is pivotally moved by the lift actuator 60 between the maximum lift position and the minimum lift position, whereby it is possible to continuously change the valve lift Liftin between the maximum value Liftinmax and the minimum value Liftinmin.

It should be noted that the variable valve lift mechanism 50 is provided with a lock mechanism, not shown, which locks operation of the variable valve lift mechanism 50 when the lift control input U_Liftin is set to a failure time value U_Liftin_fs, referred to hereinafter, and when the lift control input U_Liftin is not input from the ECU 2 to the lift actuator 60 e.g. due to a disconnection. More specifically, the variable valve lift mechanism 50 is inhibited from changing the valve lift Liftin, whereby the valve lift Liftin is held at the minimum value Liftinmin. It should be noted that when a cam phase Cain is held at a locking value, described hereinafter, the minimum value Liftinmin is set to a value which is capable of ensuring a predetermined failure time value Gcyl_fs, referred to hereinafter, as the intake air amount. The predetermined failure time value Gcyl_fs (predetermined value) is set to a value which is capable of suitably carrying out idling or starting of the engine 3 during stoppage of the vehicle, and at the same time holding the vehicle in a state of low-speed traveling when the vehicle is traveling.

The engine 3 is provided with a pivot angle sensor 25 (see FIG. 2). The pivot angle sensor 25 detects a pivot angle of the pivot shaft 66, i.e. the short arm 65, and delivers a signal indicative of the sensed pivot angle to the ECU 2. The ECU 2 calculates the valve lift Liftin based on the signal output from pivot angle sensor 25. In the present embodiment, the pivot angle sensor 25 corresponds to the operating condition parameter-detecting means and the load parameter-detecting means, and the valve lift Liftin corresponds to an operating condition parameter and the load parameter.

Figure 8:
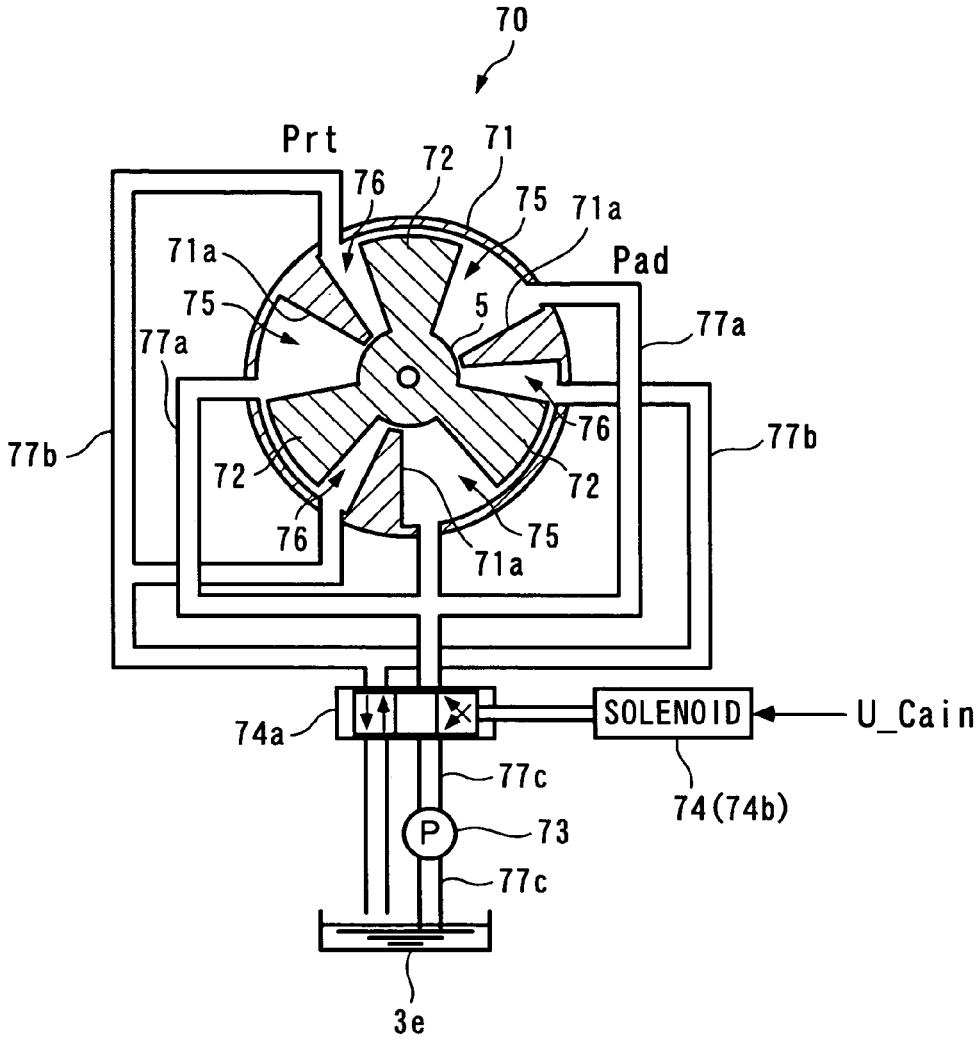
FIG. 8 is a diagram schematically showing the arrangement of a variable cam phase mechanism.

Next, a description will be given of the aforementioned variable cam phase mechanism 70 (variable intake mechanism). The variable cam phase mechanism 70 is provided for continuously advancing or retarding the relative phase Cain of the intake camshaft 5 with respect to the crankshaft 3*d* (hereinafter referred to as "the cam phase Cain"), and mounted on an intake sprocket-side end of the intake camshaft 5. As shown in FIG. 8, the variable cam phase mechanism 70 includes a housing 71, a three-bladed vane 72, an oil pressure pump 73, and a solenoid valve mechanism 74.

The housing 71 is integrally formed with the intake sprocket on the intake camshaft 5*d*, and divided by three partition walls 71*a* formed at equal intervals. The vane 72 is coaxially mounted on the intake sprocket-side end of the intake camshaft 5, such that the vane 72 radially extends outward from the intake camshaft 5, and rotatably housed in the housing 71. Further, the housing 71 has three advance chambers 75 and three retard chambers 76 each formed between one of the partition walls 71*a* and one of the three blades of the vane 72.

The oil pressure pump 73 is of a mechanical type which is connected to the crankshaft 3*d*. As the crankshaft 3*d* rotates, the oil pressure pump 73 draws lubricating oil stored in an oil pan 3*e* of the engine 3 via a lower part of an oil passage 77*c*, for pressurization, and supplies the pressurized oil to the solenoid valve mechanism 74 via the remaining part of the oil passage 77*c*.

The solenoid valve mechanism 74 is formed by combining a spool valve mechanism 74*a* and a solenoid 74*b*, and connected to the advance chambers 75 and the retard chambers 76 via an advance oil passage 77*a* and a retard oil passage 77*b* such that oil pressure supplied from the oil pressure pump 73 is output to the advance chambers 75 and the retard chambers 76 as advance oil pressure Pad and retard oil pressure Prt. The solenoid 74*b* of the solenoid valve mechanism 74 is electrically connected to the ECU 2. When a phase control input U_Cain, referred to hereinafter, is input from the ECU 2, the solenoid 74*b* moves a spool valve element of the spool valve mechanism 74*a* within a predetermined range of motion according to the phase control input U_Cain to thereby change both the advance oil pressure Pad and the retard oil pressure Prt.

Figure 9:
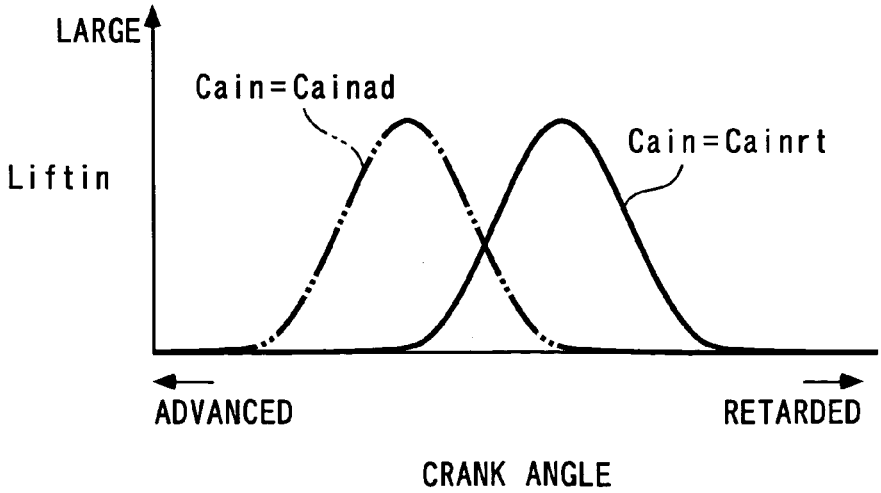
FIG. 9 is a diagram showing a valve lift curve (solid line) which the valve lift of the intake valve assumes when a cam phase is set to a most retarded value by the variable cam phase mechanism, and a valve lift curve (two-dot chain line) which the valve lift of the intake valve assumes when the cam phase is set to a most advanced value by the variable cam phase mechanism.

In the variable cam phase mechanism 70 constructed as above, during operation of the oil pressure pump 73, the solenoid valve mechanism 74 is operated according to the phase control input U_Cain, to supply the advance oil pressure Pad to the advance chambers 75 and the retard oil pressure Prt to the retard chambers 76, whereby the relative phase between the vane 72 and the housing 71 is changed toward an advanced side or a retarded side. As a result, the cam phase Cain described above is continuously changed between a most retarded value Cainrt (e.g. a value corresponding to a cam angle of 0°) and a most advanced value Cainad (e.g. a value corresponding to a cam angle of 55°), whereby valve timing of the intake valve 4 is continuously changed between a most retarded timing indicated by a solid line in FIG. 9 and a most advanced timing indicated by a two-dot chain line in FIG. 9.

It should be noted that the variable cam phase mechanism 70 is provided with a lock mechanism, not shown, which locks operation of the variable cam phase mechanism 70 when oil pressure supplied from the oil pressure pump 73 is low, when the phase control input U_Cain is set to a failure time value U_Cain_fs, referred to hereinafter, or when the phase control input U_Cain is not input to the solenoid valve mechanism 74 e.g. due to a disconnection. More specifically, the variable cam phase mechanism 70 is inhibited from changing the cam phase Cain, whereby the cam phase Cain is held at a predetermined locking value. As described hereinabove, the predetermined locking value is set to a value which is capable of ensuring the predetermined failure time value Gcyl_fs as the intake air amount when the valve lift Liftin is held at the minimum value Liftinmin, as described above.

As described above, in the variable intake valve-actuating mechanism 40 used in the present embodiment, the valve lift Liftin is continuously changed by the variable valve lift mechanism 50, and the cam phase Cain, i.e. the valve timing of the intake valve 4 is continuously changed by the variable cam phase mechanism 70 between the most retarded timing and the most advanced timing, described hereinabove. Further, as described hereinafter, the valve lift Liftin and the cam phase Cain are controlled by the ECU 2 via the variable valve lift mechanism 50 and the variable cam phase mechanism 70, respectively, whereby the intake air amount is controlled.

On the other hand, a cam angle sensor 26 (see FIG. 2) is disposed at an end of the intake camshaft 5 opposite from the variable cam phase mechanism 70. The cam angle sensor 26 is implemented e.g. by a magnet rotor and an MRE pickup, for delivering a CAM signal, which is a pulse signal, to the ECU 2 along with rotation of the intake camshaft 5. Each pulse of the CAM signal is generated whenever the intake camshaft 5 rotates through a predetermined cam angle (e.g. one degree). The ECU 2 calculates the cam phase Cain based on the CAM signal and the CRK signal, described above. In the present embodiment, the cam angle sensor 26 corresponds to the operating condition parameter-detecting means and the load parameter-detecting means, and the cam phase Cain corresponds to the operating condition parameter and the load parameter.

Next, as shown in FIG. 2, connected to the ECU 2 are an accelerator pedal opening sensor 27, and an ignition switch (hereinafter referred to as "the IG•SW") 28. The accelerator pedal opening sensor 27 detects a stepped-on amount AP of an accelerator pedal, not shown, of the vehicle (hereinafter referred to as "the accelerator pedal opening AP") and delivers a signal indicative of the sensed accelerator pedal opening AP to the ECU 2. Further, the IG•SW 28 is turned on or off by operation of an ignition key, not shown, and delivers a signal indicative of the ON/OFF state thereof to the ECU 2.

The ECU 2 is implemented by a microcomputer including a CPU, a RAM, a ROM, and an I/O interface (none of which are shown). The ECU 2 determines operating conditions of the engine 3, based on the detection signals delivered from the above-mentioned sensors 20 to 27, the ON/OFF signal from the IG•SW 28, and the like, and executes control processes. More specifically, as will be described in detail hereinafter, the ECU 2 executes the air-fuel ratio control process and the ignition timing control process according to the operating conditions of the engine 3. Furthermore, the ECU 2 calculates a corrected valve lift Liftin_comp and a corrected cam phase Cain_comp, and controls the valve lift Liftin and the cam phase Cain via the variable valve lift mechanism 50 and the variable cam phase mechanism 70, respectively, to thereby control the intake air amount.

It should be noted that in the present embodiment, the ECU 2 corresponds to the operating condition parameter-detecting means, air-fuel ratio parameter-detecting means, target air-fuel ratio-calculating means, air-fuel ratio control parameter-calculating means, correction means, fuel amount-determining means, the load parameter-detecting means, air-fuel ratio control means, and ignition timing-determining means.

Next, a description will be given of the control system 1 according to the present embodiment. The control system 1 includes an air-fuel ratio controller 100 (see FIG. 10) for carrying out the air-fuel ratio control, and an ignition timing controller 130 (see FIG. 16) for carrying out ignition timing control, both of which are implemented by the ECU 2. In the present embodiment, the air-fuel ratio controller 100 corresponds to the fuel amount-determining means and the air-fuel ratio control means, and the ignition timing controller 130 corresponds to the ignition timing-determining means.

Figure 10:
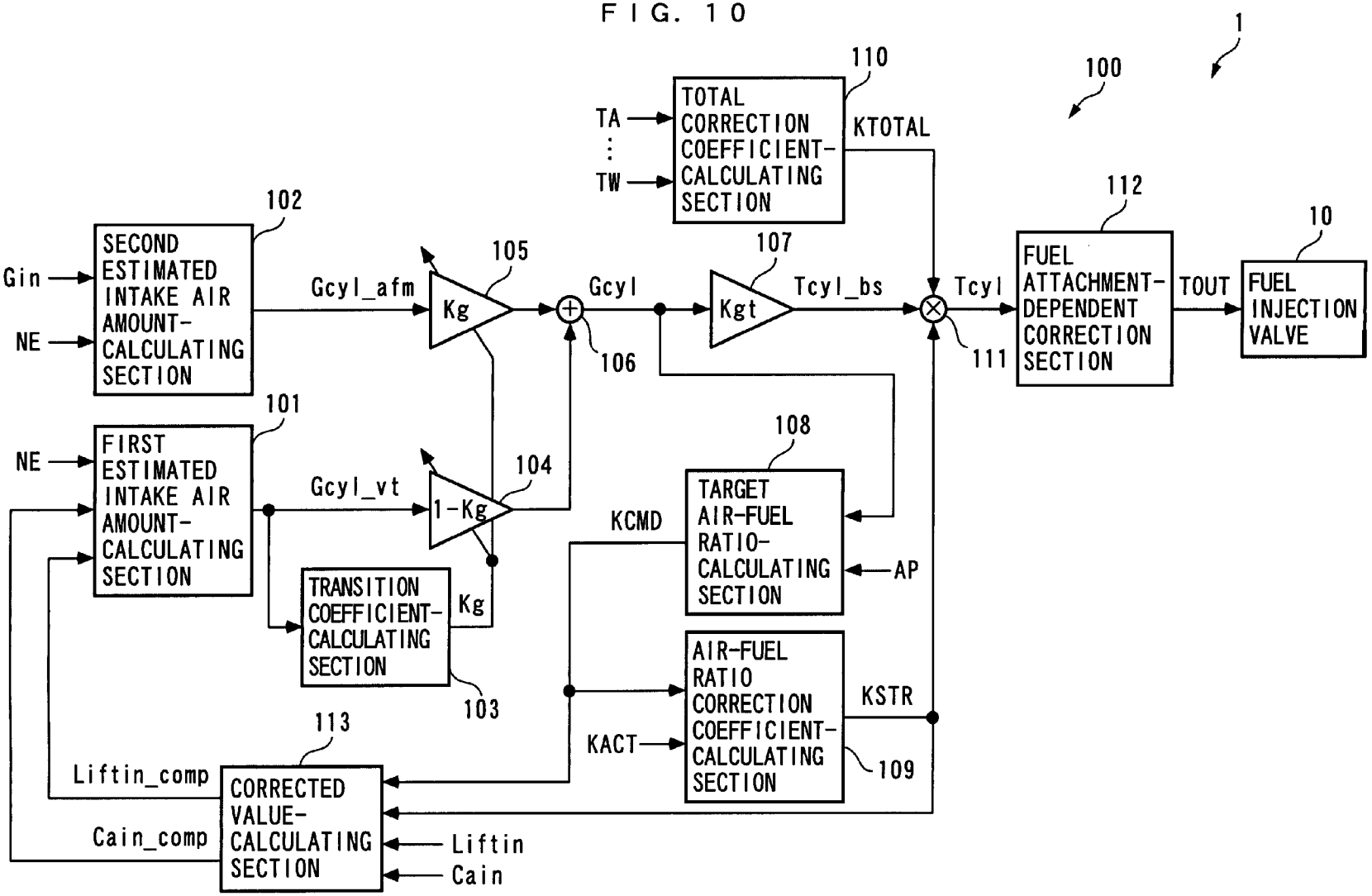
FIG. 10 is a block diagram schematically showing the arrangement of an air-fuel ratio controller.

First, a description will be given of the air-fuel ratio controller 100. As will be described hereinafter, the fuel injection controller 100 is provided for calculating a fuel injection amount TOUT (fuel amount) for each fuel injection valve 10, and as shown in FIG. 10, includes first and second estimated intake air amount-calculating sections 101 and 102, a transition coefficient-calculating section 103, amplification elements 104 and 105, an addition element 106, an amplification element 107, a target air-fuel ratio-calculating section 108, an air-fuel ratio correction coefficient-calculating section 109, a total correction coefficient-calculating section 110, a multiplication element 111, a fuel attachment-dependent correction section 112, and a corrected value-calculating section 113.

Figure 11:
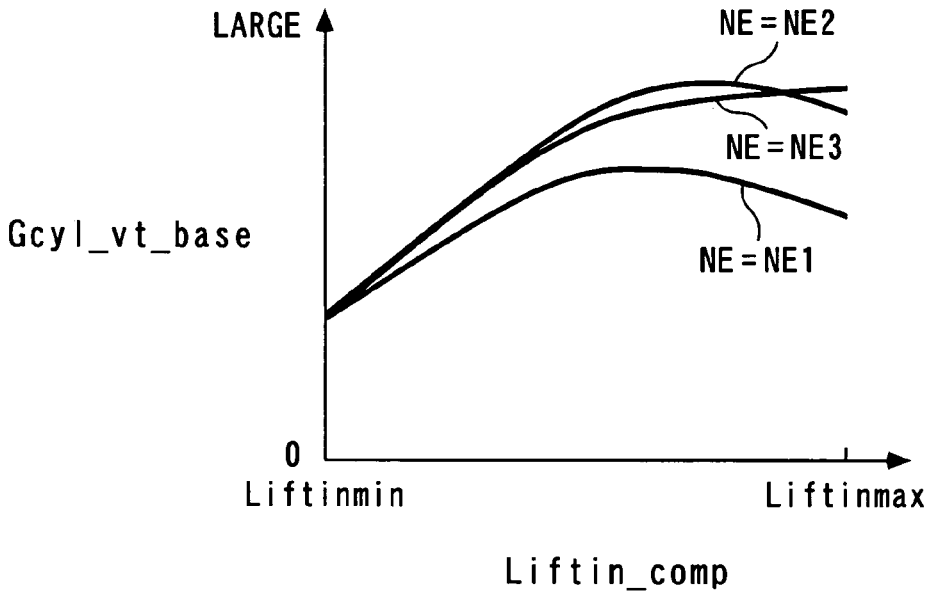
FIG. 11 is a diagram showing an example of a map for use in calculation of a basic estimated intake air amount Gcyl_vt_base.

The first estimated intake air amount-calculating section 101 calculates, as described hereinafter, a first estimated intake air amount Gcyl_vt. More specifically, a basic estimated intake air amount Gcyl_vt_base is calculated by searching a map shown in FIG. 11 according to the engine speed NE and the corrected valve lift Liftin_comp. The corrected valve lift Liftin_comp is a value obtained by correcting the valve lift Liftin, and calculated by the corrected value-calculating section 113, as described hereinafter. Further, in FIG. 11, NE1 to NE3 represent predetermined values of the engine speed NE, between which the relationship of NE1<NE2<NE3 holds. This also applies to the following description.

In this map, when NE=NE1 or NE2 holds, in a region where the corrected valve lift Liftin_comp is small, the basic estimated intake air amount Gcyl_vt_base is set to a larger value as the corrected valve lift Liftin_comp is larger, whereas in a region where the corrected valve lift Liftin_comp is close to the maximum value Liftinmax, the basic estimated intake air amount Gcyl_vt_base is set to a smaller value as corrected valve lift Liftin_comp is larger. This is because in a low-to-medium engine speed region, as the corrected valve lift Liftin_comp is larger in the region where the corrected valve lift Liftin_comp is close to the maximum value Liftinmax, the valve-opening time period of the intake valve 4 becomes longer, whereby charging efficiency is reduced by blow-back of intake air. Further, when NE=NE3 holds, the basic estimated intake air amount Gcyl_vt_base is set to a larger value as the corrected valve lift Liftin_comp is larger. This is because in a high engine speed region, the above-described blow-back of intake air is made difficult to occur even in a region where the corrected valve lift Liftin_comp is large, due to the inertia force of intake air, so that the charging efficiency becomes higher as the corrected valve lift Liftin_comp is larger.

Figure 12:
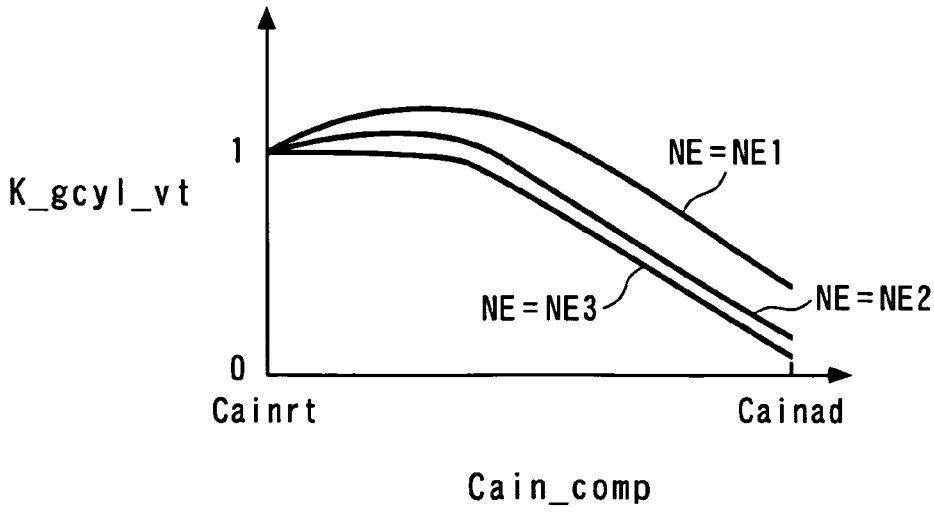
FIG. 12 is a diagram showing an example of a map for use in calculation of a correction coefficient K_gcyl_vt.

Further, a correction coefficient K_gcyl_vt is calculated by searching a map shown in FIG. 12 according to the engine speed NE and the corrected cam phase Cain_comp. The corrected cam phase Cain_comp is a value obtained by correcting the cam phase Cain, and calculated by the corrected value-calculating section 113, as described hereinafter.

In the FIG. 12 map, when NE=NE1 or NE2 holds, in a region where the corrected cam phase Cain_comp is close to the most retarded value Cainrt, the correction coefficient K_gcyl_vt is set to a smaller value as the corrected cam phase Cain_comp is closer to the most retarded value Cainrt, and in the other regions, the correction coefficient K_gcyl_vt is set to a smaller value as the corrected cam phase Cain_comp assumes a value closer to the most advanced value Cainad. This is because in the low-to-medium engine speed region, as the corrected cam phase Cain_comp is closer to the most retarded value Cainrt in the region where the corrected cam phase Cain_comp is close to the most retarded value Cainrt, the valve-closing timing of the intake valve 4 is retarded, whereby the charging efficiency is degraded by the blow-back of intake air, and in the other regions, as the corrected cam phase Cain_comp assumes a value closer to the most advanced value Cainad, the valve overlap is increased to increase the internal EGR amount, whereby the charging efficiency is degraded. Further, when NE=NE3 holds, in the region where the corrected cam phase Cain_comp is close to the most retarded value Cainrt, the correction coefficient K_gcyl_vt is set to a fixed value (a value of 1), and in the other regions, the correction coefficient K_gcyl_vt is set to a smaller value as the corrected cam phase Cain_comp assumes a value closer to the most advanced value Cainad. This is because in the high engine speed region, the blow-back of intake air is made difficult to occur even in a region where the corrected cam phase Cain_comp is close to the most advanced value Cainad, due to the above-mentioned inertia force of intake air.

Then, the first estimated intake air amount Gcyl_vt is calculated using the basic estimated intake air amount Gcyl_vt_base and the correction coefficient K_gcyl_vt, calculated as above, by the following equation (1):

$$Gcyl_vt=K_gcyl_vt\cdot Gcyl_vt_\mathrm{base} \tag{1}$$

Further, the transition coefficient-calculating section 103 calculates a transition coefficient Kg as follows: First, an estimated flow rate Gin_vt (unit: g/sec) is calculated by the following equation (2), using the first estimated intake air amount Gcyl_vt calculated by the first estimated intake air amount-calculating sections 101, and the engine speed NE.

$$Gin_vt=2\cdot Gcyl_vt\cdot NE/60 \tag{2}$$

Figures 13, 14:
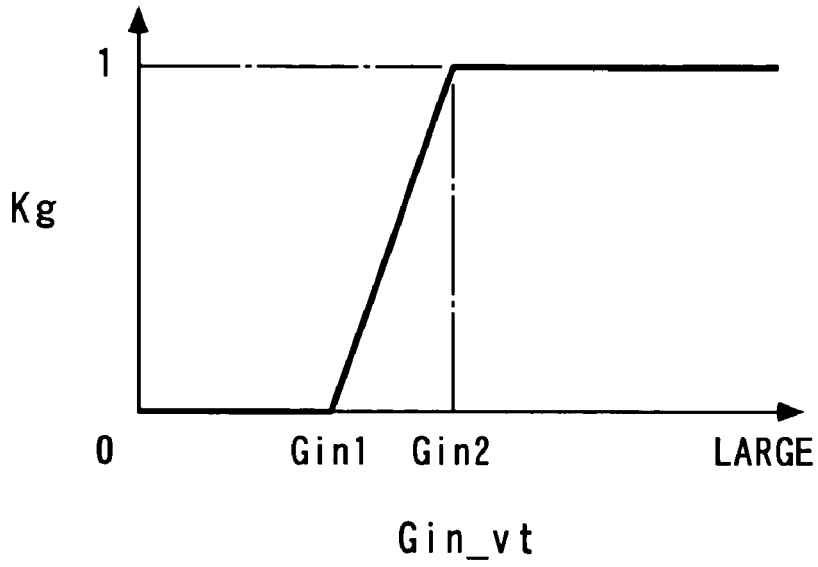
FIG. 13 is a diagram showing an example of a table for use in calculation of a transition coefficient Kg.
FIG. 14 is a diagram showing an example of a map for use in calculation of a target air-fuel ratio KCMD.

Subsequently, the transition coefficient Kg is calculated by searching a table shown in FIG. 13 according to the estimated flow rate Gin_vt. In FIG. 13, Gin1 and Gin2 represent predetermined values between which the relationship of Gin1<Gin2 holds. Since the flow rate of air flowing through the intake passage 12*a* is small when the estimated flow rate Gin_vt is within the Gin_vt≦Gin1, the predetermined value Gin1 is set to such a value as will cause the reliability of the first estimated intake air amount Gcyl_vt to exceed that of a second estimated intake air amount Gcyl_afm, described hereinafter, due to the resolution of the air flow sensor 22. Further, since the flow rate of air flowing through the intake passage 12*a* is large when the estimated flow rate Gin_vt is within the range of Gin2≦Gin_vt, the predetermined value Gin2 is set to such a value as will cause the reliability of the second estimated intake air amount Gcyl_afm to exceed that of the first estimated intake air amount Gcyl_vt. Furthermore, in this table, the transition coefficient Kg is set to a value of 0 when the first estimated intake air amount Gcyl_vt is in the range of Gin_vt≦Gin1, and to a value of 1 when the same is within the range of Gin2≦Gin_vt. When the estimated flow rate Gin_vt is within the range of Gin1<Gin_vt<Gin2, the transition coefficient Kg is set to a value which is between 0 and 1, and at the same time larger as the estimated flow rate Gin_vt is larger.

On the other hand, the second estimated intake air amount-calculating section 102 calculates the second estimated intake air amount Gcyl_afm (unit: g) based on the air flow rate Gin and the engine speed NE, by the following equation (3):

$$Gcyl_afm=Gin\cdot 60/(2\cdot NE) \tag{3}$$

The amplification elements 104 and 105 amplifies the first and second estimated intake air amounts Gcyl_vt and Gcyl_afm, calculated as above, to a (1−Kg)-fold and a Kg-fold, respectively. The addition element 106 calculates a calculated intake air amount Gcyl based on the values thus amplified, by a weighted average arithmetic operation expressed by the following equation (4):

$$Gcyl=Kg\cdot Gcyl_afm+(1-Kg)\cdot Gcyl_vt \tag{4}$$

As is clear from the equation (4), when Kg=0, i.e. within the aforementioned range of Gin_vt≦Gin1, Gcyl=Gcyl_vt holds, and when Kg=1, i.e. within the aforementioned range of Gin2≦Gin_vt, Gcyl=Gcyl_afm holds. When 0<Kg<1, i.e. when the estimated flow rate Gin_vt is within the range of Gin1<Gin_vt<Gin2, the degrees of weighting the first and second estimated intake air amounts Gcyl_vt and Gcyl_afm in the calculated intake air amount Gcyl are determined by the value of the transition coefficient Kg.

Furthermore, the amplification element 107 calculates a basic fuel injection amount Tcyl_bs based on the calculated intake air amount Gcyl (intake air amount), by the following equation (5):

$$Tcyl_bs = Kgt \cdot Gcyl \tag{5}$$

wherein Kgt represents a conversion coefficient set in advance for each fuel injection valve 10.

Further, the target air-fuel ratio-calculating section 108 (target air-fuel ratio-calculating means) calculates a target air-fuel ratio KCMD by searching a map shown in FIG. 14 according to the calculated intake air amount Gcyl and the accelerator pedal opening AP. In this map, the value of the target air-fuel ratio KCMD is set as an equivalent ratio, and basically, it is set to a value corresponding to a stoichiometric air-fuel ratio (14.5) so as to maintain excellent emission-reducing performance of the catalytic converter.

On the other hand, the air-fuel ratio correction coefficient-calculating section 109 is formed as an STR (Self Tuning Regulator) including an onboard identifier (not shown). The air-fuel ratio correction coefficient-calculating section 109 calculates an air-fuel ratio correction coefficient KSTR according to the detected air-fuel ratio KACT and the target air-fuel ratio KCMD. More specifically, the air-fuel ratio correction coefficient KSTR is calculated with an algorithm expressed by the following equations (6) to (13) such that the air-fuel ratio of the mixture, i.e. the detected air-fuel ratio KACT is caused to converge to the target air-fuel ratio KCMD, and as a value in terms of the equivalent ratio. It should be noted that in the present embodiment, the air-fuel ratio correction coefficient-calculating section 109 corresponds to air-fuel ratio control parameter-calculating means, and the air-fuel ratio correction coefficient KSTR corresponds to an air-fuel ratio control parameter and a value indicative of the state of control of the air-fuel ratio.

$$KSTR(n) = \mathrm{Lim}(kstr(n)) \tag{6}$$

$$kstr(n) = \frac{1}{b0(n)}\left\{\begin{array}{c} KCMD(n) - r1(n)\cdot KSTR(n-1) - \\ r2(n)\cdot KSTR(n-2) - r3(n)\cdot \\ KSTR(n-3) - s0(n)\cdot KACT(n) \end{array}\right\} \tag{7}$$

$$\theta(n) = \theta(n-1) + K\Gamma(n)\cdot \mathrm{e_str}(n) \tag{8}$$

$$\mathrm{e_str}(n) = KACT(n) - \theta^T(n-1)\cdot\zeta(n-3) \tag{9}$$

$$K\Gamma(n) = \frac{\Gamma\cdot\zeta(n-3)}{1+\zeta^T(n-3)\cdot\Gamma\cdot\zeta(n-3)} \tag{10}$$

$$\theta^T(n) = [b0(n), r1(n), r2(n), r3(n), s0(n)] \tag{11}$$

$$\zeta^T(n) = \left[\begin{array}{c} KSTR(n), KSTR(n-1), KSTR(n-2), \\ KSTR(n-3), KACT(n) \end{array}\right] \tag{12}$$

$$\Gamma = \begin{bmatrix} \gamma & 0 & 0 & 0 & 0 \\ 0 & \gamma & 0 & 0 & 0 \\ 0 & 0 & \gamma & 0 & 0 \\ 0 & 0 & 0 & \gamma & 0 \\ 0 & 0 & 0 & 0 & \gamma \end{bmatrix} \tag{13}$$

In the above equations (6) to (13), each portion with (n) represents discrete data sampled or calculated every combustion cycle, i.e. whenever a total of four successive pulses of the TDC signal are generated. The symbol n indicates a position in the sequence of sampling cycles of respective discrete data. For example, the symbol n indicates that discrete data therewith is a value sampled in the current control timing, and a symbol n−1 indicates that discrete data therewith is a value sampled in the immediately preceding control timing. It should be noted that in the following description, the symbol (n) and the like provided for the discrete data are omitted as deemed appropriate.

In the equation (6), kstr(n) represents a basic value of the air-fuel ratio correction coefficient (hereinafter simply referred to as "the basic value"), and is calculated by the equation (7). Further, Lim(kstr(n)) represents a value obtained by performing a limiting process on the basic value kstr(n), and is calculated specifically as a value obtained by limiting the basic value kstr(n) within a range defined by a predetermined lower limit value KSTRmin (e.g. a value of 0.6) and a predetermined upper limit value KSTRmax (e.g. a value of 1.4). More specifically, when kstr(n)<KSTRmin, Lim(kstr(n))=KSTRmin holds, when KSTRmin≦kstr(n)≦KSTRmax, Lim(kstr(n))=kstr(n) is set, and when kstr(n)>KSTRmax, Lim(kstr(n))=KSTRmax is set.

The air-fuel ratio correction coefficient KSTR is calculated, as described above, as a value obtained by performing the limiting process on the basic value kstr so as to avoid the engine speed NE from becoming unstable or an engine stall from occurring due to an excessively rich or excessively lean air-fuel ratio of the mixture brought about by failure of the LAF sensor 24 during execution of feedback control of the air-fuel ratio using the air-fuel ratio correction coefficient KSTR.

Further, the equation (7) is derived as follows: When one of the four cylinders 3*a* is regarded as a controlled object to which is input the air-fuel ratio correction coefficient KSTR, and from which is output the detected air-fuel ratio KACT, and the controlled object is modeled into a discrete-time system model, the following equation (14) is obtained. It should be noted that in the equation (14), b0, r1, r2, r3, and s0 represent model parameters.

$$KACT(n) = b0\cdot KSTR(n) + r1(n)\cdot KSTR(n-4) + r2(n)\cdot KSTR(n-5) + r3(n)\cdot KSTR(n-6) + s0(n)\cdot KCMD(n) \tag{14}$$

In the above equation, in the dead time of the detected air-fuel ratio KACT with respect to the target air-fuel ratio KCMD is estimated to correspond to approximately three combustion cycles, and therefore, the relationship of KCMD (n)=KACT (n+3) holds. When this relationship is applied to the equation (14), and KSTR(n) is replaced by kstr(n), the aforementioned equation (7) is derived.

Further, the model parameter vector θ of the model parameters b0, r1, r2, r3, and s0 in the equation (7) is identified with an identification algorithm expressed by the equations (8) to (13). In the equation (8), KΓ represents a vector of a gain coefficient, and e_str an identification error.

The identification error e_str is calculated by the equations (9) to (13). In the equation (9), $\theta^T$ represents a transposed matrix of θ, and is defined by the equation (11). Further, the vector KΓ of the gain coefficient is determined by the equation (10). In equation (10), ζ represents that the transposed matrix is a vector defined by the equation (12), and Γ represents a square matrix of order 5 defined by the equation (13). In the equation (13), γ represents an adaptive gain which is set such that 0<γ holds.

On the other hand, the total correction coefficient-calculating section 110 calculates various correction coefficients by searching maps and tables, none of which are shown, according to parameters, such as the engine coolant temperature TW and the intake air temperature TA, indicative of the operating conditions of the engine 3, and calculates a total correction coefficient KTOTAL by multiplying the thus calculated correction coefficients by each other.

Further, the multiplication element 111 calculates a required fuel injection amount Tcyl by the following equation (15):

$$Tcyl=Tcyl_bs\cdot KSTR\cdot KTOTAL \quad (15)$$

Furthermore, the fuel attachment-dependent correction section 112 calculates the fuel injection amount TOUT by performing a predetermined fuel attachment-dependent correction process on the required fuel injection amount Tcyl calculated as above. Then, the fuel injection valve 10 is controlled such that the fuel injection timing and the valve-opening time period thereof are determined based on the fuel injection amount TOUT.

As expressed by the above equations (5) and (15), the air-fuel ratio controller 100 calculates the fuel injection amount TOUT based on the calculated intake air amount Gcyl, and as expressed by the equation (4), when Kg=0, Gcyl=Gcyl_vt holds, and when Kg=1, Gcyl=Gcyl_afm holds. This is because of the following reasons: As described hereinabove, within the range of Gin_vt≦Gin1, the reliability of the first estimated intake air amount Gcyl_vt exceeds that of the second estimated intake air amount Gcyl_afm, and hence within the above range, the fuel injection amount TOUT is calculated based on the first estimated intake air amount Gcyl_vt higher in reliability, to thereby ensure an excellent accuracy of calculation. Further, within the range of Gin2≦Gin_vt, the flow rate of air flowing through the intake passage 12*a* is large, and the reliability of the second estimated intake air amount Gcyl_afm exceeds that of the first estimated intake air amount Gcyl_vt, so that in the above range, the fuel injection amount TOUT is calculated based on the second estimated intake air amount Gcyl_afm higher in reliability, to thereby ensure an excellent accuracy of calculation.

Further, when 0<Kg<1 holds, the degrees of weighting the first and second estimated intake air amounts Gcyl_vt and Gcyl_afm in the calculated intake air amount Gcyl are determined by the value of the transition coefficient Kg. This is to avoid the occurrence of a torque step because it is considered that when one of Gcyl_vt and Gcyl_afm is directly switched to the other thereof, the torque step is caused by a large difference between the values of the first and second estimated intake air amounts Gcyl_vt and Gcyl_afm. In other words, as described hereinbefore, within the range of Gin1<Gin_vt<Gin2 in which the transition coefficient Kg satisfies the relationship of 0<Kg<1, the transition coefficient Kg is set such that it assumes a value proportional to the estimated flow rate Gin_vt, so that when the estimated flow rate Gin_vt is varied between Gin1 and Gin2, the transition coefficient Kg is progressively changed with the variation in the estimated flow rate Gin_vt. This causes the calculated intake air amount Gcyl to progressively change from a value of one of the first and second estimated intake air amounts Gcyl_vt and Gcyl_afm to a value of the other thereof. As a result, it is possible to avoid occurrence of the torque step.

Next, a description will be given of the corrected value-calculating section 113. As described hereinafter, the corrected value-calculating section 113 is provided for correcting the valve lift Liftin and the cam phase Cain, respectively, to thereby calculate the corrected valve lift Liftin_comp and the corrected cam phase Cain_comp. In the present embodiment, the corrected value-calculating section 113 corresponds to correction means, and the corrected valve lift Liftin_comp and the corrected cam phase Cain_comp correspond to corrected operating condition parameters.

Figure 15:
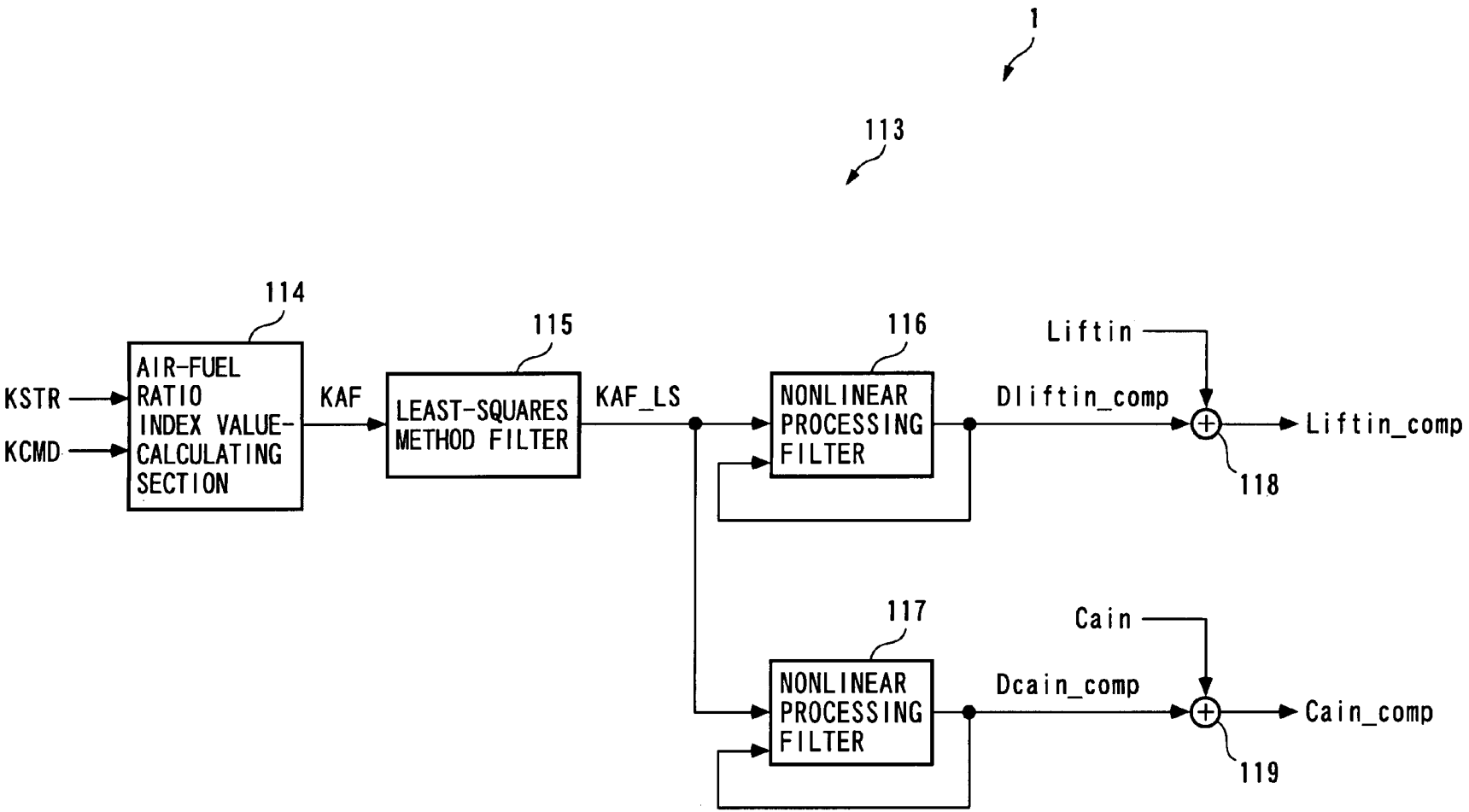
FIG. 15 is a block diagram schematically showing the arrangement of a corrected value-calculating section.

Referring to FIG. 15, the corrected value-calculating section 113 is comprised of an air-fuel ratio index value-calculating section 114, a least-squares method filter 115, nonlinear processing filters 116 and 117, and addition elements 118 and 119. First, the air-fuel ratio index value-calculating section 114 calculates an air-fuel ratio index value KAF (=KSTR/KCMD) by dividing the air-fuel ratio correction coefficient KSTR by the target air-fuel ratio KCMD. In the present embodiment, the air-fuel ratio index value KAF corresponds to a control state value and a value indicative of a control state of the air-fuel ratio.

Then, the least-squares method filter 115 calculates a statistically processed value KAF_LS of the air-fuel ratio index value (hereinafter simply referred to as "the statistically processed value KAF_LS") with a fixed-gain sequential least-squares method algorithm expressed by the following equations (16) and (17):

$$\mathrm{KAF_LS}(k) = \mathrm{KAF_LS}(k-1) + \frac{\mathrm{P_ls}}{1+\mathrm{P_ls}}\cdot \mathrm{e_ls}(k) \quad (16)$$

$$\mathrm{e_ls}(k) = KAF(k) - \mathrm{KAF_LS}(k-1) \quad (17)$$

In the above equation (16), e_ls represents the difference calculated by the equation (17), and P_ls a predetermined gain (fixed value). Further, in the equations (16) and (17), each portion with (k) represents discrete data sampled (or calculated) in synchronism with a predetermined control period ΔT (e.g. 5 msec in the present embodiment). The symbol k indicates a position in the sequence of sampling cycles of respective discrete data. For example, the symbol k indicates that discrete data therewith is a value sampled in the current control timing, and a symbol k−1 indicates that discrete data therewith is a value sampled in the immediately preceding control timing. This applies to the following discrete data. It should be noted that in the following description, the symbol (k) and the like provided for the discrete data are omitted as deemed appropriate.

Further, the nonlinear processing filter 116 calculates a lift correction value Dliftin_comp (correction amount of the operating condition parameter) by one of the following equations (18) to (20) based on the result of comparison between the above statistically processed value KAF_LS and predetermined upper and lower limit values KAF_LSH and KAF_LSL. It should be noted that in the equations (18) and (20), Dinc and Ddec both represent positive predetermined values.

When KAF_LS(k)≧KAF_LSH holds, $$Dliftin_comp(k)=Dliftin_comp(k-1)+Dinc \quad (18)$$

When KAF_LSL<KAF_LS(k)<KAF_LSH holds, $$Dliftin_comp(k)=Dliftin_comp(k-1) \quad (19)$$

When KAF_LS(k)≦KAF_LSL holds, $$Dliftin_comp(k)=Dliftin_comp(k-1)-Ddec \quad (20)$$

Then, the addition element 118 calculates the corrected valve lift Liftin_comp by the following equation (21):

$$Liftin_comp(k)=Liftin(k)+Dliftin_comp(k) \quad (21)$$

The corrected value-calculating section 113 calculates the corrected valve lift Liftin_comp and the lift correction value Dliftin_comp, as described above. This is for the following reason: When the valve lift Liftin is controlled using the aforementioned variable valve lift mechanism 50 and pivot angle sensor 25, the mounting angle of the pivot angle sensor 25 can be changed e.g. due to a change in temperature or an impact thereon, which will cause occurrence of a drift of the signal output from the pivot angle sensor 25, or the tappet clearance can be changed due to wear of the adjusting bolt 52*a*. In such a case, the valve lift Liftin calculated based on the signal output from the pivot angle sensor 25 deviates from an actual valve lift (hereinafter also referred to as "the actual value").

When the above deviation of the valve lift Liftin from the actual value is occurring, if feedback control of the air-fuel ratio by the air-fuel ratio correction coefficient KSTR is performed during a stable operating condition of the engine 3, e.g. during idling of the engine 3, the detected air-fuel ratio KACT cannot converge to the target air-fuel ratio KCMD due to the deviation, and the air-fuel ratio continues to be made leaner or richer. For example, when the valve lift Liftin assumes a smaller value than the actual value, an actual intake air amount assumes a larger value than that of the calculated intake air amount Gcyl, whereby the detected air-fuel ratio KACT deviates toward the leaner side with respect to the target air-fuel ratio KCMD. As a result, the air-fuel ratio continues to be made richer, and the air-fuel ratio correction coefficient KSTR is set to a larger value than the target air-fuel ratio KCMD, which causes the air-fuel ratio index value KAF (=KSTR/KCMD) to assume a larger value than a value of 1. Inversely, when the valve lift Liftin assumes a larger value than the actual value, the air-fuel ratio index value KAF assumes a smaller value than a value of 1.

The above-described correlation exists between the deviation of the valve lift Liftin from the actual value and the air-fuel ratio index value KAF, and in the present embodiment, the air-fuel ratio control is carried out using the calculated intake air amount Gcyl calculated according to the corrected valve lift Liftin_comp, so that the deviation of the corrected valve lift Liftin_comp from the actual value is reflected on the air-fuel ratio index value KAF.

Therefore, when KAF_LS(k)≧KAF_LSH holds, since the corrected valve lift Liftin_comp used for calculation of the calculated intake air amount Gcyl deviates from the actual value toward the smaller side, the air-fuel ratio is controlled to be richer, so that by increasing the lift correction value Dliftin_comp, as expressed by the equation (18), it is possible to make the corrected valve lift Liftin_comp closer to the actual valve lift (see FIG. 36, referred to hereinafter). On the other hand, when KAF_LS(k)≦KAF_LSL holds, since the corrected valve lift Liftin_comp deviates from the actual value toward the larger side, the air-fuel ratio is controlled to be leaner, so that by decreasing the lift correction value Dliftin_comp as expressed by the equation (20), it is possible to make the corrected valve lift Liftin_comp closer to the actual valve lift.

Further, when KAF_LSL<KAF_LS(k)<KAF_LSH holds, the lift correction value Dliftin_comp is held at a fixed value without being updated. This is to avoid a process for calculating the corrected valve lift Liftin_comp and the feedback control of the air-fuel ratio from interfering with each other by holding the lift correction value Dliftin_comp at the fixed value and stopping update of the corrected valve lift Liftin_comp. Further, since deviation between the corrected valve lift Liftin_comp and the actual value is small, the upper and lower limit values KAF_LSH and KAF_LSL are set to values (e.g. KAF_LSH=1.1, KAF_LSL=0.9) which can prevent the accuracy of the air-fuel ratio control from being degraded even if the lift correction value Dliftin_comp is held at the fixed value, and update of the corrected valve lift Liftin_comp is stopped.

On the other hand, the nonlinear processing filter 117 calculates a phase correction value Dcain_comp (correction amount of the operating condition parameter) by one of the following equations (22) to (24) based on the result of comparison between the above-described statistically processed value KAF_LS and predetermined upper and lower limit values KAF_LSH and KAF_LSL.

When KAF_LS(k)≧KAF_LSH holds, $$Dcain_comp(k)=Dcain_comp(k-1)+Dcomp \tag{22}$$

When KAF_LSL<KAF_LS(k)<KAF_LSH holds, $$Dcain_comp(k)=Dcain_comp(k-1) \tag{23}$$

When KAF_LS(k)≦KAF_LSL holds, $$Dcain_comp(k)=Dcain_comp(k-1)+Dcomp' \tag{24}$$

In the above equations (22) and (24), Dcomp and Dcomp' represent correction terms, and are set to the following values based on the result of comparison between the cam phase Cain, and predetermined advanced and retarded values Cain_adv and Cain_ret. It should be noted that the following Dadv and Dret both represent positive predetermined values.

When Cain(k)>Cain_adv holds,

Dcomp=Dadv

Dcomp'=−Dret

When Cain_ret≦Cain(k)≦Cain_adv holds,

Dcomp=0

Dcomp'=0

When Cain(k)<Cain_ret holds,

Dcomp=−Dret

Dcomp'=Dadv

Then, the addition element 119 calculates the corrected cam phase Cain_comp by the following equation (25):

$$Cain_comp(k)=Cain(k)+Dcain_comp(k) \tag{25}$$

The corrected value-calculating section 113 calculates the corrected cam phase Cain_comp and the phase correction value Dcain_comp, as described above. This is for the following reason: When the cam phase Cain is controlled using the variable cam phase mechanism 70, the crank angle sensor 20, and the cam angle sensor 26, described hereinabove, due to drifts of the signals output from the sensors 20 and 26, which are caused by changes in temperatures of the two sensors 20 and 26, and slack of the timing chain, the cam phase Cain calculated based on the signals output from the sensors 20 and 26 can deviate toward the advanced side or the retarded side with respect to an actual cam phase (hereinafter referred to as "the actual value").

As described above, when the cam phase Cain deviates toward the advanced side or the retarded side with respect to the actual value, if the feedback control of the air-fuel ratio is carried out as described above, the detected air-fuel ratio KACT cannot converge to the target air-fuel ratio KCMD due to a change in the valve overlap or a change in the amount of blow-back of intake air caused by retarded closing of the intake valve 4, so that the air-fuel ratio continues to be made leaner or richer. As a result, the air-fuel ratio index value KAF assumes a smaller value or a larger value than a value of 1. The correlation as described above also exists between the deviation of the cam phase Cain from the actual value and the air-fuel ratio index value KAF. In the present embodiment, since the air-fuel ratio control is performed using the calculated intake air amount Gcyl calculated according to the corrected cam phase Cain_comp, the deviation of the corrected cam phase Cain_comp from the actual value is reflected on the air-fuel ratio index value KAF.

Therefore, when KAF_LS(k)≧KAF_LSH holds, and the air-fuel ratio is controlled to be richer, if Cain(k)>Cain_adv holds, and the cam phase Cain assumes a value in an advanced range, the corrected cam phase Cain_comp used for calculation of the calculated intake air amount Gcyl deviates toward the retarded side with respect to the actual value, whereby the actual intake air amount is larger than the calculated intake air amount Gcyl due to reduction of the valve overlap. Accordingly, it is presumed that the detected air-fuel ratio KACT deviates toward the leaner side with respect to the target air-fuel ratio KCMD. This makes it necessary to correct the corrected cam phase Cain_comp such that it is more advanced, and hence in the equation (22), the correction term Dcomp is set to a value of Dadv such that the phase correction value Dcain_comp is calculated to be a larger value.

Furthermore, when KAF_LS(k)≧KAF_LSH holds, if Cain(k)<Cain_ret holds, and the cam phase Cain assumes a value in a retarded range, the corrected cam phase Cain_comp deviates toward the advanced side with respect to the actual value, whereby due to the reduced degree of the retarded closing of the intake valve 4, the amount of blow-back of intake air is reduced and the actual intake air amount is larger than the calculated intake air amount Gcyl. Accordingly, it is presumed that the detected air-fuel ratio KACT deviates toward the leaner side with respect to the target air-fuel ratio KCMD. This makes it necessary to correct the corrected cam phase Cain_comp such that it is more retarded, and therefore in the equation (22), the correction term Dcomp is set to a value of −Dret such that the phase correction value Dcain_comp is calculated to be a smaller value.

On the other hand, when KAF_LS(k)≦KAF_LSL holds, and the air-fuel ratio is controlled to be leaner, if Cain(k)>Cain_adv holds, and the cam phase Cain assumes a value in the advanced range, the corrected cam phase Cain_comp deviates toward the advanced side with respect to the actual value, whereby the actual intake air amount is smaller than the calculated intake air amount Gcyl due to an increase in the valve overlap. Accordingly, it is presumed that the detected air-fuel ratio KACT deviates toward the richer side with respect to the target air-fuel ratio KCMD. This makes it necessary to correct the corrected cam phase Cain_comp such that it is more retarded, and hence in the equation (24), the correction term Dcomp' is set to a value of −Dret such that the phase correction value Dcain_comp is calculated to be a smaller value.

Furthermore, when KAF_LS(k)≦KAF_LSL holds, if Cain(k)<Cain_ret holds, and the cam phase Cain assumes a value in the retarded range, the corrected cam phase Cain_comp deviates toward the retarded side with respect to the actual value, whereby due to the increased degree of the retarded closing of the intake valve 4, the amount of blow-back of intake air is increased, and the actual intake air amount is smaller than the calculated intake air amount Gcyl. Accordingly, it is presumed that the detected air-fuel ratio KACT deviates toward the richer side with respect to the target air-fuel ratio KCMD. This makes it necessary to correct the corrected cam phase Cain_comp such that it is more advanced, and therefore in the equation (24), the correction term Dcomp' is set to the value of Dadv such that the phase correction value Dcain_comp is calculated to be a larger value.

On the other hand, when KAF_LSL<KAF_LS(k)<KAF_LSH holds, and when Cain_ret≦Cain(k)≦Cain_adv holds, the phase correction value Dcain_comp is held at a fixed value without being updated. This is to avoid a process for calculating the corrected cam phase Cain_comp and feedback control of the air-fuel ratio from interfering with each other by holding the phase correction value Dcain_comp at the fixed value and stopping update of the corrected cam phase Cain_comp. Further, since deviation between the corrected cam phase Cain_comp and the actual value is small, the upper and lower limit values KAF_LSH and KAF_LSL are set to values (e.g. KAF_LSH=1.1, KAF_LSL=0.9) which can prevent the accuracy of the air-fuel ratio control from being degraded even if the phase correction value Dcain_comp is held at the fixed value, and the update of the corrected cam phase Cain_comp is stopped. Furthermore, to avoid the accuracy of the air-fuel ratio control from being degraded, the predetermined values Cain_adv and Cain_ret as well are set to values which make it possible to stop the update of the corrected cam phase Cain-comp in a range where the change in the intake air amount with respect to the actual value of the cam-phase Cain is considerately small (for example, Cain_adv is set to a value corresponding to a cam angle of 30°, and Cain_ret to a value corresponding to a cam angle of 10°).

Figure 16:
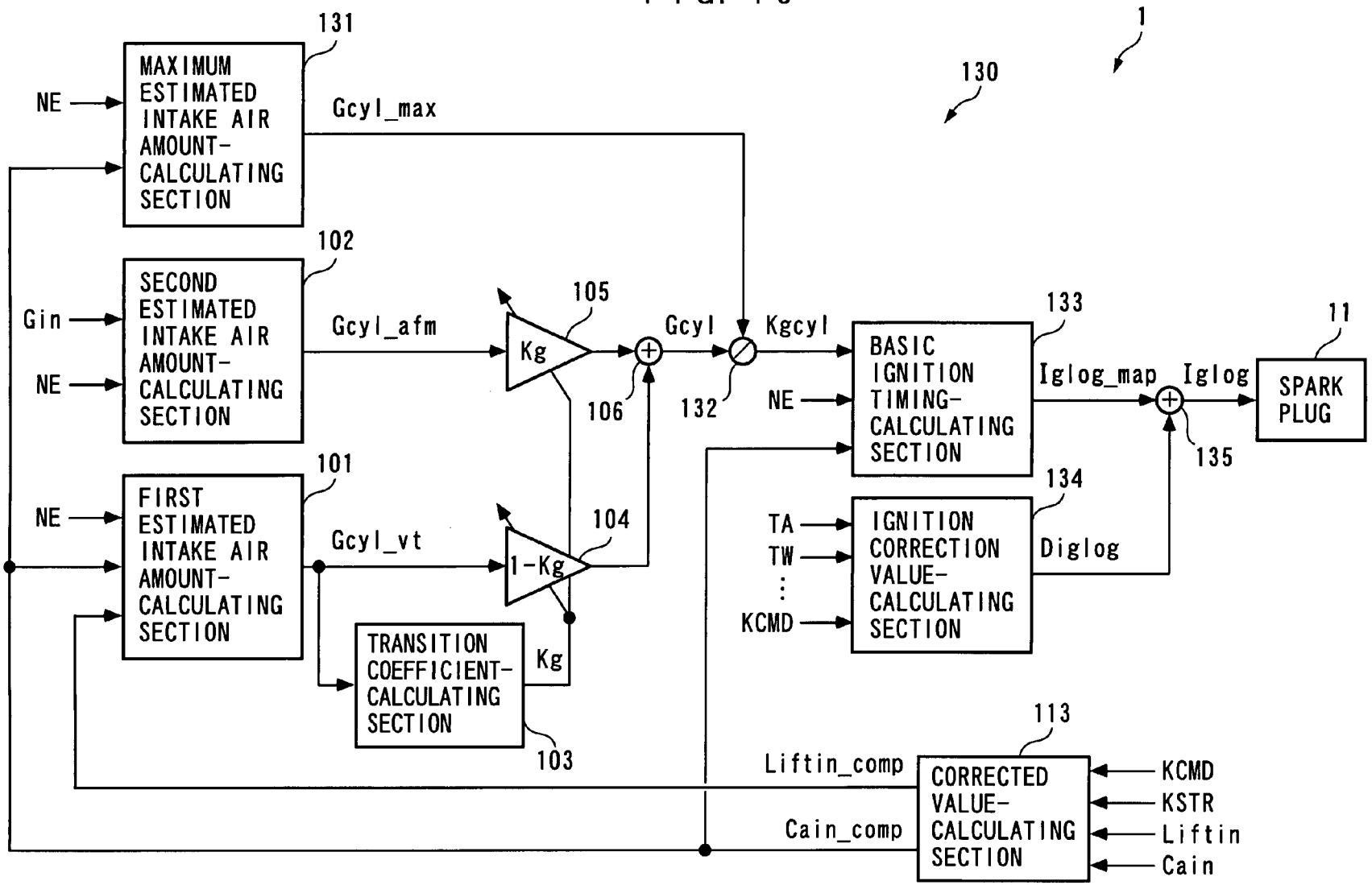
FIG. 16 is a block diagram schematically showing the arrangement of an ignition timing controller.

Next, the ignition timing controller 130 (ignition timing-determining means) will be described with reference to FIG. 16. As shown in FIG. 16, in the ignition timing controller 130, part thereof is configured similarly to the air-fuel ratio controller 100 described above, and hence component elements of the ignition timing controller 130 identical to those of the air-fuel ratio controller 100 are designated by identical reference numerals, and detailed description thereof is omitted. As described hereinafter, the ignition timing controller 130 calculates ignition timing Iglog, and is comprised of the first and second estimated intake air amount-calculating sections 101 and 102, the transition coefficient-calculating section 103, the amplification elements 104 and 105, the addition element 106, a maximum estimated intake air amount-calculating section 131, a division element 132, a basic ignition timing-calculating section 133, an ignition correction value-calculating section 134, and an addition element 135.

Figure 17:
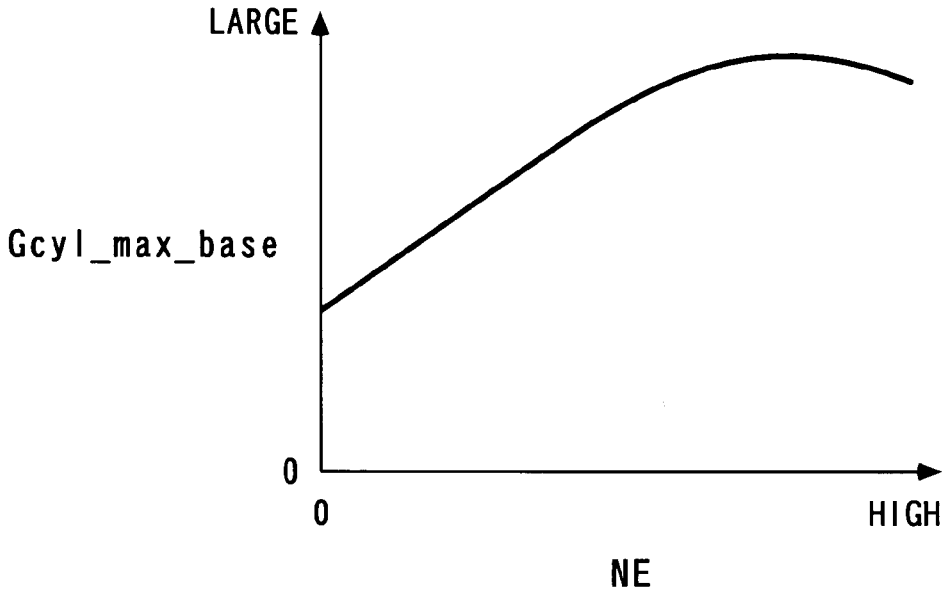
FIG. 17 is a diagram showing an example of a table for use in calculation of a maximum estimated intake air amount Gcyl_max.

The maximum estimated intake air amount-calculating section 131 calculates, as described hereinafter, a maximum estimated intake air amount Gcyl_max according to the engine speed NE and the corrected cam phase Cain_comp. More specifically, first, a basic value Gcyl_max_base of the maximum estimated intake air amount is calculated by searching a table shown in FIG. 17 according to the engine speed NE. In this table, in the low-to-medium engine speed region, the basic value Gcyl_max_base is set to a larger value as the engine speed NE is higher, and in the high engine speed region, the basic value Gcyl_max_base is set to a smaller value as the engine speed NE is higher. In the medium engine speed region, the table is configured such that when the engine speed NE assumes a predetermined value, the basic value Gcyl_max_base is set to a maximum value. This is because from the viewpoint of drivability, the intake system is configured such that the charging efficiency becomes highest when the engine speed NE assumes the predetermined value in the medium engine speed region.

Figure 18:
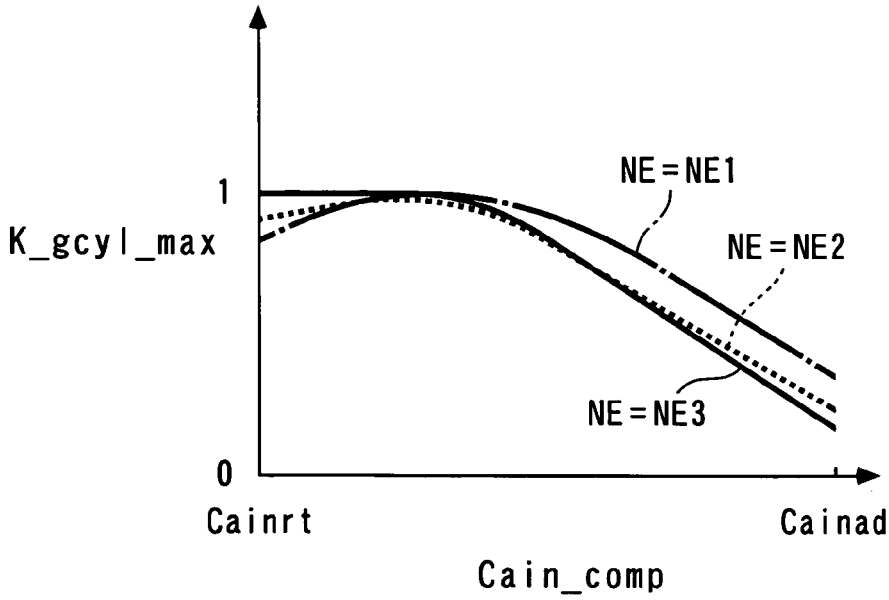
FIG. 18 is a diagram showing an example of a map for use in calculation of a correction coefficient K_gcyl_max.

Further, a correction coefficient K_gcyl_max is calculated by searching a map shown in FIG. 18 according to the engine speed NE and the corrected cam phase Cain_comp. In this map, when NE=NE1 or NE2 holds, in a region where the corrected cam phase Cain_comp is close to the most retarded value Cainrt, the correction coefficient K_gcyl_max is set to a smaller value as the corrected cam phase Cain_comp is closer to the most retarded value Cainrt, and in the other regions, the correction coefficient K_gcyl_max is set to a smaller value as the corrected cam phase Cain_comp assumes a value closer to the most advanced value Cainad. Further, when NE=NE3 holds, in the region where the corrected cam phase Cain_comp is close to the most retarded value Cainrt, the correction coefficient K_gcyl_max is set to a fixed value (a value of 1), and in the other regions, the correction coefficient K_gcyl_max is set to a smaller value as the corrected cam phase Cain_comp assumes a value closer to the most advanced value Cainad. The correction coefficient K_gcyl_max is set as above for the same reasons given in the description of the FIG. 12 map used for calculation of the aforementioned correction coefficient K_gcyl_vt.

Then, the maximum estimated intake air amount Gcyl_max is calculated using the basic value Gcyl_max_base of the maximum estimated intake air amount and the correction coefficient K_gcyl_max, determined as above, by the following equation (26):

$$Gcyl_\mathrm{max}=K_gcyl_\mathrm{max}\cdot Gcyl_\mathrm{max_base} \quad (26)$$

On the other hand, the division element 132 calculates a normalized intake air amount Kgcyl by the following equation (27):

$$Kgcyl=Gcyl/Gcyl_\mathrm{max} \quad (27)$$

Furthermore, the basic ignition timing-calculating section 133 calculates, as described hereinafter, a basic ignition timing Iglog_map by searching a basic ignition timing map according to the normalized intake air amount Kgcyl, the engine speed NE, and the corrected cam phase Cain_comp. In this case, the basic ignition timing map is comprised of a map shown in FIG. 19, for use when Cain_comp=Cainrt, a map shown in FIG. 20, for use when Cain_comp=Cainad, and a plurality of maps (not shown) set in a manner corresponding to values of the corrected cam phase Cain_comp at a plurality of stages, respectively, for use when the corrected cam phase Cain_comp is between the most retarded value Cainrt and the most advanced value Cainad.

In searching the basic ignition timing maps described above, a plurality of values are selected based on the normalized intake air amount Kgcyl, the engine speed NE, and the corrected cam phase Cain_comp, whereafter the basic ignition timing Iglog_map is calculated by interpolation of the selected values.

As described above, in the basic ignition timing-calculating section 133, the normalized intake air amount Kgcyl is employed as a parameter for setting the map values of the basic ignition timing maps. The reason for this is as follows: If map values of a basic ignition timing map are set by using the calculated intake air amount Gcyl in place of the normalized intake air amount Kgcyl, as a parameter, as in the prior art, maximum set values of calculated intake air amounts Gcyl are different from each other, and the set number of map values varies with the engine speed NE in a region where the calculated intake air amount Gcyl is large, i.e. in the high-load region of the engine 3 where knocking starts to occur, which results in an increase in the number of set data. This is because the charging efficiency of intake air in each cylinder 3*a* varies with the engine speed NE, and due to the variation in the changing efficiency of intake air, the maximum value of the intake air amount in the high-load region of the engine 3 where knocking starts to occur also varies with the engine speed NE.

Figure 19:
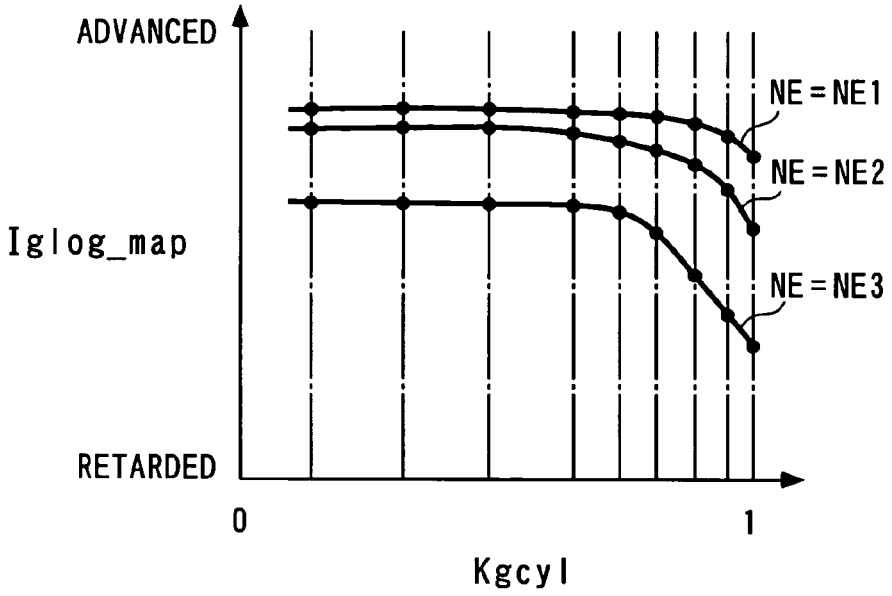
FIG. 19 is a diagram showing an example of a basic ignition timing map for use when Cain_comp=Cainrt.
Figure 20:
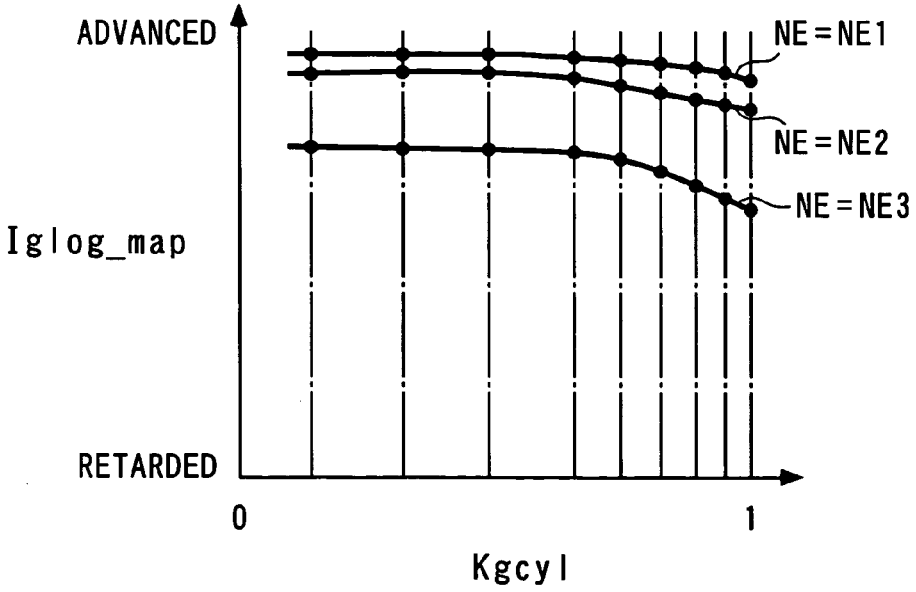
FIG. 20 is a diagram showing an example of a basic ignition timing map for use when Cain_comp=Cainad.

In contrast, in the basic ignition timing map used by the basic ignition timing-calculating section 133, the normalized intake air amount Kgcyl is used as a parameter in place of the calculated intake air amount Gcyl, so that as is clear from FIGS. 19 and 20, even in the high-load region of the engine 3 where knocking starts to occur, that is, even in a region where the normalized intake air amount Kgcyl is equal to 1 or close thereto, the number of map values of the set values NE1 to NE3 of the engine speed can be set to the same number, whereby the number of set data can be made smaller than in the prior art. This means that if the normalized intake air amount Kgcyl is used as a parameter in place of the calculated intake air amount Gcyl, as in the present embodiment, the storage capacity of the ROM in the ECU 2 can be reduced, thereby making it possible to reduce the manufacturing costs of the control system 1.

Further, the above-described ignition correction value-calculating section 134 calculates various correction values by searching maps and tables, none of which are shown, according to the intake air temperature TA, the engine coolant temperature TW, and the target air-fuel ratio KCMD, and calculates an ignition correction value Diglog based on the calculated correction values.

Then, the addition element 135 calculates the ignition timing Iglog by the following equation (28):

$$Iglog=Iglog_\mathrm{map}+Diglog \quad (28)$$

The spark plug 11 is controlled to cause a spark discharge in spark discharge timing dependent on the ignition timing Iglog.

Figure 21:
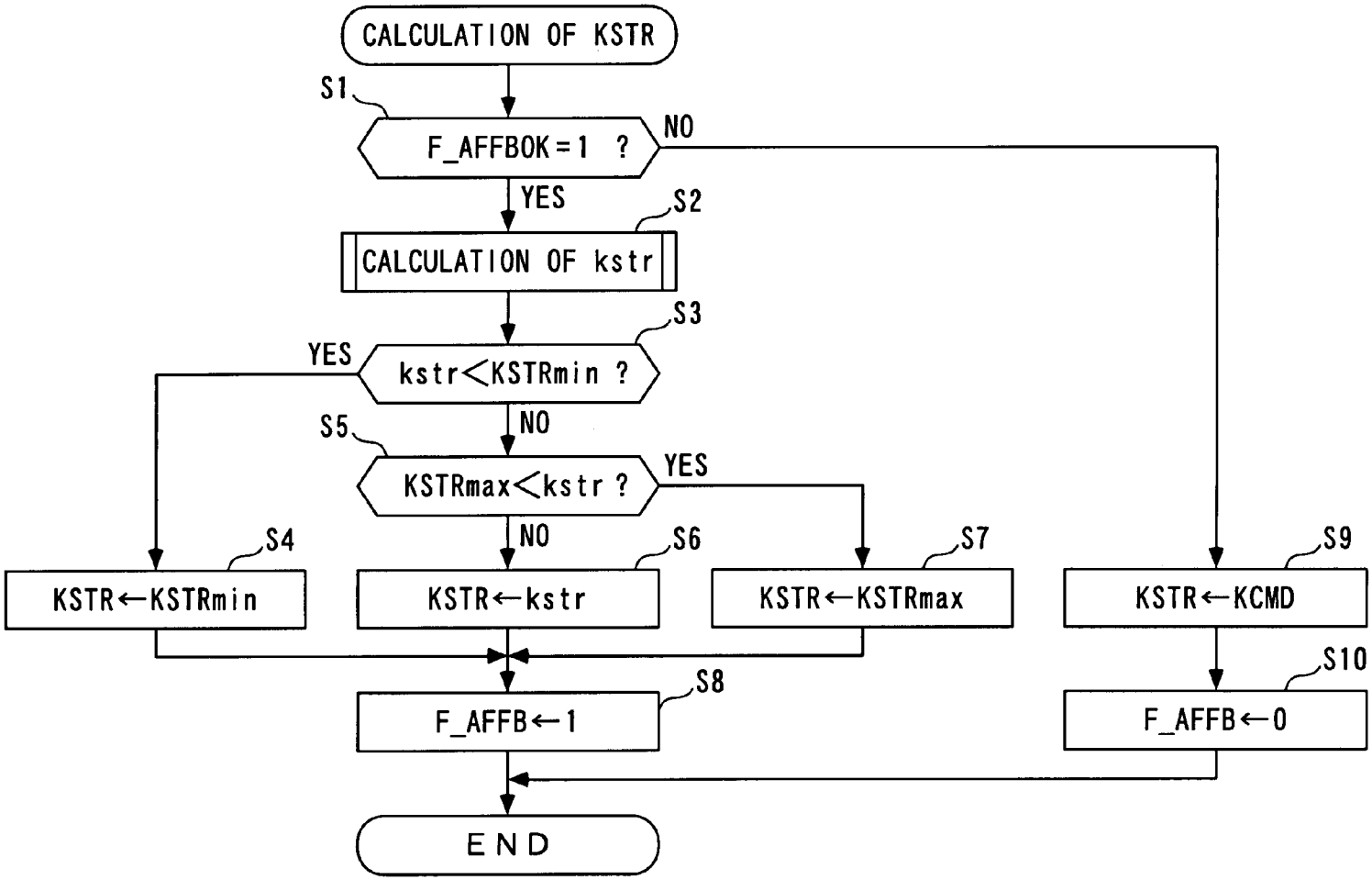
FIG. 21 is a flowchart showing a process for calculating an air-fuel ratio correction coefficient KSTR.

Hereinafter, a description will be given of a process for calculating the air-fuel ratio correction coefficient KSTR, which is carried out by the ECU 2, with reference to FIG. 21. The present process corresponds to the above-described calculation performed by the air-fuel ratio correction coefficient-calculating section 109, and is executed every combustion cycle, i.e. whenever a total of four consecutive pulses of the TDC signal are generated.

First, in a step 1 (shown as S1 in abbreviated form in FIG. 21; the following steps are also shown in abbreviated form), it is determined whether or not an executing condition flag F_AFFBOK is equal to 1. The executing condition flag F_AFFBOK represents whether or not executing conditions for performing the air-fuel ratio feedback control are satisfied. In a process, not shown, when the following executing conditions (c1) to (c4) are all satisfied, the executing condition flag F_AFFBOK is set to 1, and when at least one of the executing conditions (c1) to (c4) is not satisfied, the executing condition flag F_AFFBOK is set to 0.

(c1) The LAF sensor has been activated.

(c2) The engine 3 is not performing either lean-burn operation nor fuel cut-off operation.

(c3) The engine speed NE and the accelerator pedal opening AP both assume values within respective predetermined ranges.

(c4) Retardation of ignition timing is not being executed.

If the answer to the question of the step 1 is affirmative (YES), i.e. if the executing conditions for performing the air-fuel ratio feedback control are satisfied, the process proceeds to a step 2, wherein the basic value kstr is calculated with a control algorithm expressed by the aforementioned equations (7) to (13).

Then, in the following steps 3 to 7, a limiting process are carried out on the basic value kstr calculated in the step 2, to thereby calculate the air-fuel ratio correction coefficient KSTR. This limiting process corresponds to the equation (6) described above. More specifically, in the step 3, it is determined whether or not the basic value kstr is smaller than the lower limit value KSTRmin. If the answer to this question is affirmative (YES), i.e. if kstr<KSTRmin holds, the process proceeds to a step 4, wherein the air-fuel ratio correction coefficient KSTR is set to the lower limit value KSTRmin, and stored in the RAM.

On the other hand, if the answer to the question of the step 3 is negative (NO), the process proceeds to a step 5, wherein it is determined whether or not the basic value kstr is larger than the upper limit value KSTRmax. If the answer to this question is negative (NO), i.e. if KSTRmin≦kstr≦KSTRmax holds, the process proceeds to a step 6, wherein the air-fuel ratio correction coefficient KSTR is set to the basic value kstr, and stored in the RAM.

On the other hand, if the answer to the question of the step 5 is affirmative (YES), i.e. if KSTRmax<kstr holds, the process proceeds to a step 7, wherein the air-fuel ratio correction coefficient KSTR is set to the upper limit value KSTRmax, and stored in the RAM.

In a step 8 following the above step 4, 6 or 7, in order to indicate that the air-fuel ratio correction coefficient KSTR has been calculated with the control algorithm expressed by the aforementioned equations (6) to (13), i.e. that the air-fuel ratio feedback control is being executed, a feedback control execution flag F_AFFB is set to 1, followed by terminating the present process.

On the other hand, if the answer to the question of the step 1 is negative (NO), i.e. if the executing conditions for performing the air-fuel ratio feedback control are not satisfied, the process proceeds to a step 9, wherein the air-fuel ratio correction coefficient KSTR is set to the target air-fuel ratio KCMD. Then, in a step 10, in order to indicate that the air-fuel ratio feedback control is not being executed, the feedback control execution flag F_AFFB is set to 0, followed by terminating the present process.

Figure 22:
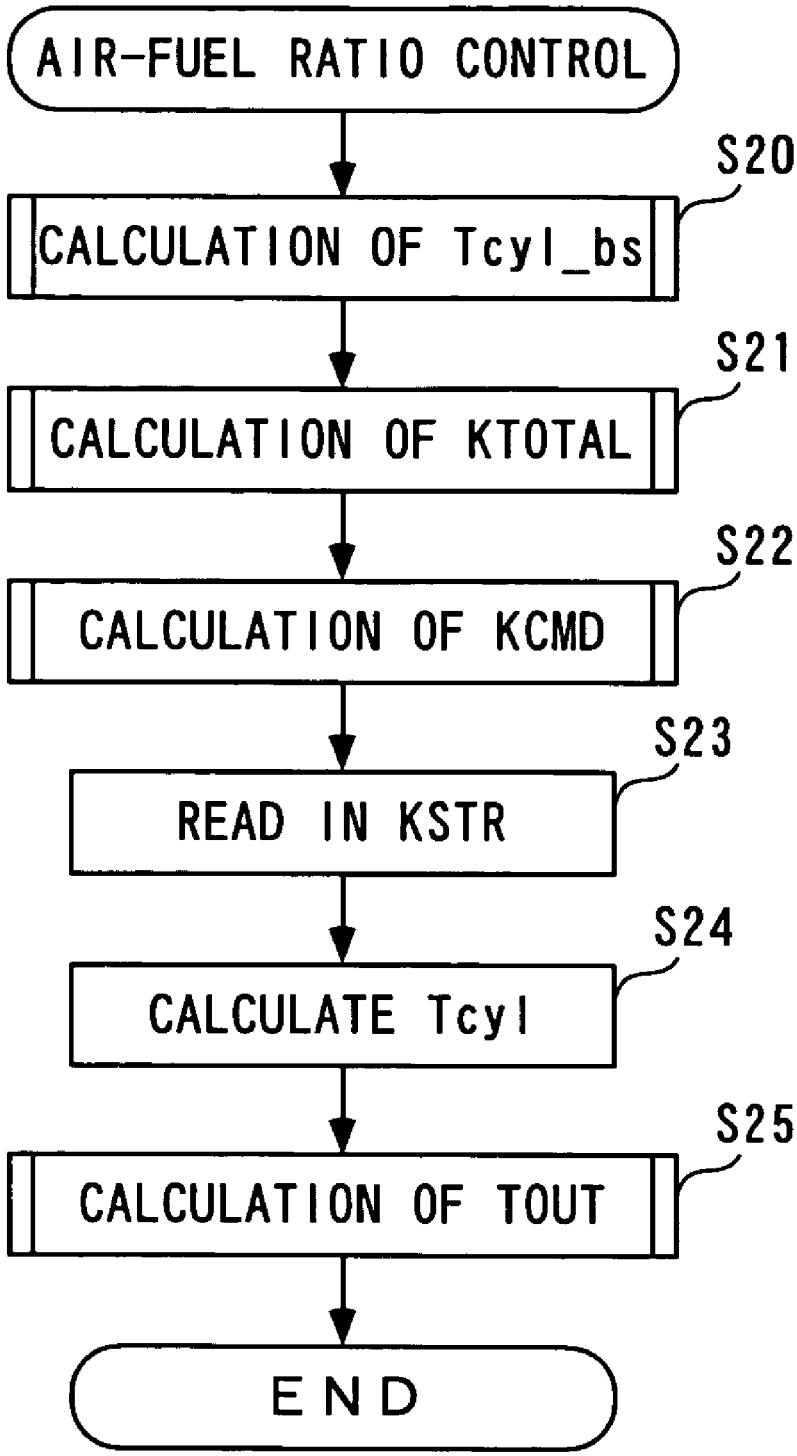
FIG. 22 is a flowchart showing an air-fuel ratio control process.

Hereinafter, an air-fuel ratio control process carried out by the ECU 2 will be described with reference to FIG. 22. The present process calculates the fuel injection amount TOUT for each fuel injection valve 10, and corresponds to the calculation process by the air-fuel ratio controller 100, described hereinabove. This process is executed in timing synchronous with generation of each pulse of the TDC signal.

Figure 23:
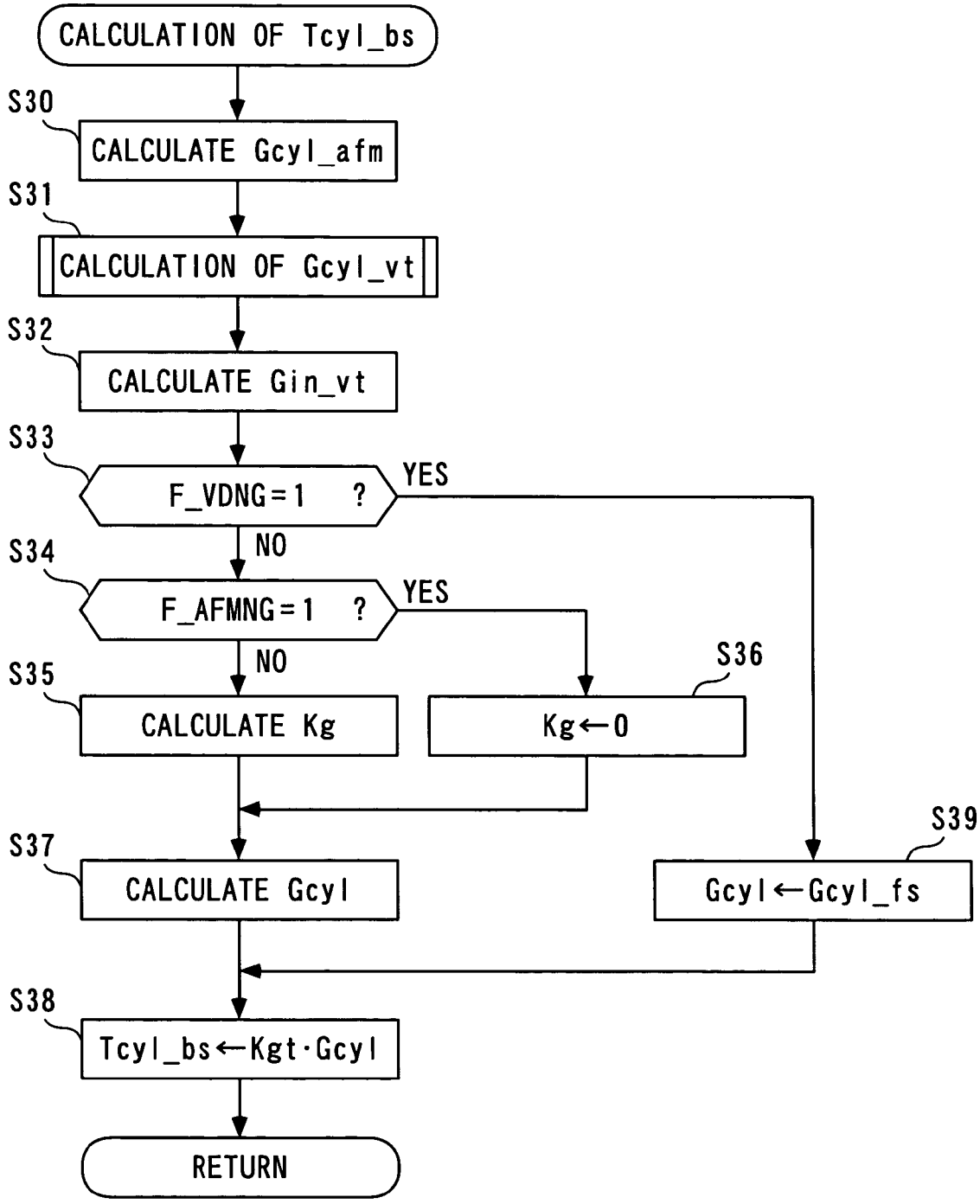
FIG. 23 is a flowchart showing a process for calculation of a basic fuel injection amount Tcyl_bs.

First, in a step 20, the basic fuel injection amount Tcyl_bs is calculated. More specifically, the process for calculating the basic fuel injection amount Tcyl_bs is executed as shown in FIG. 23. That is, first, in a step 30, the second estimated intake air amount Gcyl_afm is calculated by the aforementioned equation (3).

Then, in a step 31, the first estimated intake air amount Gcyl_vt is calculated by the method described above. More specifically, the basic estimated intake air amount Gcyl_vt_base is calculated by searching the map shown in FIG. 11 according to the engine speed NE and the corrected valve lift Liftin_comp, and the correction coefficient K_gcyl_vt is calculated by searching the map shown in FIG. 12 according to the engine speed NE and the corrected cam phase Cain_comp. Then, the first estimated intake air amount Gcyl_vt is calculated by the aforementioned equation (1) based on the values Gcyl_vt_base and K_gcyl_vt.

Next, in a step 32, the estimated flow rate Gin_vt is calculated by the aforementioned equation (2). After that, the process proceeds to a step 33, wherein it is determined whether or not a variable mechanism failure flag F_VDNG is equal to 1.

The variable mechanism failure flag F_VDNG is set to 1, when it is determined in a failure-determining process, not shown, that at least one of the variable valve lift mechanism 50 and the variable cam phase mechanism 70 is faulty, whereas when it is determined that the variable valve lift mechanism 50 and the variable cam phase mechanism 70 are both normal, the variable mechanism failure flag F_VDNG is set to 0. It should be noted that in the following description, the variable valve lift mechanism 50 and the variable cam phase mechanism 70 are collectively referred to as "the two variable mechanisms".

If the answer to the question of the step 33 is negative (NO), i.e. if the two variable mechanisms are both normal, the process proceeds to a step 34, wherein it is determined whether or not an air flow sensor failure flag F_AFMNG is equal to 1. When it is determined in a failure-determining process, not shown, that the air flow sensor 22 is faulty, the air flow sensor failure flag F_AFMNG is set to 1, whereas when it is determined that the air flow sensor 22 is normal, the air flow sensor failure flag F_AFMNG is set to 0.

If the answer to the question of the step 34 is negative (NO), i.e. if the air flow sensor 22 is normal, the process proceeds to a step 35, wherein as described hereinabove, the transition coefficient Kg is calculated by searching the table shown in FIG. 13 according to the estimated flow rate Gin_vt.

On the other hand, if the answer to the question of the step 34 is affirmative (YES), i.e. if the air flow sensor 22 is faulty, the process proceeds to a step 36, wherein the transition coefficient Kg is set to a value of 0.

In a step 37 following the step 35 or 36, the calculated intake air amount Gcyl is calculated by the aforementioned equation (4). Then, in a step 38, the basic fuel injection amount Tcyl_bs is set to the product Kgt-Gcyl of the conversion coefficient and the calculated intake air amount, followed by terminating the present process.

On the other hand, if the answer to the question of the step 33 is affirmative (YES), i.e. if it is determined that at least one of the two variable mechanisms is faulty, the process proceeds to a step 39, wherein the calculated intake air amount Gcyl is set to the above-described predetermined failure time value Gcyl_fs. Then, the aforementioned step 38 is carried out, followed by terminating the present process.

Referring again to FIG. 22, after the basic fuel injection amount Tcyl_bs is determined in the step 20 as described above, the process proceeds to a step 21, wherein the total correction coefficient KTOTAL is calculated. More specifically, as described hereinabove, the total correction coefficient KTOTAL is calculated by calculating the various correction coefficients by searching the tables and maps according to the operating parameters (e.g. the intake air temperature TA, the atmospheric pressure PA, the engine coolant temperature TW, the accelerator pedal opening AP, and so forth), and then multiplying the thus calculated correction coefficients by each other.

Then, the process proceeds to a step 22, wherein as described hereinabove, the target air-fuel ratio KCMD is calculated by searching the map shown in FIG. 14 according to the accelerator pedal opening AP and the calculated intake air amount Gcyl, and stored in the RAM.

Next, the process proceeds to a step 23, wherein a value of the air-fuel ratio correction coefficient KSTR stored in the RAM is read out. That is, the air-fuel ratio correction coefficient KSTR is sampled.

Then, the process proceeds to a step 24, wherein the required fuel injection amount Tcyl is calculated by the aforementioned equation (15). After that, in a step 25, as described hereinbefore, the fuel injection amount TOUT is calculated by performing a predetermined fuel attachment-dependent correction process on the required fuel injection amount Tcyl, followed by terminating the present process. Thus, the fuel injection timing and the valve-opening time period of each fuel injection valve 10 are determined based on the fuel injection amount TOUT, to thereby control the fuel injection valve 10. As a result, the air-fuel ratio of the mixture, i.e. the detected air-fuel ratio KACT is feedback-controlled such that it converges to the target air-fuel ratio KCMD.

Figure 24:
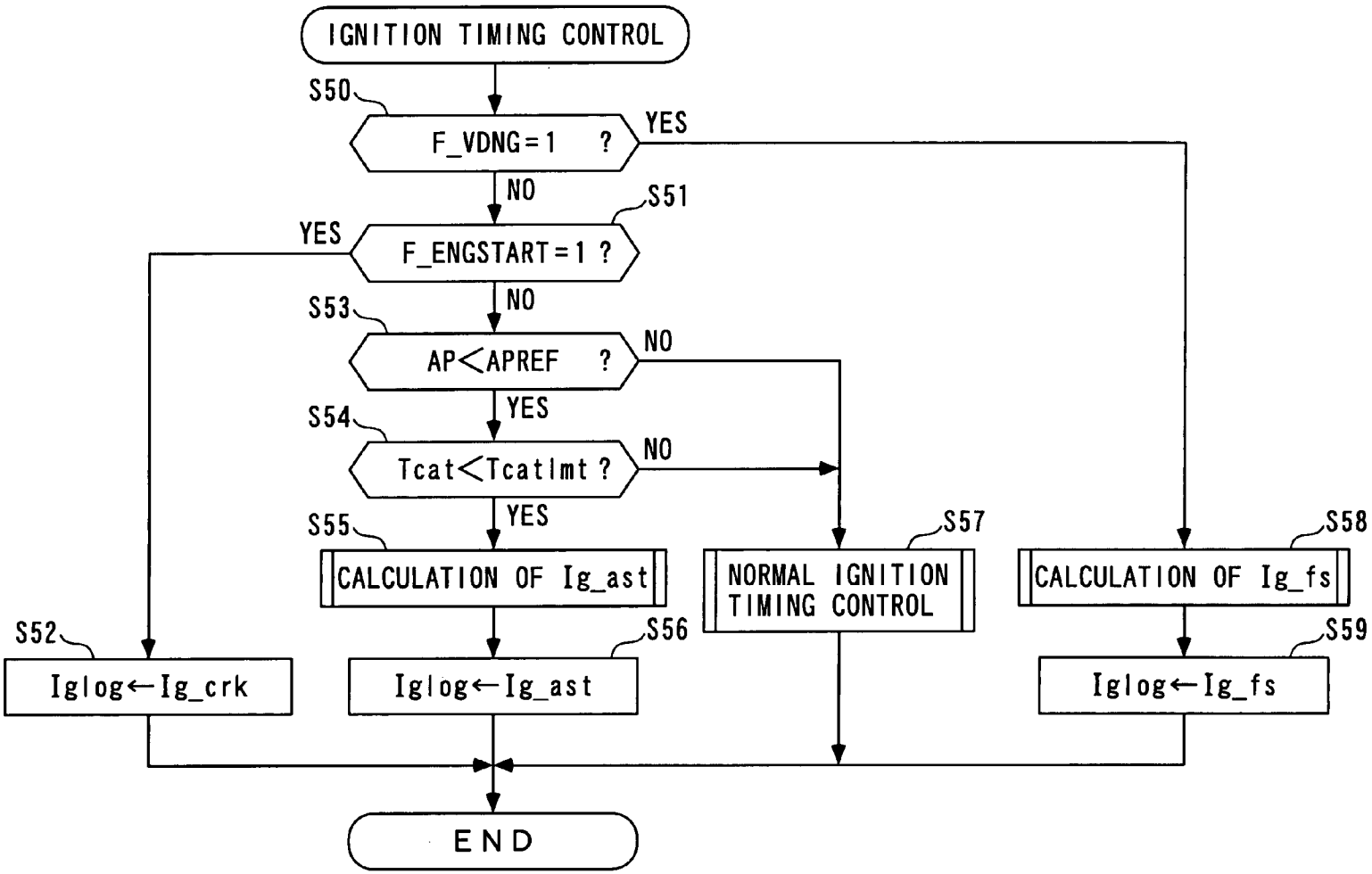
FIG. 24 is a flowchart showing an ignition timing control process.

Next, the ignition timing control process carried out by the ECU 2 will be described with reference to FIG. 24. The present process calculates the ignition timing Iglog, as described hereinafter, and corresponds to the above-described calculation by the ignition timing controller 130. This process is executed immediately after the above-described air-fuel ratio control process in timing synchronous with generation of each pulse of the TDC signal.

In this process, first, it is determined in a step 50 whether or not the aforementioned variable mechanism failure flag F_VDNG is equal to 1. If the answer to this question is negative (NO), i.e. if the two variable mechanisms are both normal, the process proceeds to a step 51, wherein it is determined whether or not an engine start flag F_ENGSTART is equal to 1.

The above engine start flag F_ENGSTART is set by determining in a determination process, not shown, whether or not engine starting control, i.e. cranking is being executed, based on the engine speed NE and the ON/OFF signal output from the IG•SW 29. More specifically, when the engine starting control is being executed, the engine start flag F_ENGSTART is set to 1, and otherwise set to 0.

If the answer to the question of the step 51 is affirmative (YES), i.e. if the engine starting control is being executed, the process proceeds to a step 52, wherein the ignition timing Iglog is set to a predetermined start-time value Ig_crk (e.g. BTDC 10°) for starting of the engine 3, followed by terminating the present process.

On the other hand, if the answer to the question of the step 51 is negative (NO), i.e. if the engine starting control is not being executed, the process proceeds to a step 53, wherein it is determined whether or not the accelerator pedal opening AP is smaller than a predetermined value APREF. The predetermined value APREF is for determining that the accelerator pedal is not stepped on, and set to a value (e.g. 1°) capable of determining that the accelerator pedal is not stepped on.

If the answer to this question is affirmative (YES), i.e. if the accelerator pedal is not stepped on, the process proceeds to a step 54, wherein it is determined whether or not an execution time period Tcat for the catalyst warmup control (measured value of a time period elapsed immediately after termination of the start of the engine 3) is smaller than a predetermined value Tcatlmt (e.g. 30 sec). The catalyst warmup control is executed for rapidly activating catalyst in the catalytic converter arranged in the exhaust pipe 13 after the start of the engine 3. If the answer to this question is affirmative (YES), i.e. if Tcat<Tcatlmt holds, it is judged that the catalyst warmup control should be executed, so that the process proceeds to a step 55, wherein a catalyst warmup value Ig_ast is calculated. More specifically, the catalyst warmup value Ig_ast is calculated with a response-specifying control algorithm (a sliding mode control algorithm or a back-stepping control algorithm) expressed by the following equations (29) to (31).

$$\text{Ig_ast} = \text{Ig_ast_base} - Krch \cdot \sigma(m) - Kadp \cdot \sum_{i=0}^{m} \sigma(i) \tag{29}$$

$$\sigma(m) = Enast(m) + \text{pole} \cdot Enast(m-1) \tag{30}$$

$$Enast(m) = NE(m) - \text{NE_ast} \tag{31}$$

In the above equations (29) to (31), a symbol (m) in discrete data indicates that the data is sampled (or calculated) in synchronism with a predetermined control cycle (cycle of generation of the CRK signal in the present embodiment). The symbol m indicates a position in the sequence of sampling cycles of respective discrete data. It should be noted that in the following description, the symbol m and the like provided for the discrete data are omitted as deemed appropriate.

In the equation (29), Ig_ast_base represents a predetermined catalyst warmup reference ignition timing (e.g. BTDC 5°), and Krch and Kadp represent predetermined feedback gains. Further, σ represents a switching function defined by the equation (30). In the equation (30), pole represents a response-specifying parameter set to a value which satisfies the relationship of −1<pole<0, and Enast represents a follow-up error calculated by the equation (31). In the equation (31), NE_ast represents a predetermined catalyst warmup target engine speed (e.g. 1800 rpm). With the above-described control algorithm, the catalyst warmup value Ig_ast is calculated as a value for causing the engine speed NE to converge to the catalyst warmup target engine speed NE_ast.

Then, the process proceeds to a step 56, wherein the ignition timing Iglog is set to the catalyst warmup value Ig_ast, followed by terminating the present process.

On the other hand, if the answer to the question of the step 53 or the step 54 is negative (NO), i.e. if Tcat≧Tcatlmt holds, or if the accelerator pedal is stepped on, the process proceeds to a step 57, wherein a normal ignition timing control process is carried out.

Figure 25:
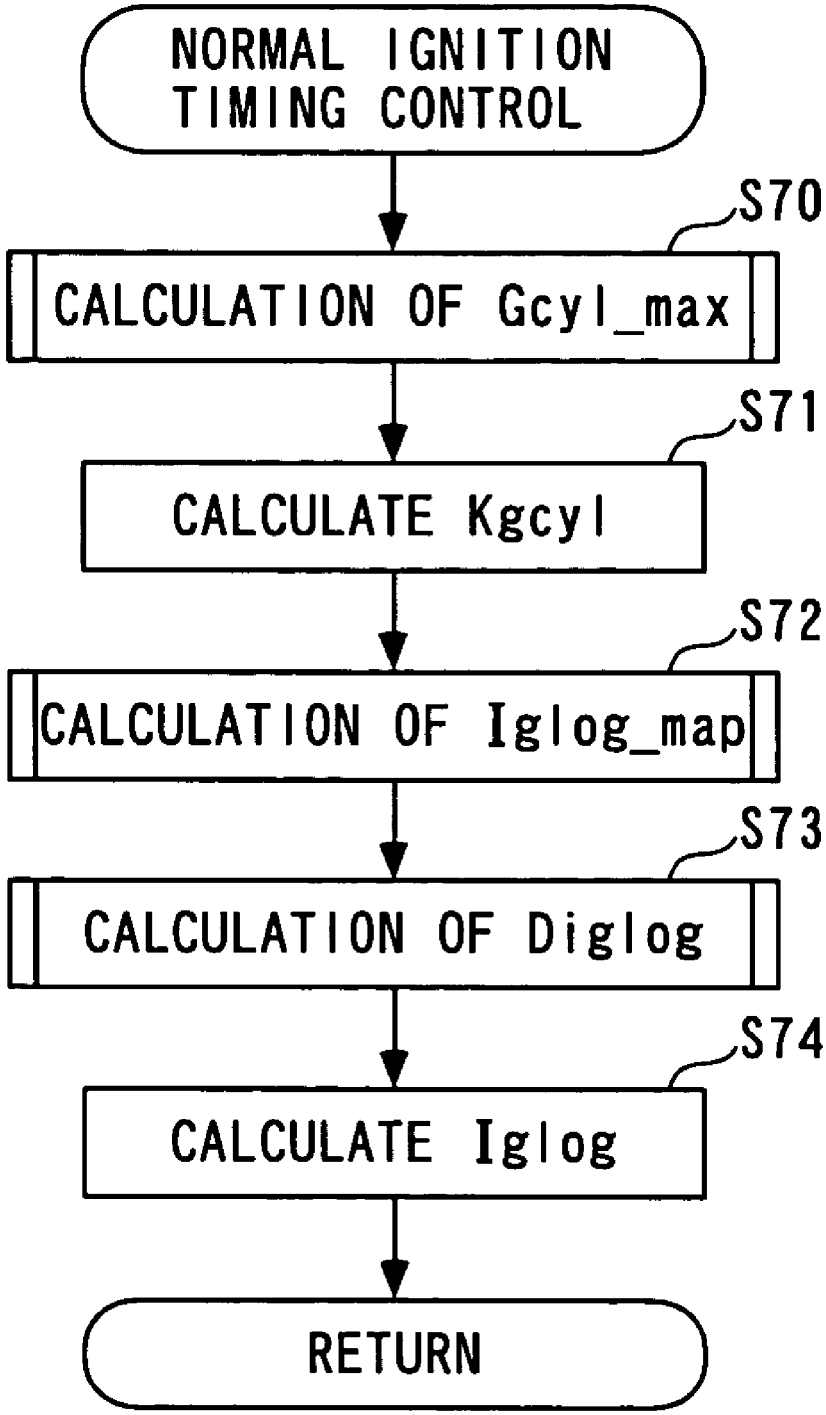
FIG. 25 is a flowchart showing a normal ignition timing control process.

More specifically, the normal ignition timing control process is executed as shown in FIG. 25. First, in a step 70, the maximum estimated intake air amount Gcyl_max is calculated by the above-described method. The basic value Gcyl_max_base of the maximum estimated intake air amount is calculated by searching the table shown in FIG. 17 according to the engine speed NE, and the correction coefficient K_gcyl_max is calculated by searching the map shown in FIG. 18 according to the engine speed NE and the corrected cam phase Cain_comp. Then, the maximum estimated intake air amount Gcyl_max is calculated by the aforementioned equation (26) based on the thus calculated two values Gcyl_max_base and K_gcyl_max.

Then, in a step 71, the normalized intake air amount Kgcyl is calculated by the aforementioned equation (27). After that, in a step 72, the basic ignition timing Iglog_map is calculated by the above-described method. More specifically, a plurality of values are selected by searching the basic ignition timing map e.g. in FIG. 19 or 20 according to the normalized intake air amount Kgcyl, the engine speed NE, and the corrected cam phase Cain_comp, and the basic ignition timing Iglog_map is calculated by interpolation of the selected values.

Then, in a step 73, the ignition correction value Diglog is calculated by the above-described method. More specifically, the various correction values are calculated by searching the maps and tables, none of which are shown, according to the intake air temperature TA, the engine coolant temperature TW, the target air-fuel ratio KCMD, and so forth, and the ignition correction value Diglog is calculated based on the calculated correction values. Then, in a step 74, the ignition timing Iglog is calculated by the aforementioned equation (28), followed by terminating the present process.

Referring again to FIG. 24, after carrying out the normal ignition timing control process as described above, in the step 57, the present process is terminated.

On the other hand, if the answer to the question of the step 50 is affirmative (YES), i.e. if at least one of the two variable mechanisms is faulty, the process proceeds to a step 58, wherein a failure time value Ig_fs is calculated. More specifically, the failure time value Ig_fs is calculated with a response-specifying control algorithm (a sliding mode control algorithm or a back-stepping control algorithm) expressed by the following equations (32) to (34).

$$\text{Ig_fs} = \text{Ig_fs_base} - Krch^{\#} \cdot \sigma^{\#}(m) - Kadp^{\#} \cdot \sum_{i=0}^{m} \sigma^{\#}(i) \tag{32}$$

$$\sigma^{\#}(m) = Enfs(m) + pole^{\#} \cdot Enfs(m-1) \tag{33}$$

$$Enfs(m) = NE(m) - \text{NE_fs} \tag{34}$$

In the above equation (32), Ig_fs_base represents a predetermined reference ignition timing (e.g. TDC±0°) for a failure time, and Krch# and Kadp# represent predetermined feedback gains. Further, σ# represents a switching function defined by the equation (33). In the equation (33), pole# represents a response-specifying parameter set to a value which satisfies the relationship of −1<pole#<0, and Enfs represents a follow-up error calculated by the equation (34). In the equation (34), NE_fs represents a predetermined failure-time target engine speed (e.g. 2000 rpm). With the above control algorithm, the failure time value Ig_fs is calculated as a value for causing the engine speed NE to converge to the failure-time target engine speed NE_fs.

Then, the process proceeds to a step 59, wherein the ignition timing Iglog is set to the failure time value Ig_fs, followed by terminating the present process.

Figure 26:
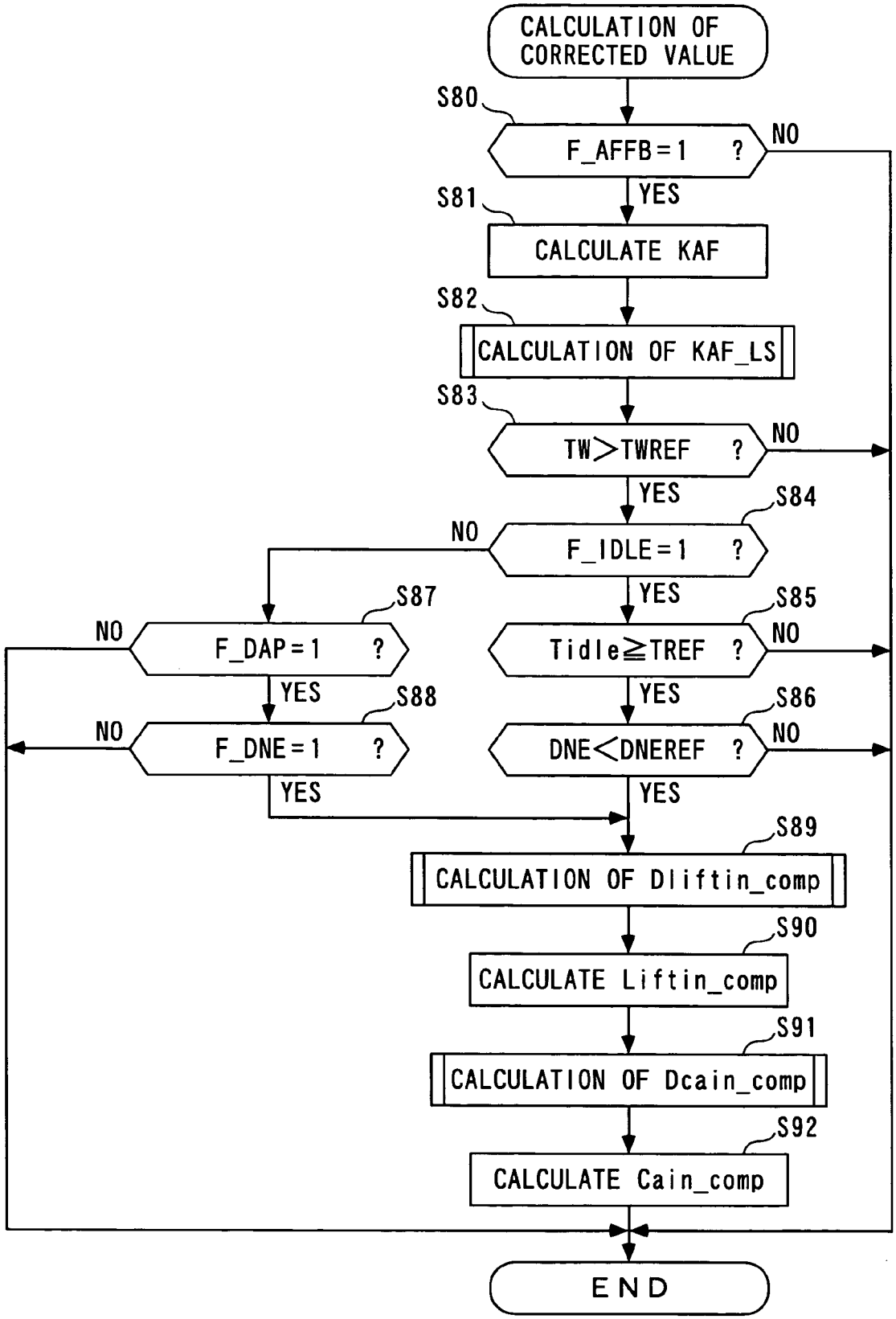
FIG. 26 is a flowchart showing a corrected value-calculating process.

Hereinafter, a corrected value-calculating process carried out by the ECU 2 will be described with reference to FIG. 26. As described hereinafter, the present process calculates the corrected valve lift Liftin_comp and the corrected cam phase Cain_comp, and corresponds to the above-described calculation by the corrected value-calculating section 113. This process is executed in synchronism with the predetermined control period ΔT (e.g. 5 msec in the present embodiment).

First, it is determined in a step 80 whether or not the aforementioned feedback control execution flag F_AFFB is equal to 1. If the answer to this question is negative (NO), i.e. if the air-fuel ratio feedback control is not being executed, the present process is immediately terminated. On the other hand, if the answer to this question is affirmative (YES), i.e. if the air-fuel ratio feedback control is being executed, the process proceeds to a step 81, wherein the air-fuel ratio index value KAF is calculated by dividing the value of the air-fuel ratio correction coefficient KSTR stored in the RAM by the value of the target air-fuel ratio KCMD.

Then, the process proceeds to a step 82, wherein the statistically processed value KAF_LS of the air-fuel ratio index value is calculated with the sequential least-squares method algorithm expressed by the aforementioned equations (16) and (17).

Then, it is determined in a step 83 whether or not the engine coolant temperature TW is higher than a predetermined temperature TWREF (e.g. 85° C.). If the answer to this question is negative (NO), i.e. if the warming up of the engine 3 has not been completed, the present process is immediately terminated.

On the other hand, if the answer to the question of the step 83 is affirmative (YES), i.e. if the warming up of the engine 3 has been completed, the process proceeds to a step 84, wherein it is determined whether or not an idling flag F_IDLE is equal to 1. When the engine 3 is idling, the idling flag F_IDLE is set to 1, and otherwise set to 0.

If the answer to the above question is affirmative (YES), i.e. if the engine 3 is idling, the process proceeds to a step 85, wherein it is determined whether or not an execution time period Tidle for the idling of the engine 3 is equal to or longer than a predetermined value TREF. If the answer to this question is affirmative (YES), the process proceeds to a step 86, wherein it is determined whether or not an engine speed difference DNE is smaller than a predetermined value DNEREF (e.g. 20 rpm). The engine speed difference DNE is calculated as the absolute value of the difference between a target engine speed NE_cmd for idling of the engine 3 and the engine speed NE.

If the answer to the question of the step 86 is affirmative (YES), it is judged that conditions for calculating the corrected valve lift Liftin_comp and the corrected cam phase Cain_comp are satisfied, and the process proceeds to a step 89, referred to hereinafter, whereas if the answer to the question of the step 85 or 86 is negative (NO), the present process is terminated. Based on the determinations of the steps 85 and 86, the calculations of the corrected valve lift Liftin_comp and the corrected cam phase Cain_comp are avoided until the operating condition of the engine 3 is stabilized after the start of transition from a state of high-speed operation of the engine 3 to idling thereof by deceleration, or immediately after racing by a driver during idling, and carried out after stabilization of the operating condition.

On the other hand, if the answer to the question of the step 84 is negative (NO), i.e. if the engine 3 is not idling, the process proceeds to a step 87, wherein it is determined whether or not an accelerator difference flag F_DAP is equal to 1. The accelerator difference flag F_DAP represents whether or not the accelerator pedal opening AP is stable. More specifically, when a state in which the absolute value of the difference between the current value AP(k) and the immediately preceding value AP(k−1) of the accelerator pedal opening is not larger than a predetermined value continues for a predetermined time period, the accelerator difference flag F_DAP is set to 1, and otherwise set to 0.

If the answer to the question of the step 87 is affirmative (YES), i.e. if the accelerator pedal opening AP is stable without being fluctuated, the process proceeds to a step 88, wherein it is determined whether or not an engine speed difference flag F_DNE is equal to 1. The engine speed difference flag F_DNE represents whether or not the engine speed NE is stable. More specifically, when a state in which the absolute value of the difference between the current value NE(k) and the immediately preceding value NE(k−1) of the engine speed NE is not larger than a predetermined value continues for a predetermined time period, the engine speed difference flag F_DNE is set to 1, and otherwise set to 0.

If the answer to the question of the step 88 is affirmative (YES), i.e. if the engine speed NE is stable without being fluctuated, it is judged that conditions for calculating the corrected valve lift Liftin_comp and the corrected cam phase Cain_comp are satisfied, and the process proceeds to the step 89, referred to hereinafter, whereas if the answer to the question of the step 87 or 88 is negative (NO), the present process is terminated. Based on the determinations of the steps 87 and 88, the calculations of the corrected valve lift Liftin_comp and the corrected cam phase Cain_comp are avoided until the accelerator pedal opening AP and the engine speed NE are stabilized, i.e. until the operating conditions of the engine 3 are stabilized, and performed after stabilization of the operating conditions.

Figure 27:
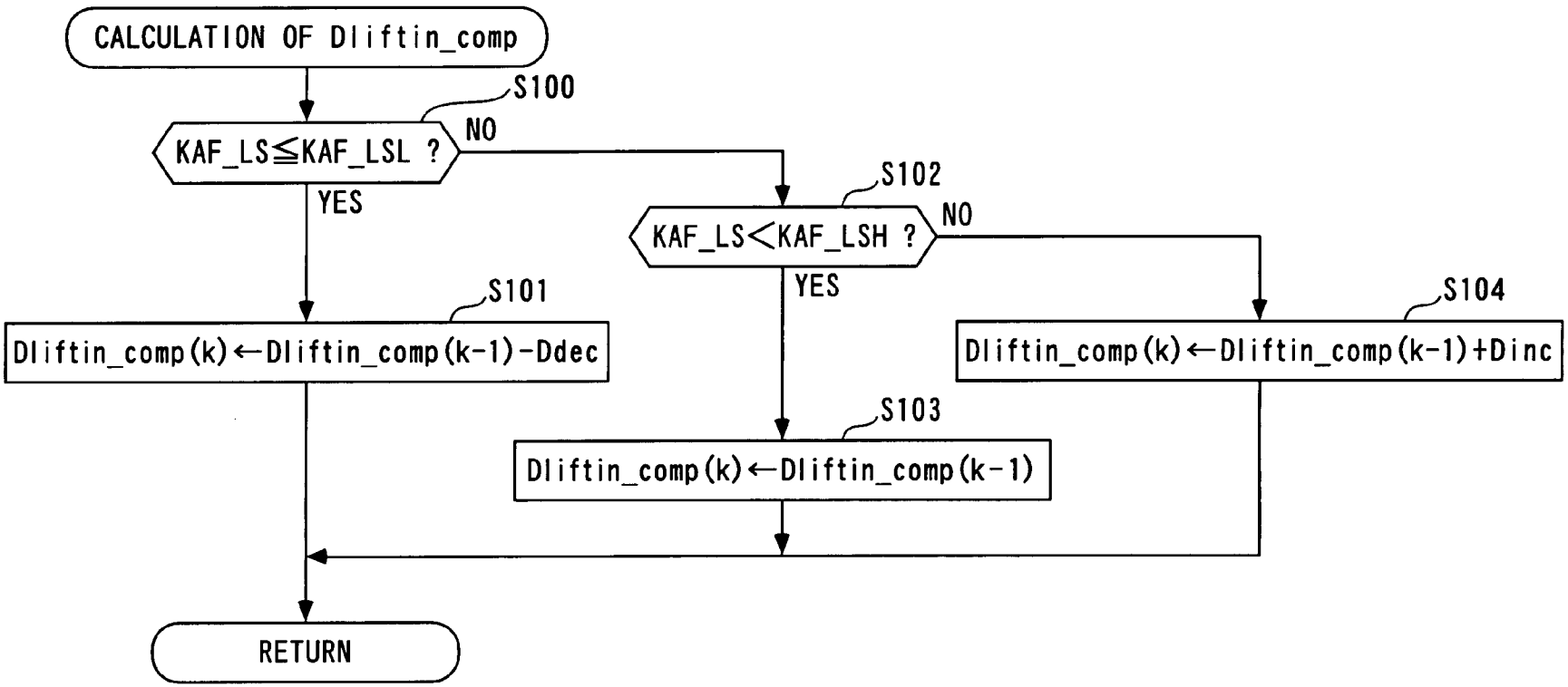
FIG. 27 is a flowchart showing a process for calculation of a lift correction value Dliftin_comp.

In a step 89 following the step 86 or 88, the lift correction value Dliftin_comp is calculated by the aforementioned calculation method. More specifically, as shown in FIG. 27, first, it is determined in a step 100 whether or not the statistically processed value KAF_LS is not larger than the lower limit value KAF_LSL.

If the answer to the above question is affirmative (YES), i.e. if KAF_LS≦KAF_LSL holds, in a step 101, the current value Dliftin_comp(k) of the lift correction value is set to a value obtained by subtracting a predetermined value Ddec from the immediately preceding value Dliftin_comp(k−1), followed by terminating the present process.

On the other hand, if the answer to the question of the step 100 is negative (NO), the process proceeds to a step 102, wherein it is determined whether or not the statistically processed value KAF_LS is smaller than the upper limit value KAF_LSH. If the answer to this question is affirmative (YES), i.e. if KAF_LSL<KAF_LS<KAF_LSH holds, in a step 103, the current value Dliftin_comp(k) of the lift correction value is set to the immediately preceding value Dliftin_comp(k−1) thereof, followed by terminating the present process. That is, the lift correction value Dliftin_comp is held at a fixed value without being updated.

On the other hand, if the answer to the question of the step 102 is negative (NO), i.e. if KAF_LSH≦KAF_LS holds, in a step 104, the current value Dliftin_comp(k) of the lift correction value is set to the sum of the immediately preceding value Dliftin_comp(k−1) and the predetermined value Dinc, followed by terminating the present process.

Referring again to FIG. 26, the lift correction value Dliftin_comp is calculated as above in the step 89. After that, the process proceeds to a step 90, wherein the corrected valve lift Liftin_comp is calculated by the aforementioned equation (21).

Figure 28:
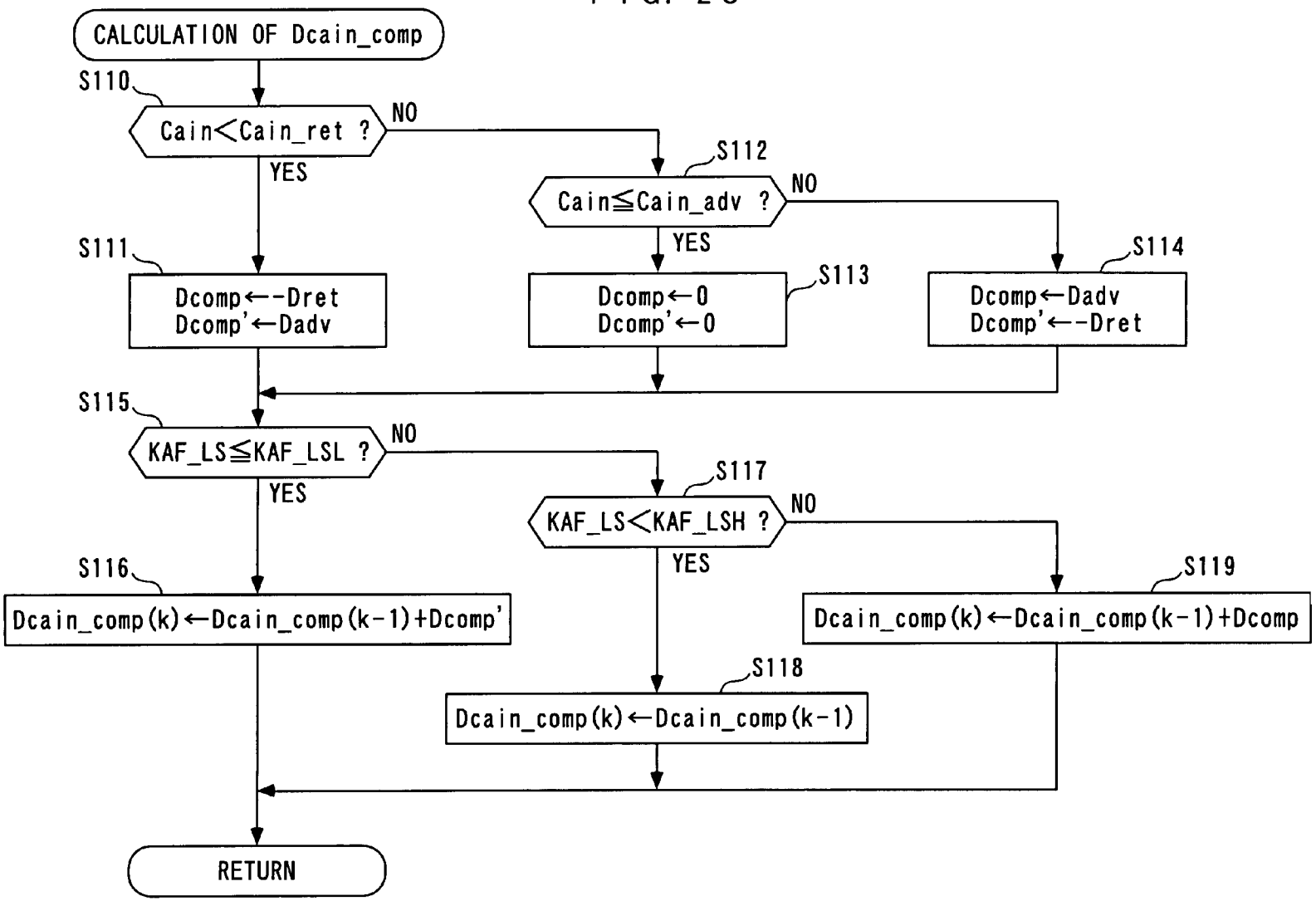
FIG. 28 is a flowchart showing a process for calculation of a phase correction value Dcain_comp.

Then, in a step 91, the phase correction value Dcain_comp is calculated by the aforementioned calculation method. More specifically, as shown in FIG. 28, first, it is determined in a step 110 whether or not the cam phase Cain is smaller than the predetermined retarded value Cain_ret. If the answer to this question is affirmative (YES), and the cam phase Cain assumes a value in the retarded range, the process proceeds to a step 111, wherein the correction term Dcomp is set to a value of −Dret, and the correction term Dcomp' to a value of Dadv.

On the other hand, if the answer to the question of the step 110 is negative (NO), the process proceeds to a step 112, wherein it is determined whether or not the cam phase Cain is not larger than the predetermined advanced value Cain_adv. If the answer to this question is affirmative (YES), i.e. if Cain_ret≦Cain≦Cain_adv holds, the process proceeds to a step 113, wherein both of the two correction terms Dcomp and Dcomp' are set to a value of 0.

On the other hand, if the answer to the question of the step 112 is negative (NO), and the cam phase Cain assumes a value in the advanced range, the process proceeds to a step 114, wherein the correction term Dcomp is set to a value of −Dret, and the correction term Dcomp' to a value of Dadv.

In a step 115 following the step 111, 113 or 114, it is determined whether or not the statistically processed value KAF_LS is not larger than the lower limit value KAF_LSL.

If the answer to this question is affirmative (YES), i.e. if KAF_LS≦KAF_LSH holds, in a step 116, the current value Dcain_comp(k) of the phase correction value is set to the sum of the immediately preceding value Dcain_comp(k−1) and the correction term Dcomp', followed by terminating the present process.

On the other hand, if the answer to the question of the step 115 is negative (NO), the process proceeds to a step 117, wherein it is determined whether or not the statistically processed value KAF_LS is smaller than the upper limit value KAF_LSH. If the answer to this question is affirmative (YES), i.e. if KAF_LSL<KAF_LS<KAF_LSH holds, in a step 118, the current value Dcain_comp(k) of the phase correction value is set to the immediately preceding value Dcain_ comp(k−1), followed by terminating the present process. That is, the phase correction value Dcain_comp is held at a fixed value without being updated.

On the other hand, if the answer to the question of the step 117 is negative (NO), i.e. if KAF_LSH≦KAF_LS holds, in a step 119, the current value Dcain_comp(k) of the phase correction value is set to the sum of the immediately preceding value Dcain_comp(k−1) and the correction term Dcomp, followed by terminating the present process.

Referring again to FIG. 26, the phase correction value Dcain_comp is calculated as above in the step 91, and then the process proceeds to a step 92, wherein the corrected cam phase Cain_comp is calculated by the aforementioned equation (25), followed by terminating the present process.

As described above, in the corrected value-calculating process, if the answers to the questions of the steps 83 to 86 are all affirmative (YES), or if the answer to the question of the step 84 is negative (NO), and at the same time if the answers to the questions of the steps 87 and 88 are both affirmative (YES), the calculations of the corrected valve lift Liftin_comp and the corrected cam phase Cain_comp are carried out. More specifically, after termination of the warming up of the engine 3, when the engine 3 is idling and the operating condition thereof is stable, or when the engine 3 is not idling, and the accelerator pedal opening AP and the engine speed NE are small in the amount of variation, with the engine 3 being in a stable operating condition, the corrected valve lift Liftin_comp and the corrected cam phase Cain_comp are calculated, and therefore it is possible to ensure an excellent accuracy of calculation.

Figure 29:
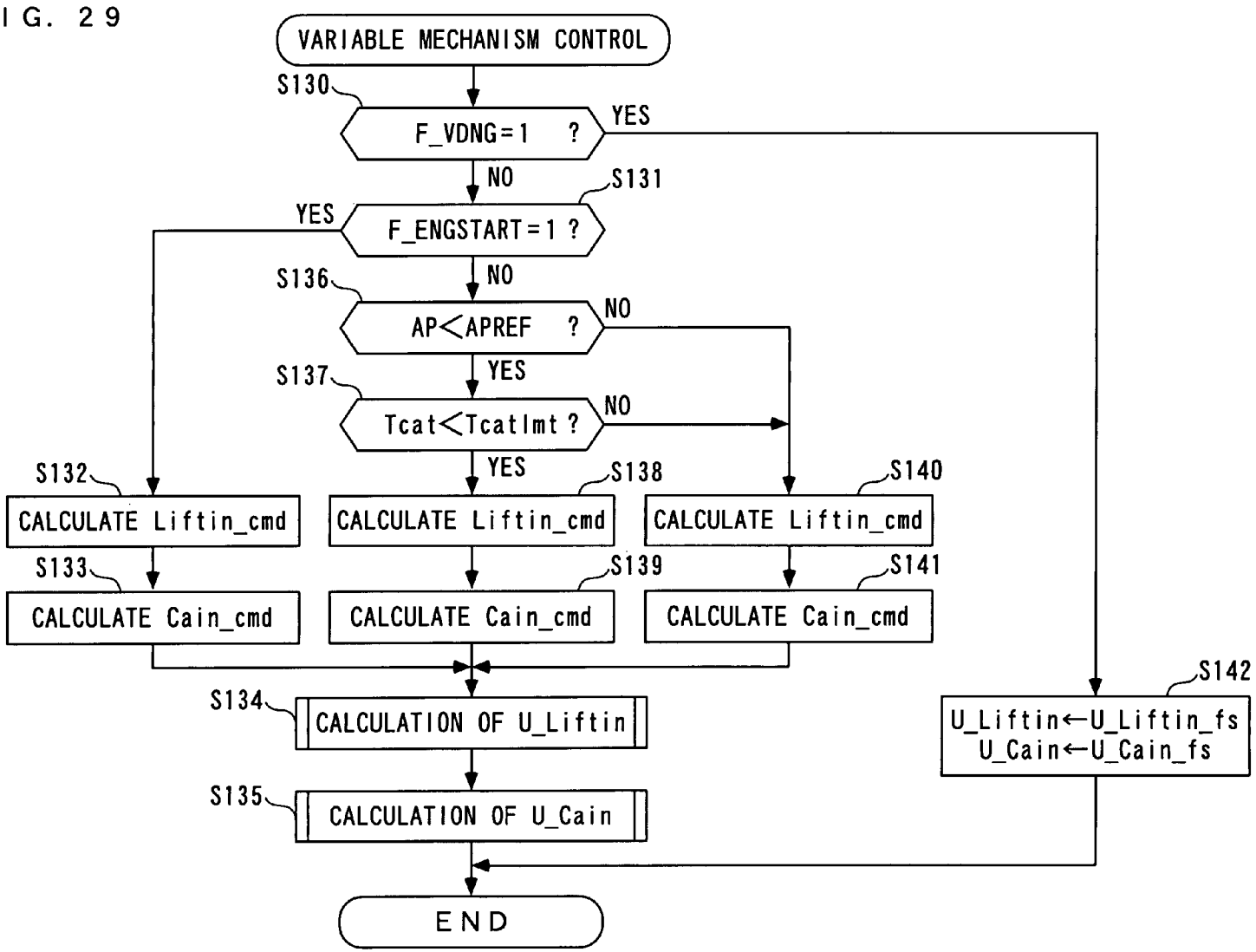
FIG. 29 is a flowchart showing a variable mechanism control process.

Hereinafter, a variable mechanism control process carried out by the ECU 2 will be described with reference to FIG. 29. The present process calculates the two control inputs U_Liftin and U_Cain for controlling the two variable mechanisms, respectively, and is executed immediately after the above-described corrected value-calculating process at the aforementioned predetermined control period ΔT.

In this process, first, it is determined in a step 130 whether or not the aforementioned variable mechanism failure flag F_VDNG is equal to 1. If the answer to this question is negative (NO), i.e. if the two variable mechanisms are both normal, the process proceeds to a step 131, wherein it is determined whether or not the above described engine start flag F_ENGSTART is equal to 1.

Figure 30:
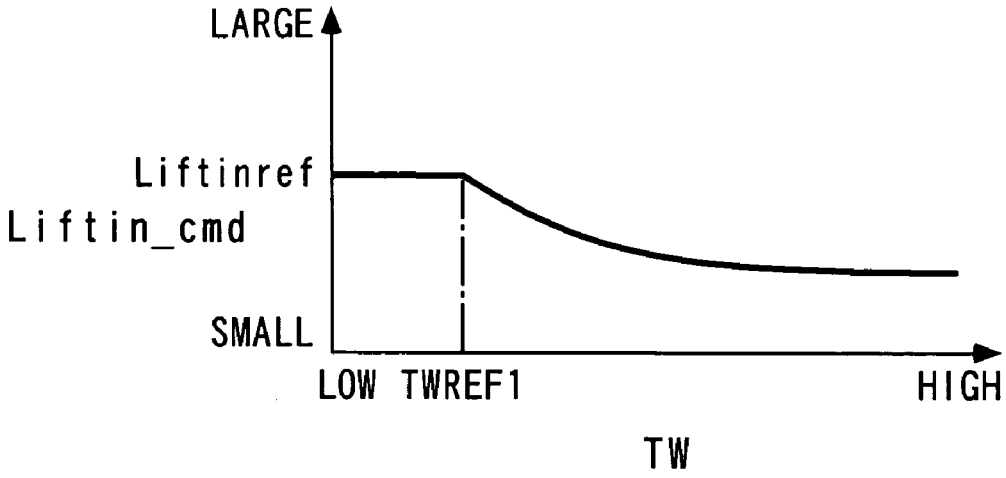
FIG. 30 is a diagram showing an example of a table for use in calculation of a target valve lift Liftin_cmd during starting of the engine.

If the answer to the above question is affirmative (YES), i.e. if the engine starting control is being executed, the process proceeds to a step 132, wherein a target valve lift Liftin_cmd is calculated by searching a table shown in FIG. 30 according to the engine coolant temperature TW.

In this table, in a range where the engine coolant temperature TW is higher than a predetermined value TWREF1, the target valve lift Liftin_cmd is set to a larger value as the engine coolant temperature TW is lower, and in a range where TW≦TWREF1 holds, the target valve lift Liftin_cmd is set to a predetermined value Liftinref. This is to compensate for an increase in friction of the variable valve lift mechanism 50, which is caused when the engine coolant temperature TW is low.

Figure 31:
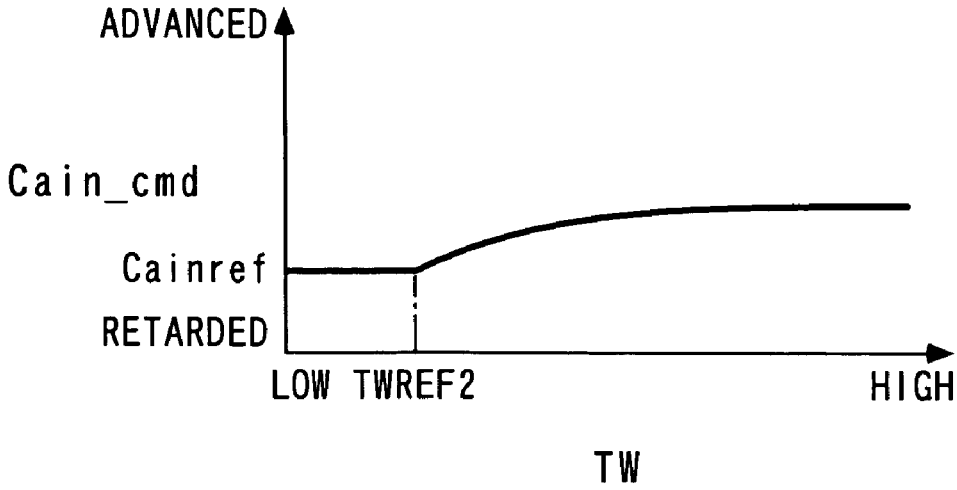
FIG. 31 is a diagram showing an example of a table for use in calculation of a target cam phase Cain_cmd during starting of the engine.

Then, in a step 133, a target cam phase Cain_cmd is calculated by searching a table shown in FIG. 31 according to the engine coolant temperature TW.

In this table, in a range where the engine coolant temperature TW is higher than a predetermined value TWREF2, the target cam phase Cain_cmd is set to a more retarded value as the engine coolant temperature TW is lower, and in a range where TW≦TWREF2 holds, the target cam phase Cain_cmd is set to a predetermined value Cainref. This is to ensure the combustion stability of the engine 3 by controlling the cam phase Cain to a more retarded value when the engine coolant temperature TW is low than when the engine coolant temperature TW is high, to thereby reduce the valve overlap, to increase the flow velocity of intake air.

Subsequently, the process proceeds to a step 134, wherein the lift control input U_Liftin is calculated with a target value filter-type two-degree-of-freedom sliding mode control algorithm expressed by the following equations (35) to (38).

$$U_Liftin = -Krch_lf \cdot \sigma_lf(k) - Kadp_lf \cdot \sum_{i=0}^{k} \sigma_lf(i) \tag{35}$$

$$\sigma_lf(k) = E_lf(k) + pole_lf \cdot E_lf(k-1) \tag{36}$$

$$E_lf(k) = Liftin_comp(k) - Liftin_cmd_f(k) \tag{37}$$

$$Liftin_cmd_f(k) = -pole_f_lf \cdot Liftin_cmd_f(k-1) + (1 + pole_f_lf) \cdot Liftin_cmd(k) \tag{38}$$

In the equation (35), Krch_lf and Kadp_lf represent a predetermined reaching law gain and a predetermined adaptive law gain, respectively. Furthermore, σ_lf represents a switching function defined by the equation (36). In the equation (36), pole_lf represents a response-specifying parameter set to a value which satisfies the relationship of $-1<pole_lf<0$, and E_lf represents a follow-up error calculated by the equation (37). In the equation (37), Liftin_cmd_f represents a filtered value of the target valve lift, and is calculated with a first-order lag filter algorithm expressed by the equation (38). In the equation (38), pole_f_lf represents a target value filter-setting parameter set to a value which satisfies the relationship of $-1<pole_f_lf<0$.

Next, the process proceeds to a step 135, wherein the phase control input U_Cain is calculated with a target value filter-type two-degree-of-freedom sliding mode control algorithm expressed by the following equations (39) to (42).

$$U_Cain = -Krch_ca \cdot \sigma_ca(k) - Kadp_ca \cdot \sum_{i=0}^{k} \sigma_ca(i) \tag{39}$$

$$\sigma_ca(k) = E_ca(k) + pole_ca \cdot E_ca(k-1) \tag{40}$$

$$E_ca(k) = Cain_comp(k) - Cain_cmd_f(k) \tag{41}$$

$$Cain_cmd_f(k) = -pole_f_ca \cdot Cain_cmd_f(k-1) + (1 + pole_f_ca) \cdot Cain_cmd(k) \tag{42}$$

In the equation (39), Krch_ca and Kadp_ca represent a predetermined reaching law gain and a predetermined adaptive law gain, respectively. Furthermore, σ_ca represents a switching function defined by the equation (40). In the equation (40), pole_ca represents a response-specifying parameter set to a value which satisfies the relationship of $-1<pole_ca<0$, and E_ca represents a follow-up error calculated by the equation (41). In the equation (41), Cain_cmd_f represents a filtered value of the target cam phase, and is calculated with a first-order lag filter algorithm expressed by the equation (42). In the equation (42), pole_f_ca represents a target value filter-setting parameter set to a value which satisfies the relationship of $-1<pole_f_ca<0$.

In the step 135, the phase control input U_Cain is calculated as above, followed by terminating the present process.

On the other hand, if the answer to the question of the step 131 is negative (NO), i.e. if the engine starting control is not being executed, the process proceeds to a step 136, wherein it is determined whether or not the accelerator pedal opening AP is smaller than the predetermined value APREF. If the answer to this question is affirmative (YES), i.e. if the accelerator pedal is not stepped on, the process proceeds to a step 137, wherein it is determined whether or not the execution time period Tcat for the catalyst warmup control is smaller than the predetermined value Tcatlmt.

Figure 32:
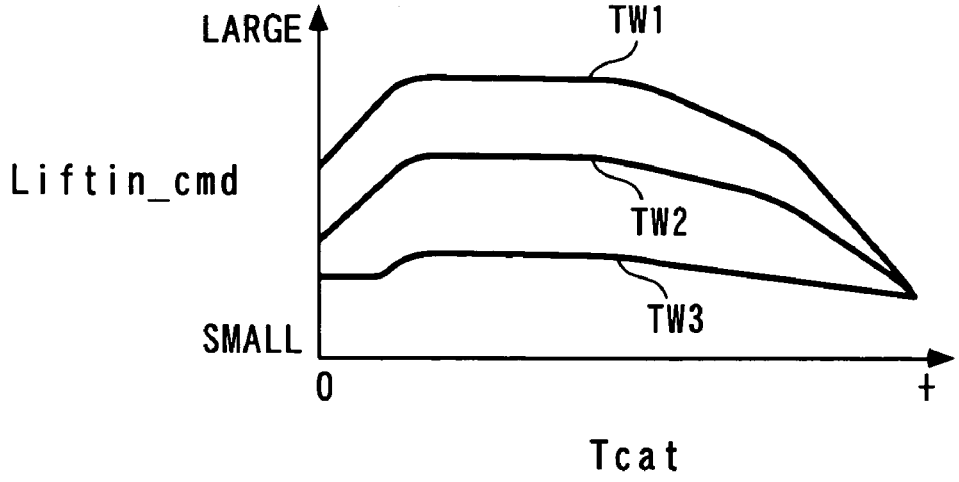
FIG. 32 is a diagram showing an example of a map for use in calculation of a target valve lift Liftin_cmd during catalyst warmup control.

If the answer to this question is affirmative (YES), i.e. if Tcat<Tcatlmt holds, it is judged that the catalyst warmup control should be executed, and the process proceeds to a step 138, wherein the target valve lift Liftin_cmd is calculated by searching a map shown in FIG. 32 according to the execution time period Tcat for the catalyst warmup control and the engine coolant temperature TW. In FIG. 32, TW1 to TW3 indicate predetermined values of the engine coolant temperature TW, between which the relationship of TW1<TW2<TW3 holds. This also applies to the following description.

In this map, the target valve lift Liftin_cmd is set to a larger value as the engine coolant temperature TW is lower. This is because as the engine coolant temperature TW is lower, it takes a longer time period to activate the catalyst, and hence the volume of exhaust gasses is increased to shorten the time period required for activating the catalyst. Furthermore, in the above map, the target valve lift Liftin_cmd is set to a larger value as the execution time period Tcat becomes longer in a range where the execution time period Tcat for the catalyst warmup control is short i.e. before reaching a certain time period, whereas after the elapse of the certain time period, the target valve lift Liftin_cmd is set to a smaller value as the execution time period Tcat becomes longer. This is because the warming up of the engine 3 proceeds along with the lapse of the execution time period Tcat, so that when the friction lowers, unless the intake air amount is decreased, the ignition timing is excessively retarded so as to hold the engine speed NE at a target value, which makes unstable the combustion state of the engine. To avoid the combustion state from being unstable, the map is configured as described above.

Figure 33:
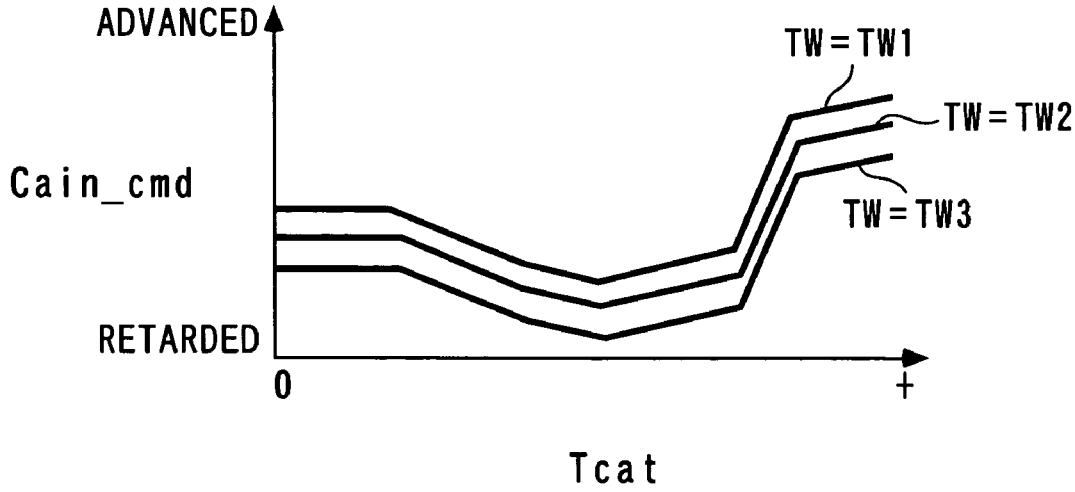
FIG. 33 is a diagram showing an example of a map for use in calculation of a target cam phase Cain_cmd during the catalyst warmup control.

Then, in a step 139, the target cam phase Cain_cmd is calculated by searching a map shown in FIG. 33 according to the execution time period Tcat for the catalyst warmup control and the engine coolant temperature TW.

In this map, the target cam phase Cain_cmd is set to a more advanced value as the engine coolant temperature TW is lower. This is because as the engine coolant temperature TW is lower, it takes a longer time period to activate the catalyst, as described above, and hence the pumping loss is reduced to increase the intake air amount to thereby shorten the time period required for activating the catalyst. Furthermore, in the above map, the target cam phase Cain_cmd is set to a more retarded value as the execution time period Tcat becomes longer in a range where the execution time period Tcat for the catalyst warmup control is short i.e. before reaching the certain time period, whereas after the lapse of the certain time period of the execution time period Tcat, the target cam phase Cain_cmd is set to a more advanced value as the execution time period Tcat is longer. The reason for this is the same as given in the description of the FIG. 32 map.

Then, the steps 134 and 135 are carried out, as described hereinabove. After that, the present process is terminated.

Figure 34:
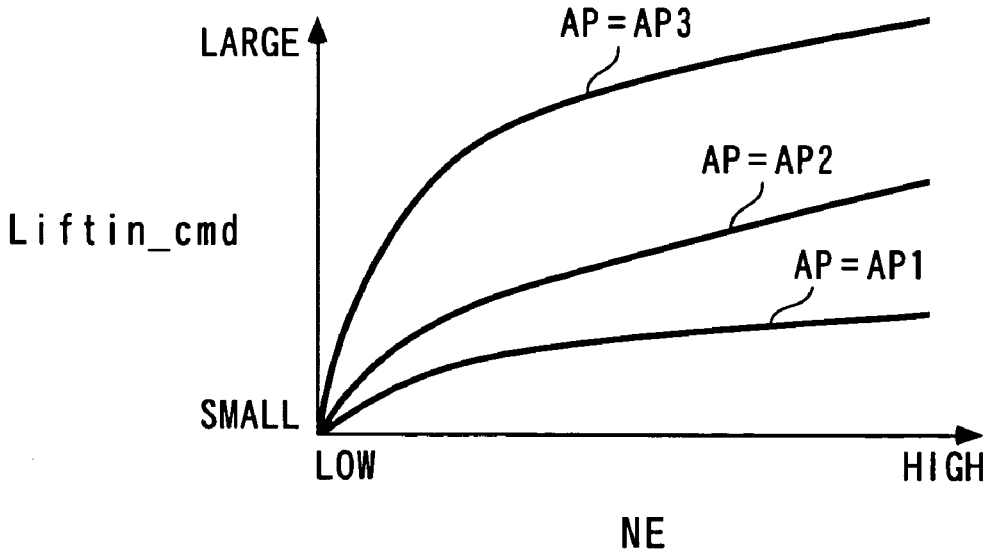
FIG. 34 is a diagram showing an example of a map for use in calculation of a target valve lift Liftin_cmd during normal operation of the engine.

On the other hand, if the answer to the question of the step 136 or 137 is negative (NO), i.e. if Tcat≧Tcatlmt holds, or if the accelerator pedal is stepped on, the process proceeds to a step 140, wherein the target valve lift Liftin_cmd is calculated by searching a map shown in FIG. 34 according to the engine speed NE and the accelerator pedal opening AP. In FIG. 34, AP1 to Ap3 indicate predetermined values of the accelerator pedal opening AP, between which the relationship of AP1<AP2<AP3 holds. This also applies to the following description.

In this map, the target valve lift Liftin_cmd is set to a larger value as the engine speed NE is higher, or as the accelerator pedal opening AP is larger. This is because as the engine speed NE is higher, or as the accelerator pedal opening AP is larger, an output required of the engine 3 is larger, and hence a larger intake air amount is required.

Figure 35:
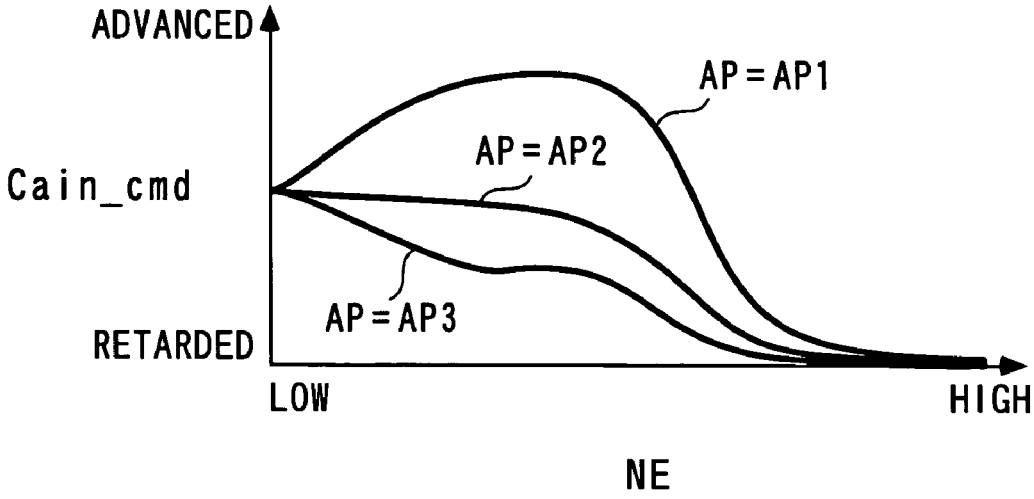
FIG. 35 is a diagram showing an example of a map for use in calculation of the target cam phase Cain_cmd during normal operation of the engine.

Then, in a step 141, the target cam phase Cain_cmd is calculated by searching a map shown in FIG. 35 according to the engine speed NE and the accelerator pedal opening AP. In this map, when the accelerator pedal opening AP is small, and the engine speed NE is in the medium rotational speed region, the target cam phase Cain_cmd is set to a more advanced value than otherwise. This is because under the above operating conditions of the engine 3, it is necessary to reduce the internal EGR amount to reduce the pumping loss.

Following the step 141, the steps 134 and 135 are carried out, as described hereinabove. After that, the present process is terminated.

On the other hand, if the answer to the question of the step 130 is affirmative (YES), i.e. if at least one of the two variable mechanisms is faulty, the process proceeds to a step 142, wherein the lift control input U_Liftin is set to the predetermined failure time value U_Liftin_fs, and the phase control input U_Cain to the predetermined failure time value U_Cain_fs, followed by terminating the present process. As a result, as described above, the valve lift Liftin is held at the minimum value Liftinmin, and the cam phase Cain at the predetermined locking value, whereby it is possible to suitably carry out idling or starting of the engine 3 during stoppage of the vehicle, and at the same time hold the vehicle in the state of low-speed traveling when the vehicle is traveling.

Next, a description will be given of the results of simulations of the air-fuel ratio control by the control system 1 of the first embodiment, configured as above. FIG. 36 shows an example of the results of feedback control of the air-fuel ratio by the control system 1, which is carried out using the air-fuel ratio correction coefficient KSTR during idling of the engine 3 when the valve lift Liftin calculated based on the signal output from the pivot angle sensor 25 (the calculated values are indicated by a solid line) deviates toward a smaller side with respect to an actual valve lift (values of which are indicated by a two-dot chain line).

Figure 36:
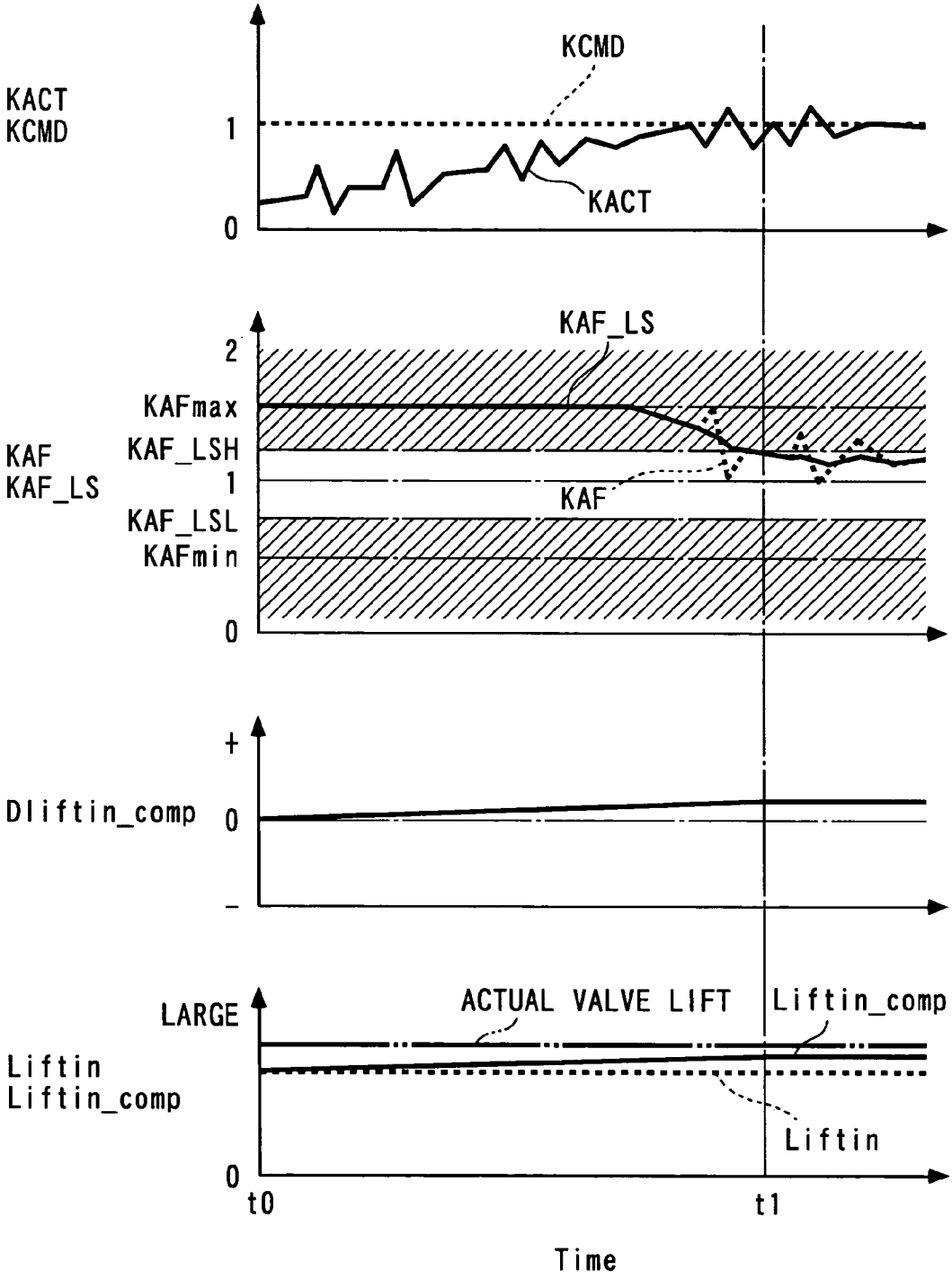
FIG. 36 is a timing diagram showing an example of results of air-fuel ratio control carried out by the control system according to the first embodiment.

In FIG. 36, regions where the lift correction value Dliftin_comp and the corrected valve lift Liftin_comp are both updated (changed) are indicated by hatching. It should be noted that during idling of the engine 3, the cam phase Cain is controlled to a range where Cain_ret≦Cain≦Cain_adv holds, and neither the corrected cam phase Cain_comp nor the phase correction value Dcain_comp is changed, so that curves indicating the values Cain_comp and Dcain_comp are omitted in FIG. 36.

Figure 37:
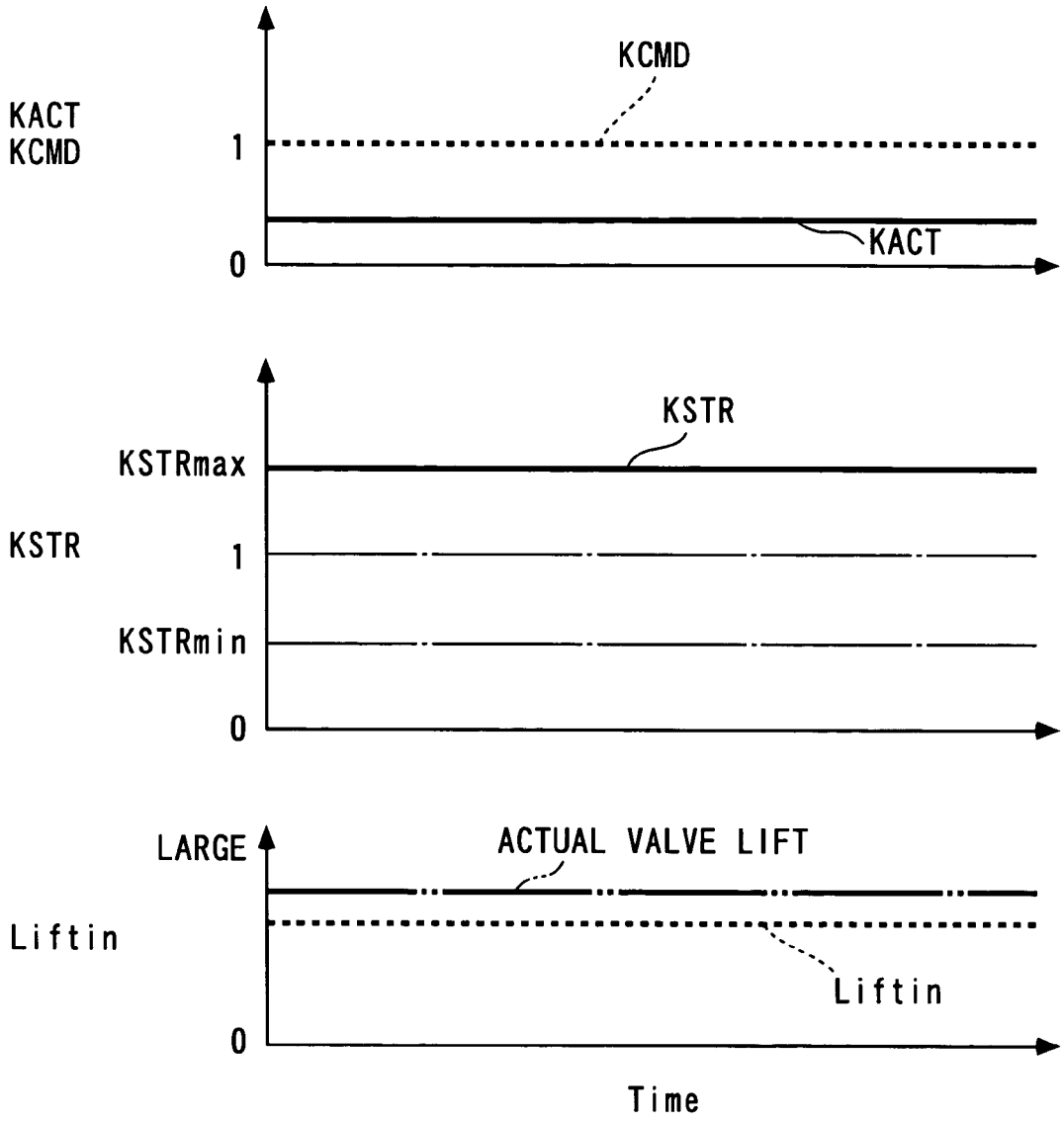
FIG. 37 is a timing diagram showing results of the air-fuel ratio control of a comparative example.

Further, FIG. 37 shows an example of the results of air-fuel ratio control for comparison with the FIG. 36 example, in which the feedback control of the air-fuel ratio is carried out using the air-fuel ratio correction coefficient KSTR during idling of the engine 3, without correcting the valve lift Lintin (i.e. without using the corrected valve lift Liftin_comp), when the valve lift Liftin (values of which are indicated by a solid line) deviates toward a smaller side with respect to an actual valve lift (values of which are indicated by a two-dot chain line).

As shown in FIG. 37, at the start of the feedback control of the air-fuel ratio, when the valve lift Liftin deviates toward the smaller side with respect to the actual valve lift, and the degree of the deviation is relatively large, the actual amount of intake air drawn into each cylinder 3*a* is made considerably larger than the calculated intake air amount due to the deviation, whereby the actual air-fuel ratio of the mixture deviates toward the leaner side, which causes the detected air-fuel ratio KACT to largely deviate toward the leaner side with respect to the target air-fuel ratio KCMD. To correct the above deviation, although in the air-fuel ratio control, the air-fuel ratio correction coefficient KSTR is calculated as a value on the fairly richer side, larger than the upper limit value KSTRmax, the air-fuel ratio correction coefficient KSTR is controlled to the upper limit value KSTRmax by the aforementioned limiting process. As a result, the detected air-fuel ratio KACT does not converge to the target air-fuel ratio KCMD even with the lapse of time, and held at a leaner value than the target air-fuel ratio KCM.

On the other hand, as shown in FIG. 36, in the case of the control system 1 of the present embodiment, when the feedback control of the air-fuel ratio is started (time t0), the valve lift Liftin and the corrected valve lift Liftin_comp deviate from the actual valve lift (values of which are indicated by the two dot chain lines), toward the smaller side, which causes the detected air-fuel ratio KACT to largely deviate toward the leaner side with respect to the target air-fuel ratio KCMD, whereby the air-fuel ratio index value KAF is held at a maximum value KAFmax (=KSTRmax/KCMD).

Then, in accordance with the progress of the process for calculating the corrected valve lift Liftin_comp, the corrected valve lift Liftin_comp is corrected such that it is made closer to the actual valve lift. In parallel with the above correction, in accordance with the progress of the feedback control of the air-fuel ratio using the corrected valve lift Liftin_comp, the detected air-fuel ratio KACT changes such that it converges to the target air-fuel ratio KCMD, and the statistically processed value KAF_LS of the air-fuel ratio index value crosses the upper limit value KAF_LSH to become a value within the range of KAF_LSL<KAF_LS<KAF_LSH (time t1). From this time on, the lift correction value Dliftin_comp and the corrected valve lift Liftin_comp are held at fixed values, respectively, and the detected air-fuel ratio KACT is controlled such that it converges to the target air-fuel ratio KCMD. As described above, according to the control system 1 of the present embodiment, it is understood that the corrected valve lift Liftin_comp is calculated such that it is made closer to the actual value, and therefore the air-fuel ratio feedback control is carried out using the thus calculated corrected valve lift Liftin_comp, whereby it is possible to quickly converge the detected air-fuel ratio KACT to the target air-fuel ratio KCMD.

Further, it is understood that although the air-fuel ratio index value KAF changes in an oscillatory state due to a change in the operating condition of the engine 3 along with the progress of the feedback control of the air-fuel ratio, the statistically processed value KAF_LS is calculated with the sequential least-squares method algorithm, and hence it can be calculated as a value indicating a stabilized changing state of the air-fuel ratio index value KAF while avoiding the influence of the oscillatory changing state thereof.

As described hereinabove, according to the control system 1 of the present embodiment, during idling of the engine 3, or in a stable operating condition of the engine 3, when the feedback control of the air-fuel ratio is being performed using the air-fuel ratio correction coefficient KSTR, the corrected valve lift Liftin_comp and the corrected cam phase Cain_comp are calculated as values obtained by correcting the valve lift Liftin and the cam phase Cain according to the statistically processed value KAF_LS of the air-fuel ratio index value, respectively. When deviation of the corrected valve lift Liftin_comp (or the valve lift Liftin) from the actual value or deviation of the corrected cam phase Cain_comp (or the cam phase Cain) from the actual value occurs for the reasons described above, the air-fuel ratio index value KAF assumes a larger value or a smaller value than a value of 1 due to the above deviation. More specifically, since the above deviation is reflected on the air-fuel ratio index value KAF, the fuel injection amount TOUT and the ignition timing Iglog are calculated using the corrected valve lift Liftin_comp and the corrected cam phase Cain_comp calculated according to the statistically processed value KAF_LS of the air-fuel ratio index value reflecting the deviation, whereby it is possible to properly carry out the air-fuel ration control and the ignition timing control while compensating for the influence of the above deviation. This makes it possible to ensure a stable combustion state and excellent reduction of exhaust emissions, thereby making it possible to maintain excellent combustion efficiency and fuel economy.

Further, generally, in the air-fuel ratio control, when the operating condition or the combustion state of the engine 3 changes, the state of control of the air-fuel ratio is changed accordingly in an oscillatory manner between a direction toward the leaner side and a direction toward the richer side, whereby the air-fuel ratio correction coefficient KSTR is changed in an oscillating manner to cause an oscillatory change in the air-fuel ratio index value KAF as well. Therefore, when the corrected valve lift Liftin_comp and the corrected cam phase Cain_comp are calculated using the thus changed air-fuel ratio index value KAF, the calculated values thereof are also changed in an oscillating manner to reduce the control accuracy of the air-fuel ratio control and the ignition timing control. This can cause occurrence of surging and fluctuation in the engine speed NE, resulting in the degraded drivability. In contrast, the present invention uses the statistically processed value KAF_LS obtained by statistically processing the air-fuel ratio index value KAF with the sequential least-squares method algorithm, and hence it is possible to avoid occurrence of surging and fluctuation in the engine speed NE, thereby making it possible to ensure excellent drivability.

Furthermore, when the statistically processed value KAF_LS is not within the range of KAF_LSL<KAF_LS<KAF_LSH, the lift correction value Dliftin_comp and the phase correction value Dcain_comp are updated such that the statistically processed value KAF_LS is within the above range, and when the statistically processed value KAF_LS is within the range, update of the two correction values Dliftin_comp and Dcain_comp is stopped, and the two correction values are held at fixed values, respectively, so that it is possible to avoid the process for calculating the corrected valve lift Liftin_comp and the corrected cam phase Cain_comp, and the feedback control of the air-fuel ratio from interfering with each other. This makes it possible to enhance the accuracy of the air-fuel ratio control and reduce exhaust emissions.

Further, the first estimated intake air amount Gcyl_vt is calculated according to the corrected valve lift Liftin_comp and the corrected cam phase Cain_comp, and the second estimated intake air amount Gcyl_afm is calculated according to the air flow rate Gin detected by the air flow sensor 22. Then, the calculated intake air amount Gcyl is calculated by the equation (4) as a weighted average value of the first and second estimated intake air amounts Gcyl_vt and Gcyl_afm, and within the range of Gin_vt≦Gin1, Gcyl=Gcyl_vt is set, while within the range of Gin2≦Gin_vt, Gcyl=Gcyl_afm is set.

In the air-fuel ratio control, the fuel injection amount TOUT is calculated based on the calculated intake air amount Gcyl, and hence when Gin_vt≦Gin1 holds, that is, when the reliability of the detection signal from the air flow sensor 22 is low due to a low flow rate of air flowing through the intake passage 12*a*, so that the reliability of the first estimated intake air amount Gcyl_vt exceeds that of the second estimated intake air amount Gcyl_afm, the fuel injection amount TOUT can be accurately calculated based on the first estimated intake air amount Gcyl_vt higher in reliability. Further, when Gin2≦Gin_vt holds, that is, when the reliability of the detection signal from the air flow sensor 22 is high due to a high flow rate of air flowing through the intake passage 12*a*, so that the reliability of the second estimated intake air amount Gcyl_afm exceeds that of the first estimated intake air amount Gcyl_vt, the fuel injection amount TOUT can be accurately calculated based on the second estimated intake air amount Gcyl_afm higher in reliability. As described above, the fuel injection amount TOUT can be calculated with accuracy not only in the low-load region of the engine 3 where the reliability of the first estimated intake air amount Gcyl_vt exceeds that of the second estimated intake air amount Gcyl_afm, but also in a load region opposite thereto, so that it is possible to enhance the accuracy of the air-fuel ratio control. As a result, it is possible to improve fuel economy and reduce exhaust emissions.

On the other hand, in the ignition timing control, the ignition timing Iglog is calculated using the normalized intake air amount Kgcyl which is the ratio between the calculated intake air amount Gcyl and the maximum estimated intake air amount Gcyl_max, so that when Gin_vt≦Gin1 or Gin2≦Gin_vt holds, that is, even in a region where the reliability of one of the first and second estimated intake air amounts Gcyl_vt and Gcyl_afm exceeds that of the other, it is possible to calculate the ignition timing Iglog with accuracy based on a value higher in reliability. This makes it possible to improve the accuracy of the ignition timing control, which can result in the enhanced fuel economy and combustion stability.

It should be noted that although the present embodiment is an example in which the corrected valve lift Liftin_comp and the corrected cam phase Cain_comp are calculated according to the statistically processed value KAF_LS obtained by statistically processing the air-fuel ratio index value KAF with the sequential least-squares method algorithm, the corrected valve lift Liftin_comp and the corrected cam phase Cain_comp may be calculated according to the air-fuel ratio index value KAF in place of the statistically processed value KAF_LS. Furthermore, the corrected valve lift Liftin_comp and the corrected cam phase Cain_comp may be calculated according to the air-fuel ratio correction coefficient KSTR or a value obtained by statistically processing the air-fuel ratio correction coefficient KSTR, in place of the statistically processed value KAF_LS.

Further, the corrected valve lift Liftin_comp may be calculated by searching a map according to the valve lift Liftin and the statistically processed value KAF_LS (or the air-fuel ratio index value KAF). Similarly, the corrected cam phase Cain_comp as well may be calculated by searching a map according to the cam phase Cain and the statistically processed value KAF_LS (or the air-fuel ratio index value KAF).

Furthermore, the statistical processing algorithm for calculating the statistically processed value KAF_LS is not necessarily limited to the fixed-gain sequential least-squares method algorithm according to the first embodiment, but it may be any suitable statistical processing algorithm so long as it is capable of avoiding the influence of the oscillatory change of the air-fuel ratio index value KAF. For example, a variable-gain sequential least-squares method algorithm, a moving average algorithm, or the like may be used as the statistical processing algorithm for calculating the statistically processed value KAF_LS.

Figure 38:
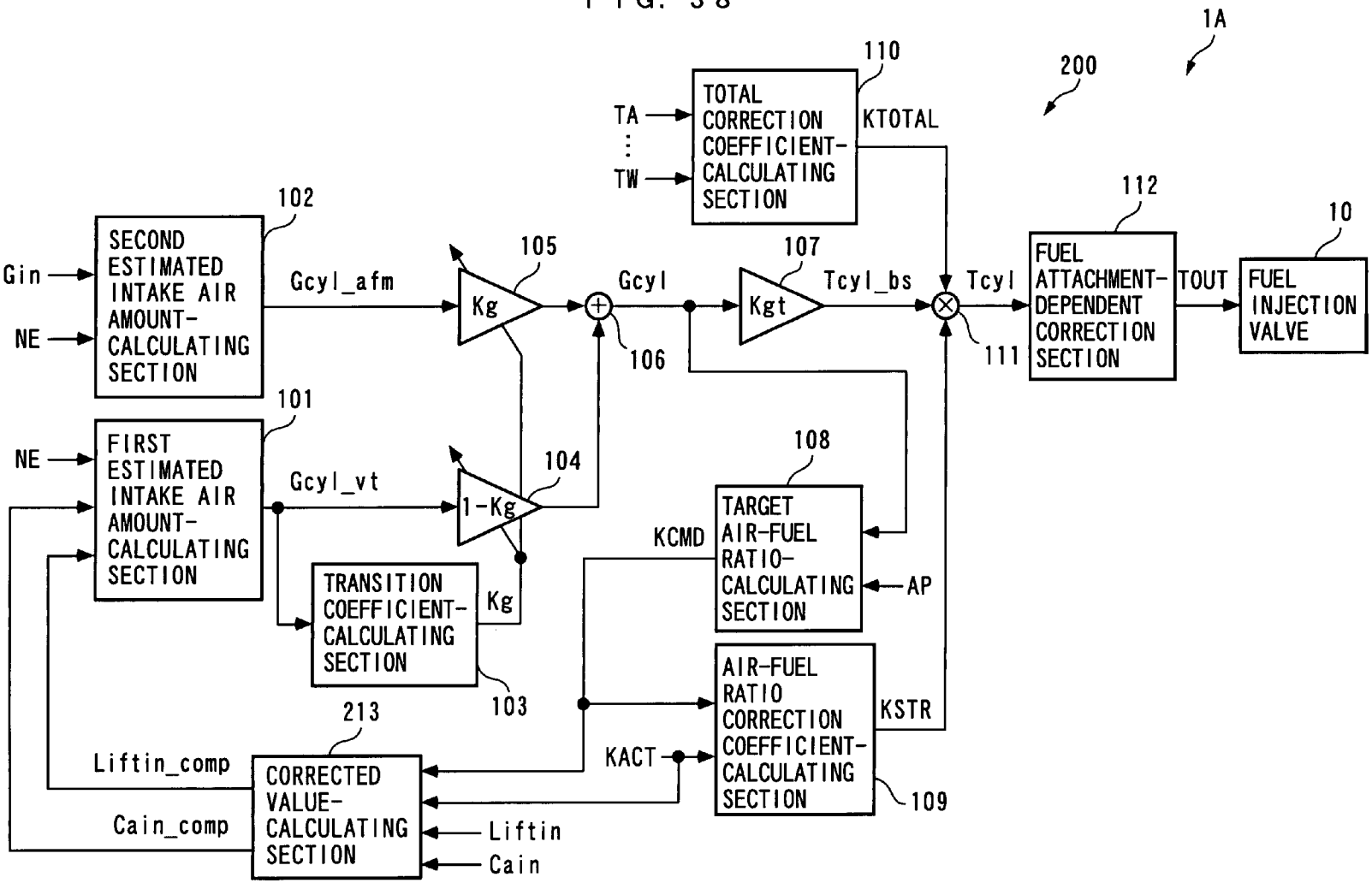
FIG. 38 is a block diagram schematically showing the arrangement of an air-fuel ratio controller of a control system according to a second embodiment of the present invention.
Figure 39:
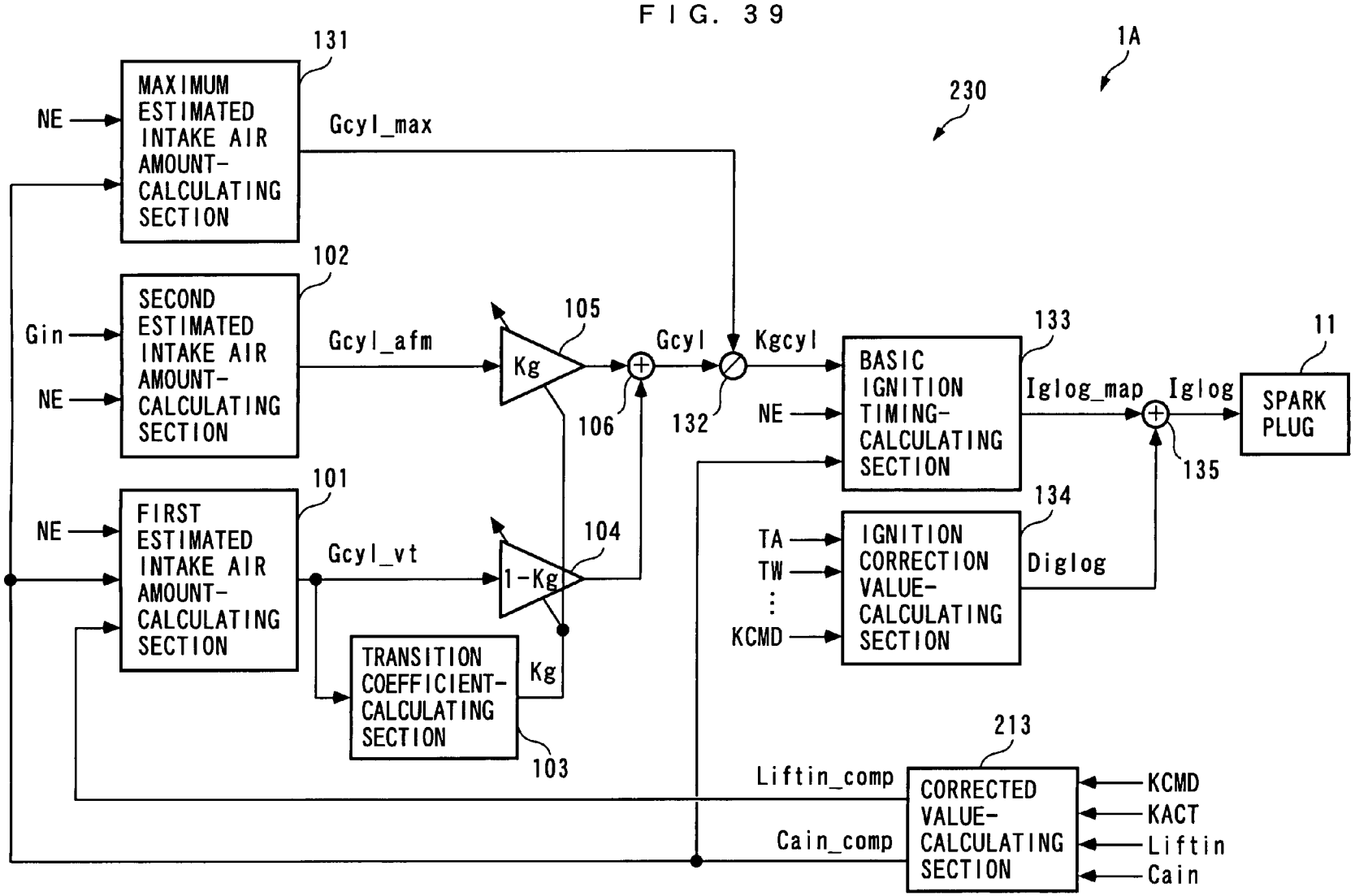
FIG. 39 is a block diagram schematically showing the arrangement of an ignition timing controller of the control system according to the second embodiment.

Next, a control system 1A according to a second embodiment of the present invention will be described. The control system 1A is configured similarly to the control system 1 of the first embodiment described above, except for part thereof. Therefore, the following description will be mainly given of the different points from the control system 1 of the first embodiment. Referring to FIGS. 38 and 39, the control system 1A includes an air-fuel ratio controller 200 and an ignition timing controller 230. The air-fuel ratio controller 200 and the ignition timing controller 230 are implemented by the ECU 2. In the present embodiment, the air-fuel ratio controller 200 corresponds to the fuel amount-determining means and the air-fuel ratio control means, while the ignition timing controller 230 corresponds to the ignition timing-determining means.

Referring to FIGS. 38 and 39, the air-fuel ratio controller 200 and the ignition timing controller 230 are configured similarly to the air-fuel ratio controller 100 and ignition timing controller 130 described hereinabove, respectively, except a corrected value-calculating section 213 which corresponds to the corrected value-calculating section 113, and hence component elements thereof identical to those of the controllers 100 and 130 are designated by identical reference numerals, and detailed description thereof is omitted. The following description of the two controllers 200 and 230 will be given as to the corrected value-calculating section 213 (correcting means) alone.

Figure 40:
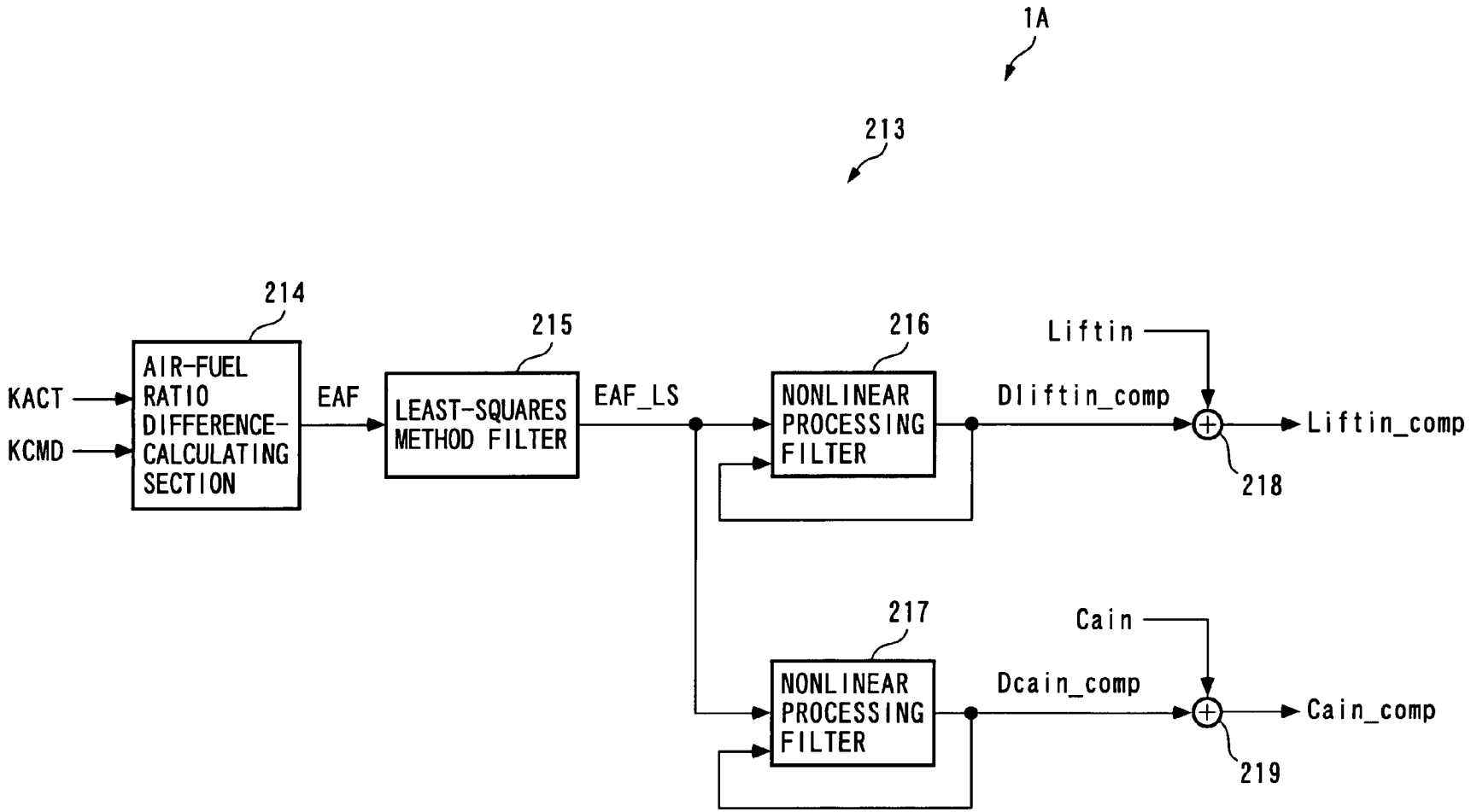
FIG. 40 is a block diagram schematically showing the arrangement of a corrected value-calculating section according to the second embodiment.

The above corrected value-calculating section 213 calculates the corrected valve lift Liftin_comp and the corrected cam phase Cain_comp according to the target air-fuel ratio KCMD and the detected air-fuel ratio KACT, and as shown in FIG. 40, is comprised of an air-fuel ratio difference-calculating section 214, a least-squares method filter 215, nonlinear processing filters 216 and 217, and addition elements 218 and 219.

First, the air-fuel ratio difference-calculating section 214 calculates an air-fuel ratio difference EAF (=KACT−KCMD) by subtracting the target air-fuel ratio KCMD from the detected air-fuel ratio KACT. In the present embodiment, the air-fuel ratio difference EAF corresponds to the control state value.

Next, the least-squares method filter 215 calculates a statistically processed value EAF_LS of the air-fuel ratio difference (hereinafter simply referred to as "the statistically processed value EAF_LS") with a fixed-gain sequential least-squares method algorithm expressed by the following equations (43) and (44).

$$\mathrm{EAF_LS}(k) = \mathrm{EAF_LS}(k-1) + \frac{\mathrm{P_ls'}}{1+\mathrm{P_ls'}} \cdot \mathrm{e_ls'}(k) \tag{43}$$

$$\mathrm{e_ls'}(k) = EAF(k) - \mathrm{EAF_LS}(k-1) \tag{44}$$

In the above equation (43), e_ls' represents a difference calculated by the equation (44), and P_ls' a predetermined gain (fixed value).

Further, the nonlinear processing filter 216 calculates the lift correction value Dliftin_comp by one of the following equations (45) to (47) based on the result of comparison of the above statistically processed value KAF_LS with predetermined upper and lower limit values EAF_LSH and EAF_LSL.

When EAF_LS(k)≧EAF_LSH holds, $$Dliftin_comp(k)=Dliftin_comp(k-1)-Ddec \tag{45}$$

When EAF_LSL<EAF_LS(k)<EAF_LSH holds, $$Dliftin_comp(k)=Dliftin_comp(k-1) \tag{46}$$

When EAF_LS(k)≦EAF_LSH holds, $$Dliftin_comp(k)=Dliftin_comp(k-1)+Dinc \tag{47}$$

Then, the addition element 218 calculates the corrected valve lift Liftin_comp by the following equation (48):

$$Liftin_comp(k)=Liftin(k)+Dliftin_comp(k) \tag{48}$$

The corrected value-calculating section 213 calculates the corrected valve lift Liftin_comp and the lift correction value Dliftin_comp, as described above. This is for the following reason: When the valve lift Liftin calculated based on the signal output from the pivot angle sensor 25 deviates from the actual value for the above-described reason, if feedback control of the air-fuel ratio is performed in a stable operating condition of the engine 3, the detected air-fuel ratio KACT does not converge to the target air-fuel ratio KCMD due to the deviation of the valve lift Liftin, and deviates toward the leaner or richer side.

For example, when the valve lift Liftin assumes a smaller value than the actual value, the actual intake air amount become larger than the calculated intake air amount Gcyl, whereby the detected air-fuel ratio KACT deviates toward the leaner side with respect to the target air-fuel ratio KCMD. As a result, e.g. when KCMD=1, the air-fuel ratio difference EAF (=KACT−KCMD)<0 holds. Inversely, when the valve lift Liftin assumes a larger value than the actual value, the detected air-fuel ratio KACT deviates toward the richer side with respect to the target air-fuel ratio KCMD, so that e.g. when KCMD=1, EAF>0 holds. The above-described correlation exists between the deviation of the valve lift Liftin from the actual value, and the air-fuel ratio difference value EAF, and in the present embodiment, the air-fuel ratio control is carried out using the calculated intake air amount Gcyl calculated according to the corrected valve lift Liftin_comp, so that the deviation of the corrected valve lift Liftin_comp from the actual value is reflected on the air-fuel ratio difference EAF.

Therefore, when EAF_LS(k)≧EAF_LSH holds, the valve lift Liftin deviates from the actual value toward the larger side, so that as expressed by the aforementioned equation (45), the lift correction value Dliftin_comp is decreased, thereby making it possible to make the corrected valve lift Liftin_comp closer to the actual valve lift. On the other hand, when EAF_LS(k)≦EAF_LSL holds, the valve lift Liftin deviates from the actual value toward the smaller side, and hence as expressed by the aforementioned equation (47), the lift correction value Dliftin_comp is increased, thereby making it possible to make the corrected valve lift Liftin_comp closer to the actual value (see FIG. 41, referred to hereinafter)

Further, when EAF_LSL<EAF_LS(k)<EAF_LSH holds, the lift correction value Dliftin_comp is held at a fixed value without being updated. This is, as described hereinbefore, to avoid the process for calculating the corrected valve lift Liftin_comp and feedback control of the air-fuel ratio from interfering with each other. Further, since the deviation between the corrected valve lift Liftin_comp and the actual value is small, the upper and lower limit values EAF_LSH and EAF_LSL are set to values (e.g. EAF_LSH=0.1, and EAF_LSL=−0.1) which can prevent the accuracy of the air-fuel ratio control from being degraded even if the lift correction value Dliftin_comp is held at the fixed value, and update of the corrected valve lift Liftin_comp is stopped.

On the other hand, the nonlinear processing filter 217 calculates the phase correction value Dcain_comp by any of the following equations (49) to (51) based on the result of comparison of the above-described statistically processed value EAF_LS with the predetermined upper and lower limit values EAF_LSH and EAF_LSL.

When EAF_LS(k)≧EAF_LSH holds, $$Dcain_comp(k)=Dcain_comp(k-1)+Dcomp \quad (49)$$

When EAF_LSL<EAF_LS(k)<EAF_LSH holds, $$Dcain_comp(k)=Dcain_comp(k-1) \quad (50)$$

When EAF_LS(k)≦EAF_LSL holds, $$Dcain_comp(k)=Dcain_comp(k-1)+Dcomp' \quad (51)$$

In the above equations (49) and (51), the correction terms Dcomp and Dcomp' are set to the following values based on the result of comparison of the cam phase Cain with the predetermined advanced and retarded values Cain_adv and Cain_ret.

When Cain(k)>Cain_adv holds,

Dcomp=−Dret

Dcomp'=Dadv

When Cain_ret≦Cain(k)≦Cain_adv holds,

Dcomp=0

Dcomp'=0

When Cain(k)<Cain_ret holds,

Dcomp=Dadv

Dcomp'=−Dret

Then, the addition element 219 calculates the corrected cam phase Cain_comp by the following equation (52):

$$Cain_comp(k)=Cain(k)+Dcain_comp(k) \quad (52)$$

The corrected value-calculating section 213 calculates the corrected cam phase Cain_comp and the phase correction value Dcain_comp, as described above. This is for the following reason: When the cam phase Cain calculated based on the signals output from the two sensors 20 and 26 deviates toward the advanced side or the retarded side with respect to the actual cam phase for the above-described reason, if feedback control of the air-fuel ratio is performed, the detected air-fuel ratio KACT does not converge to the target air-fuel ratio KCMD due to the change in the valve overlap or the change in the amount of the blow-back of intake air caused by retarded closing of the intake valve 4, but deviates toward the leaner or richer side. As a result, e.g. when KCMD=1, EAF<0 or EAF>0 holds. The above-described correlation exists between the deviation of the cam phase Cain from the actual value, and the air-fuel ratio difference EAF. In the present embodiment, since the air-fuel ratio control is performed using the calculated intake air amount Gcyl calculated according to the corrected cam phase Cain_comp, the deviation of the corrected cam phase Cain_comp from the actual value is reflected on the air-fuel ratio difference EAF.

Therefore, when EAF_LS(k)≧EAF_LSH holds, if Cain(k)>Cain_adv holds, and the cam phase Cain assumes a value in the advanced range, the corrected cam phase Cain_comp used for calculation of the calculated intake air amount Gcyl deviates toward the advanced side with respect to the actual value, whereby the actual intake air amount assumes a smaller value than that of the calculated intake air amount Gcyl due to the increase in the valve overlap. As a result, it is presumed that the detected air-fuel ratio KACT deviates toward the richer side with respect to the target air-fuel ratio KCMD. This makes it necessary to correct the corrected cam phase Cain_comp such that it is more retarded, and hence in the equation (49), the correction term Dcomp is set to a value of −Dret such that the phase correction value Dcain_comp is calculated as a smaller value.

Furthermore, when EAF_LS(k)≧_EAF_LSH holds, if Cain(k)<Cain_ret holds, and the cam phase Cain assumes a value in the retarded range, the corrected cam phase Cain_comp deviates toward the retarded side with respect to the actual value, whereby due to the increased degree of the retarded closing of the intake valve 4, the amount of the blow-back of intake air is increased to make the actual intake air amount smaller than the calculated intake air amount Gcyl. It is presumed that this results in deviation of the detected air-fuel ratio KACT toward the richer side with respect to the target air-fuel ratio KCMD. Therefore, it is necessary to correct the corrected cam phase Cain_comp such that it is more retarded, and therefore in the equation (49), the correction term Dcomp is set to a value of Dadv so as to cause the phase correction value Dcain_comp to be calculated as a larger value.

On the other hand, when EAF_LS(k)≦EAF_LSL holds, if Cain(k)>Cain_adv holds, and the cam phase Cain assumes a value in the advanced range, the corrected cam phase Cain_comp deviates toward the retarded side with respect to the actual value, whereby the actual intake air amount is larger than the calculated intake air amount Gcyl due to a decrease in the valve overlap. It is presumed that this results in deviation of the detected air-fuel ratio KACT toward the leaner side with respect to the target air-fuel ratio KCMD. Therefore, it is necessary to correct the corrected cam phase Cain_comp such that it is more advanced, and hence in the equation (51), the correction term Dcomp' is set to a value of Dadv so as to cause the phase correction value Dcain_comp to be calculated as a larger value.

Furthermore, when EAF_LS(k)≦EAF_LSL holds, if Cain(k)<Cain_ret holds and the cam phase Cain assumes a value in the retarded range, the corrected cam phase Cain_comp deviates toward the advanced side with respect to the actual value, whereby due to the decreased degree of the retarded closing of the intake valve 4, the amount of the blow-back of intake air is decreased to make the actual intake air amount larger than the calculated intake air amount Gcyl. Accordingly, it is presumed that this results in deviation of the detected air-fuel ratio KACT toward the leaner side with respect to the target air-fuel ratio KCMD. Therefore, it is necessary to correct the corrected cam phase Cain_comp such that it is more retarded, and therefore in the equation (51), the correction term Dcomp' is set to a value of −Dret so as to cause the phase correction value Dcain_comp to be calculated as a smaller value.

On the other hand, when EAF_LSL<EAF_LS(k)<EAF_LSH holds, or when Cain_ret≦Cain(k)≦Cain_adv holds, the phase correction value Dcain_comp is held at a fixed value without being updated. This is to avoid the process for calculating the corrected cam phase Cain_comp and feedback control of the air-fuel ratio from interfering with each other by holding the phase correction value Dcain_comp at the fixed value, and stopping the update of the corrected cam phase Cain_comp. Further, since deviation between the corrected cam phase Cain_comp and the actual value is small, the upper and lower limit values EAF_LSH and EAF_LSL and the predetermined values Cain_adv and Cain_ret are set to values which can prevent the accuracy of the air-fuel ratio control from being degraded even if the phase correction value Dcain_comp is held at the fixed value, and the update of the corrected cam phase Cain_comp is stopped.

Figure 41:
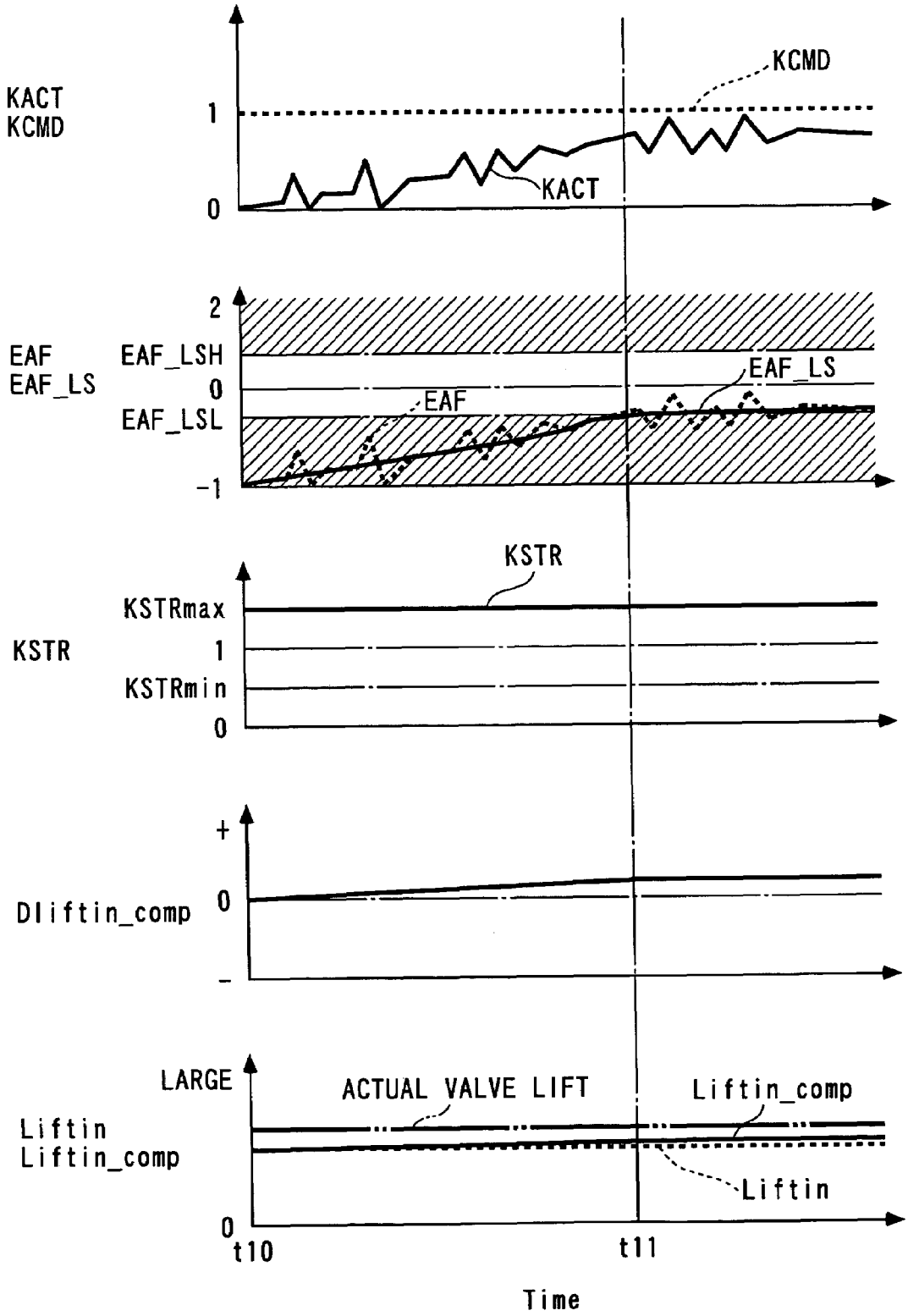
FIG. 41 is a timing diagram showing an example of results of air-fuel ratio control carried out by the control system according to the second embodiment.

Next, a description will be given of the results of control by the control system 1A according to the second embodiment, configured as above. FIG. 41 shows an example of the results of execution of feedback control of the air-fuel ratio using the air-fuel ratio correction coefficient KSTR and a corrected value-calculating process, during idling of the engine 3, when the valve lift Liftin calculated based on the signal output from the pivot angle sensor 25 (the calculated values are indicated by a solid line) deviates toward the smaller side than an actual valve lift (values of which are indicated by a two-dot chain line).

In FIG. 41, regions where the lift correction value Dliftin_comp and the corrected valve lift Liftin_comp are both updated are indicated by hatching. Further, as described hereinabove, since during idling of the engine 3, the cam phase Cain is controlled to the range where Cain_ret≦Cain≦Cain_adv holds, neither the corrected cam phase Cain_comp nor the phase correction value Dcain_comp is changed, so that curves indicating the values Cain_comp and Dcain_comp are omitted in FIG. 41.

As shown in FIG. 41, in the case of the control system A1 according to the second embodiment, when the feedback control of the air-fuel ratio is started (time t10), the valve lift Liftin, i.e. the corrected valve lift Liftin_comp deviates from the actual valve lift toward the smaller side, so that the detected air-fuel ratio KACT largely deviates toward the leaner side with respect to the target air-fuel ratio KCMD, whereby the air-fuel ratio difference EAF assumes a value in the vicinity of a value of −1. This causes the air-fuel ratio correction coefficient KSTR to be calculated as a value considerably larger than the maximum value KSTRmax, and hence it is limited to the maximum value KSTRmax by the aforementioned limiting process.

Then, in accordance with the progress of the process for calculating the corrected valve lift Liftin_comp, the corrected valve lift Liftin_comp is corrected such that it is made closer to the actual valve lift. In parallel with the above correction, in accordance with the progress of the feedback control of the air-fuel ratio using the corrected valve lift Liftin_comp, the detected air-fuel ratio KACT changes toward the target air-fuel ratio KCMD, and the statistically processed value EAF_LS of the air-fuel ratio difference crosses the lower limit value EAF_LSL to become a value within the range of EAF_LSL<EAF_LS <EAF_LSH (time t11). From this time on, the lift correction value Dliftin_comp is held at a fixed value, and the corrected valve lift Liftin_comp as well is held at a fixed value. As a result, the detected air-fuel ratio KACT is held in a state slightly deviating toward the leaner side with respect to the target air-fuel ration KCMD, and the air-fuel ratio correction coefficient KSTR is held at the maximum value KSTRmax.

Further, it is understood that although the air-fuel ratio difference EAF fluctuates in an oscillating manner in accordance with the progress of the feedback control of the air-fuel ratio, since the statistically processed value KAF_LS is calculated with the sequential least-squares method algorithm, it is possible to calculate the statistically processed value KAF_LS as a value indicating a stabilized changing state of the air-fuel ratio difference EAF while avoiding the influence of the fluctuation thereof.

Furthermore, in the case of the control system A1 according to the second embodiment, after the statistically processed value EAF_LS of the air-fuel ratio difference has become a value within the range of EAF_LSL<EAF_LS<EAF_LSH, the air-fuel ratio correction coefficient KSTR is held at the maximum value KSTRmax, so that it is understood that the above-described control system 1 of the first embodiment is capable of ensuring a more excellent controllability and stability in the air-fuel ratio control.

As described above, also in the control system A1 according to the second embodiment, the corrected valve lift Liftin_comp and the corrected cam phase Cain_comp are calculated as values obtained by correcting the valve lift Liftin and the cam phase Cain toward the actual values, respectively, so that it is possible to carry out the air-fuel ratio feedback control and the ignition timing control using the corrected valve lift Liftin_comp and the corrected cam phase Cain_comp, calculated as above, thereby making it possible to obtain the same advantageous effects as provided by the above-described control system 1 according to the first embodiment.

It should be noted that although the above-described embodiments are examples of application of the control system 1 according to the present invention to the internal combustion engine 3 for automotive vehicles, the control system is not necessarily limited to this, but it can be applied to internal combustion engines for various uses, such as those installed on boats, electric generators, and the like.

Further, although the above-described embodiments are examples in which the variable valve lift mechanism 50 and the variable cam phase mechanism 70 are employed as variable intake mechanisms, the variable intake mechanisms are not necessarily limited to these, but they may be any suitable variable intake mechanisms which are capable of changing the amount of intake air drawn into the combustion chamber of the engine 3. For example, a conventional throttle valve mechanism may be used as the variable intake mechanism. In this case, it is only required to use the opening of the throttle valve as an operating condition parameter.

Furthermore, although the above-described embodiments are examples in which the valve lift Liftin and the cam phase Cain are employed as operating condition parameters, only one of the valve lift Liftin and the cam phase Cain may be used as an operating condition parameter.

INDUSTRIAL APPLICABILITY

According to the control system of the present invention, by correcting the operating condition parameter according to the air-fuel ratio control parameter calculated as a value reflecting deviation of the air-fuel ratio or the air-fuel ratio parameter detected as such a value, it is possible to properly correct the deviation between the detection value of the operating condition parameter and the actual value. As a result, even when the detection value of the operating condition parameter deviates from the actual value due to a drift of the detection value detected by the operating condition parameter-detecting means, and wear, contamination, play caused by aging, etc., occurring in component parts of the variable intake mechanism, it is possible to properly determine the fuel amount while compensating for the influence of the above deviation. This makes it possible to properly carry out the air-fuel ratio control, thereby making it possible to ensure a stable combustion state and excellent reduction of exhaust emissions.

Further, by correcting the operating condition parameter according to the state of the air-fuel ratio control or the air-fuel ratio parameter, both reflecting the deviation of the air-fuel ratio, it is possible to properly correct the deviation between the detection value of the operating condition parameter and the actual value. As a result, even when the detection value of the operating condition parameter deviates from the actual value due to a drift of the detection value detected by operating condition parameter-detecting means, and wear, contamination, play caused by aging, etc., occurring in component parts of the variable intake mechanism, it is possible to properly determine the ignition timing while compensating for the influence of the above deviation. This makes it possible to properly ensure excellent accuracy of the ignition timing control, thereby making it possible to maintain excellent combustion efficiency and fuel economy.

Therefore, the present invention can be applied to a control system for internal combustion engines, and is useful in that the control system is capable of properly performing the air-fuel ratio control and the ignition timing control according to the actual intake air amount even when reliability of results of detection of the operating condition of the variable intake mechanism is low, the former control making it possible to ensure a stable combustion state and excellent reduction of exhaust emissions, and the latter control making it possible to properly ensure excellent accuracy of the ignition timing control, thereby making it possible to maintain excellent combustion efficiency and fuel economy.

The invention claimed is:

1. A control system for an internal combustion engine, which controls an amount of intake air drawn into a cylinder of the engine by a variable intake mechanism and controls an amount of fuel to be supplied to a combustion chamber, to thereby control an air-fuel ratio of a mixture in the combustion chamber, comprising:

operating condition parameter-detecting means for detecting an operating condition parameter indicative of an operating condition of the variable intake mechanism;

air-fuel ratio parameter-detecting means for detecting an air-fuel ratio parameter indicative of an air-fuel ratio of exhaust gases flowing through an exhaust passage of the engine;

target air-fuel ratio-calculating means for calculating a target air-fuel ratio to which the air-fuel ratio of the mixture is to be controlled;

air-fuel ratio control parameter-calculating means for calculating an air-fuel ratio control parameter for controlling an air-fuel ratio of the mixture such that the air-fuel ratio becomes equal to the target air-fuel ratio, according to the air-fuel ratio parameter;

correction means for correcting the operating condition parameter according to one of the air-fuel ratio control parameter and the air-fuel ratio parameter; and fuel amount-determining means for determining the amount of fuel according to the corrected operating condition parameter and the air-fuel ratio control parameter.

2. A control system as claimed in claim 1, wherein said correction means calculates a control state value indicative of a state of control of the air-fuel ratio of the mixture based on one of the air-fuel ratio control parameter and the air-fuel ratio parameter, calculates a statistically processed value by performing a predetermined sequential statistical process on the control state value, and corrects the operating condition parameter according to the statistically processed value.

3. A control system as claimed in claim 2, wherein when the statistically processed value is outside a predetermined range, said correction means corrects the operating condition parameter according to the statistically processed value such that the statistically processed value comes to be within the predetermined range, and holds an amount of correction of said operating condition parameter at a fixed value when the statistically processed value is within the predetermined range.

4. A control system as claimed in any one of claims 1 to 3, further comprising:

air flow rate-detecting means for detecting a flow rate of air flowing through an intake passage of the engine; and load parameter-detecting means for detecting a load parameter indicative of load on the engine, and wherein said fuel amount-determining means determines the amount of fuel according to the corrected operating condition parameter and the air-fuel ratio control parameter when the load parameter is within a first predetermined range, and determines the amount of fuel according to the flow rate of air and the air-fuel ratio control parameter when the load parameter is within a second predetermined range different from the first predetermined range.

5. A control system for an internal combustion engine, which controls an amount of intake air drawn into a cylinder of the engine by a variable intake mechanism, and controls ignition timing and an air-fuel ratio of a mixture in a combustion chamber, comprising:

operating condition parameter-detecting means for detecting an operating condition parameter indicative of an operating condition of the variable intake mechanism;

air-fuel ratio parameter-detecting means for detecting an air-fuel ratio parameter indicative of an air-fuel ratio of exhaust gases flowing through an exhaust passage of the engine;

target air-fuel ratio-setting means for setting a target air-fuel ratio to which the air-fuel ratio of the mixture is to be controlled;

air-fuel ratio control means for controlling the air-fuel ratio of the mixture such that the air-fuel ratio becomes equal to the target air-fuel ratio, according to the air-fuel ratio parameter;

correction means for correcting the operating condition parameter according to one of a state of control of the air-fuel ratio of the mixture by said air-fuel ratio control means, and the air-fuel ratio parameter; and ignition timing-determining means for determining the ignition timing according to the corrected operating condition parameter.

6. A control system as claimed in claim 5, wherein said air-fuel ratio control means calculates an air-fuel ratio control parameter for controlling the air-fuel ratio of the mixture such that the air-fuel ratio becomes equal to the target air-fuel ratio, according to the air-fuel ratio parameter, and wherein said correction means calculates a control state value indicative of a state of control of the air-fuel ratio of the mixture based on one of the air-fuel ratio control parameter and the air-fuel ratio parameter, calculates a statistically processed value by performing a predetermined sequential statistical process on the control state value, and corrects the operating condition parameter according to the statistically processed value.

7. A control system as claimed in claim 5 or 6, further comprising:

air flow rate-detecting means for detecting a flow rate of air flowing through an intake passage of the engine; and load parameter-detecting means for detecting a load parameter indicative of load on the engine, and wherein said ignition timing-determining means determines the ignition timing according to the corrected operating condition parameter when the load parameter is within a first predetermined range, and determines the ignition timing according to the flow rate of air when the load parameter is within a second predetermined range different from the first predetermined range.

* * * * *